US007088290B2

(12) United States Patent
Ohno et al.

(10) Patent No.: US 7,088,290 B2
(45) Date of Patent: Aug. 8, 2006

(54) DIELECTRIC LOADED ANTENNA APPARATUS WITH INCLINED RADIATION SURFACE AND ARRAY ANTENNA APPARATUS INCLUDING THE DIELECTRIC LOADED ANTENNA APPARATUS

(75) Inventors: Takeshi Ohno, Moriguchi (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 340 days.

(21) Appl. No.: 10/649,723

(22) Filed: Aug. 28, 2003

(65) Prior Publication Data

US 2004/0119646 A1 Jun. 24, 2004

(30) Foreign Application Priority Data

Aug. 30, 2002 (JP) ..... P2002-253691

(51) Int. Cl.
*H01Q 1/38* (2006.01)
*H01Q 5/00* (2006.01)
*H01Q 9/04* (2006.01)

(52) U.S. Cl. ..... 343/700 MS

(58) Field of Classification Search ..... 343/700 MS, 343/791, 785, 787, 790, 792, 890
See application file for complete search history.

(56) References Cited

U.S. PATENT DOCUMENTS 5,461,394 A * 10/1995 Weber ..... 343/786
5,757,324 A * 5/1998 Helms et al. ..... 343/700 MS
5,831,581 A * 11/1998 Keough ..... 343/725
6,144,344 A * 11/2000 Kim et al. ..... 343/770
6,147,648 A * 11/2000 Granholm et al. ... 343/700 MS
6,201,509 B1 * 3/2001 Zhang et al. ..... 343/791
6,211,824 B1 * 4/2001 Holden et al. ..... 343/700 MS
6,271,799 B1 * 8/2001 Rief et al. ..... 343/776

FOREIGN PATENT DOCUMENTS

JP 3-139903 6/1991
JP 2000-278030 10/2000
JP 2002-185240 6/2002

OTHER PUBLICATIONS

Tetsuo Tsugawa et al., entitled "*Fat Dielectric Loaded Antenna* ", Proceedings of 1999 IEICE (The Institute Electronics, Information and Communications Engineers in Japan) General Convention, B-1-119, pp. 119, issued to: IEICE, Mar. 1999 , (with partial English translation attached).

* cited by examiner

*Primary Examiner*—Wilson Lee
*Assistant Examiner*—Huedung X. Cao
(74) *Attorney, Agent, or Firm*—Wenderoth, Lind & Ponack, L.L.P.

(57) ABSTRACT

A dielectric loaded antenna apparatus has a column-shaped loaded dielectric which is loaded on an end portion of a feeding line of the dielectric loaded antenna apparatus. The loaded dielectric has an inclined radiation surface which is inclined from a surface perpendicular to an axial direction of the loaded dielectric. A cross section of the loaded dielectric perpendicular to the axial direction of the loaded dielectric has a shape of one of a circle, ellipse and polygon. The feeding line is a waveguide which includes a radiation waveguide and a feeding waveguide. The radiation waveguide has an axis parallel to the axial direction of the loaded dielectric and includes an opening for feeding an electromagnetic wave to the loaded dielectric. The feeding waveguide feeds the electromagnetic wave to the radiation waveguide.

51 Claims, 43 Drawing Sheets

FIRST PREFERRED EMBODIMENT

FIRST PREFERRED EMBODIMENT

FIRST MODIFIED PREFERRED EMBODIMENT
OF FIRST PREFERRED EMBODIMENT

SECOND MODIFIED PREFERRED EMBODIMENT
OF FIRST PREFERRED EMBODIMENT

SECOND PREFERRED EMBODIMENT

THIRD PREFERRED EMBODIMENT

FIRST MODIFIED PREFERRED EMBODIMENT
OF THIRD PREFERRED EMBODIMENT

SECOND MODIFIED PREFERRED EMBODIMENT
OF THIRD PREFERRED EMBODIMENT

THIRD MODIFIED PREFERRED EMBODIMENT
OF THIRD PREFERRED EMBODIMENT

FOURTH MODIFIED PREFERRED EMBODIMENT
OF THIRD PREFERRED EMBODIMENT

FIFTH MODIFIED PREFERRED EMBODIMENT
OF THIRD PREFERRED EMBODIMENT

FIFTH PREFERRED EMBODIMENT

SIXTH PREFERRED EMBODIMENT

SEVENTH PREFERRED EMBODIMENT

FIRST IMPLEMENTAL EXAMPLE
OF SIXTH AND SEVENTH PREFERRED EMBODIMENTS

SECOND IMPLEMENTAL EXAMPLE
OF SIXTH AND SEVENTH PREFERRED EMBODIMENTS

FIRST MODIFIED PREFERRED EMBODIMENT
OF SIXTH AND SEVENTH PREFERRED EMBODIMENTS

SECOND MODIFIED PREFERRED EMBODIMENT
OF SIXTH AND SEVENTH PREFERRED EMBODIMENTS

EIGHTH PREFERRED EMBODIMENT

NINTH PREFERRED EMBODIMENT

MODIFIED PREFERRED EMBODIMENT OF NINTH PREFERRED EMBODIMENT

TENTH PREFERRED EMBODIMENT

ELEVENTH PREFERRED EMBODIMENT

ELEVENTH PREFERRED EMBODIMENT

TWELFTH PREFERRED EMBODIMENT

DIELECTRIC LOADED ANTENNA APPARATUS WITH INCLINED RADIATION SURFACE AND ARRAY ANTENNA APPARATUS INCLUDING THE DIELECTRIC LOADED ANTENNA APPARATUS

BACKGROUND OF THE INVENTION

1. Field of the Invention

The present invention relates to a dielectric loaded antenna apparatus for use in a microwave band, a quasi-millimeter wave band, or a millimeter wave band, an array antenna apparatus including the dielectric loaded antenna apparatus, and a radio communication apparatus including one of the dielectric loaded antenna apparatus and the array antenna apparatus. In particular, the present invention relates to a dielectric loaded antenna apparatus with a loaded dielectric having an inclined radiation surface, an array antenna apparatus including the dielectric loaded antenna apparatus, and a radio communication apparatus including one of the dielectric loaded antenna apparatus and the array antenna apparatus.

2. Description of the Related Art

Conventionally, a dielectric loaded antenna apparatus having a loaded dielectric which is loaded on a feeder circuit which is constituted by a microstrip line, a waveguide or the like has been often used as an antenna for use in a radio communication apparatus in a microwave band, a quasi-millimeter wave band or a millimeter wave band, as disclosed in, for example, the Japanese patent laid-open publication No. 2002-185240, and a prior art document of Tetsuo Tsugawa et. al, "Fat Dielectric Loaded Antenna", Proceedings of 1999 IEICE (The Institute of Electronics, Information and Communications Engineers in Japan) General Convention, B-1-119, pp. 119, issued by IEICE, March 1999.

FIG. 41 is an exploded perspective view showing a configuration of a conventional waveguide feeding type dielectric loaded antenna apparatus. The conventional waveguide feeding type dielectric loaded antenna apparatus shown in FIG. 41 is characterized in that a feeding waveguide 4 and a radiation waveguide 7 are each formed by a lower conductor substrate 11 and an upper conductor substrate 12, and in that a loaded dielectric 108 including a circular dielectric column is provided on the upper conductor substrate to cover a radiation opening 107 of the radiation waveguide 7. A lower rectangular groove 2 having a rectangular cross section is formed on a top surface of the lower conductor substrate 11. One end of the lower rectangular groove 2 passes through a bottom surface of the lower conductor substrate 11 to be connected with a feeding opening 1, and another end of the lower rectangular groove 2 is connected with a lower radiation waveguide chamber 5 having a rectangular cross section. The lower radiation waveguide chamber 5 is formed by boring the lower conductor substrate 11 in the thickness direction thereof from the top surface by a predetermined depth. An upper rectangular groove 3 which has a rectangular cross section and which corresponds to the lower rectangular groove 2 is formed on a bottom surface of the upper conductor substrate 12. One end of the upper rectangular groove 3 is connected with an upper radiation waveguide chamber 6 which passes through the upper conductor substrate 12 in the thickness direction and which has a rectangular cross section.

Further, when the lower conductor substrate 11 and the upper conductor substrate 12 are superimposed on each other so that the lower rectangular groove 2 opposes to the upper rectangular groove 3 and so that the lower radiation waveguide chamber 5 opposes to the upper radiation waveguide chamber 6, the lower rectangular groove 2 and the upper rectangular groove 3 constitute the feeding waveguide 4 having a rectangular cross section and also the lower radiation waveguide chamber 5 and the upper radiation waveguide chamber 6 constitute the radiation waveguide 7 having a rectangular cross section. A length of the radiation waveguide 7 in a guide or tube axial direction or a guide or tube direction (namely, the vertical direction) is set to $n \times \lambda g/2$ (where n is a natural number) when a guide wavelength that corresponds to an operating wavelength of the antenna apparatus is set to $\lambda g$. The loaded dielectric 108 is fixedly attached onto the radiation opening 107 of the upper conductor substrate 12 so that a central axis in the vertical direction of the radiation waveguide 7 coincides with the central axis in the vertical direction of the loaded dielectric 108.

An electromagnetic wave input from the feeding opening 1 progresses or travels into the feeding waveguide 4, and the progressive electromagnetic wave passes through the radiation waveguide 7, then being fed to the loaded dielectric 108. In this case, there appear two types of waves, i.e., the electromagnetic wave that passes through the loaded dielectric 108 and a surface wave that progresses or travels along a surface of the loaded dielectric 108. By determining dimensions of the loaded dielectric 108 so that the two type waves are made to be in phase on a horizontal surface S0 that is a top surface or a radiation surface of the loaded dielectric 108, the present dielectric loaded antenna apparatus operates as a high-gain antenna. The dielectric loaded antenna apparatus can attain high gain characteristics with a small size, so that the loaded antenna apparatus can operate as a high efficient antenna.

Now, an xyz coordinate system as shown in FIG. 41 with a center of the radiation opening 107 of the radiation waveguide 7 set as an origin will be referred to hereinafter. In the configuration shown in FIG. 41, it is assumed, for example, that the lower conductor substrate 11 is made of aluminum and has horizontal dimensions of 100 mm×100 mm and a thickness of 3 mm and that the upper conductor substrate 12 is made of aluminum and has horizontal dimensions of 100 mm×100 mm and a thickness of 2.5 mm. It is also assumed, for example, that the cross section of the feeding waveguide 4 when the lower conductor substrate 11 is coupled with the upper conductor substrate 12 has a vertical length of 3.76 mm and a horizontal length of 1.88 mm, the horizontal cross section of the radiation waveguide 7 has cross sectional dimensions of 2.8 mm×2.8 mm, the column-shaped loaded dielectric 108 is made of polypropylene having a dielectric constant of 2.26, and has dimensions of 6 mm in a diameter $\phi$ and 7 mm in a length L.

FIG. 42 is a graph showing a radiation directivity pattern on the xz plane of the dielectric loaded antenna apparatus of FIG. 41 which was manufactured to have the above-mentioned dimensions. As shown in FIG. 42, the radiation directivity pattern of the conventional dielectric loaded antenna apparatus has a beam direction of a +z direction that is a front direction perpendicular to the top surface of the upper conductor substrate 12. In other words, if the column-shaped or cubic-shaped loaded dielectric 108 is employed, the radiation directivity pattern has a beam direction in a direction toward a direction in which the dielectric is loaded on the conductor substrate. This is because on the surface of the loaded dielectric 108, the amplitude and the phase of the propagating electromagnetic wave are axial symmetric with respect to the central axis of the loaded dielectric 108.

Therefore, in order to radiate the electromagnetic wave in a desirable direction other than the +z direction, it is necessary to direct the whole dielectric loaded antenna apparatus to the desirable direction.

Furthermore, since the dielectric loaded antenna apparatus has a high gain characteristic, the dielectric loaded antenna apparatus has such a feature of a narrower beam of the radiation directivity characteristic thereof, then having a narrower coverage area. In a frequency band such as a millimeter wave band whose spatial loss is relatively large, the antenna apparatus is required to have a high gain upon designing telecommunication circuits. However, depending on the purpose, the antenna apparatus is required to have a wider coverage area, and then the antenna apparatus is required to satisfy the above two contradicting relations simultaneously.

SUMMARY OF THE INVENTION

An essential object of the present invention is to provide a dielectric loaded antenna apparatus which can solve the above-mentioned problems and which has a radiation directivity pattern that is not restricted by the installation direction of the antenna apparatus itself.

Another object of the present invention is to provide a dielectric loaded antenna apparatus which can solve the above-mentioned problems and which has a radiation directivity pattern capable of covering an area wider than that of the prior art.

A further object of the present invention is to further provide an array antenna apparatus utilizing the dielectric loaded antenna apparatus, and a radio communication apparatus employing these antenna apparatuses.

According to one aspect of the present invention, there is provided a dielectric loaded antenna apparatus including a column-shaped loaded dielectric which is loaded on an end portion of a feeding line of the dielectric loaded antenna apparatus. The loaded dielectric has an inclined radiation surface which is inclined from a surface perpendicular to an axial direction of the loaded dielectric.

In the above-mentioned dielectric loaded antenna apparatus, a cross section of the loaded dielectric perpendicular to the axial direction of the loaded dielectric preferably has a shape of one of circle, ellipse and polygon.

In the above-mentioned dielectric loaded antenna apparatus, the feeding line is preferably a waveguide. The waveguide includes a radiation waveguide and a feeding waveguide. The radiation waveguide has an axis parallel to the axial direction of the loaded dielectric and includes an opening for feeding an electromagnetic wave to the loaded dielectric. The feeding waveguide feeds the electromagnetic wave to the radiation waveguide.

In the above-mentioned dielectric loaded antenna apparatus, a dielectric is preferably filled into an interior of the waveguide.

In the above-mentioned dielectric loaded antenna apparatus, the loaded dielectric is preferably arranged so that a central axis of the loaded dielectric is shifted from a central axis of the radiation waveguide.

In the above-mentioned dielectric loaded antenna apparatus, the loaded dielectric is preferably arranged so that a central axis of the loaded dielectric is shifted from a central axis of the radiation waveguide toward one of a polarization direction of the electromagnetic wave and a direction perpendicular to the polarization direction thereof.

In the above-mentioned dielectric loaded antenna apparatus, the feeding waveguide is preferably arranged so that a central axis of the feeding waveguide in the axial direction is shifted from a center of the radiation waveguide.

In the above-mentioned dielectric loaded antenna apparatus, the feeding line is preferably a microstrip line formed on a dielectric substrate. A feeding patch conductor which feeds an electromagnetic wave to the loaded dielectric is provided on an end portion of the microstrip line.

In the above-mentioned dielectric loaded antenna apparatus, the loaded dielectric is preferably arranged so that a central axis of the loaded dielectric is shifted from a center of the feeding patch conductor.

In the above-mentioned dielectric loaded antenna apparatus, the loaded dielectric is preferably arranged so that the central axis of the loaded dielectric is shifted from the center of the feeding patch conductor toward one of a polarization direction of the electromagnetic wave and a direction perpendicular direction to the polarization direction thereof.

In the above-mentioned dielectric loaded antenna apparatus, the microstrip line is preferably arranged so that a central axis of the microstrip line is shifted from the center of the feeding patch conductor.

The above-mentioned dielectric loaded antenna apparatus preferably further includes a radome which covers the dielectric loaded antenna apparatus. The radome and the loaded dielectric are formed integrally with each other.

In the above-mentioned dielectric loaded antenna apparatus, the feeding line preferably includes a waveguide and a microstrip line. The dielectric loaded antenna apparatus further includes a converter which is inserted between the waveguide and the microstrip line and which matches impedance between the waveguide to the microstrip line.

In the above-mentioned dielectric loaded antenna apparatus, the inclined surface of the loaded dielectric is preferably one of a surface inclined from an electric field plane of a radiated electromagnetic wave and a surface inclined from a magnetic field plane of the radiated electromagnetic wave.

The above-mentioned dielectric loaded antenna apparatus preferably further includes circularly polarized wave radiating device for radiating an electromagnetic wave radiated from the dielectric loaded antenna apparatus as a circularly polarized wave.

In the above-mentioned dielectric loaded antenna apparatus, the feeding line is preferably a waveguide, and the waveguide includes a radiation waveguide and a feeding waveguide. The radiation waveguide has an axis parallel to the axial direction of the loaded dielectric and including an opening for feeding an electromagnetic wave to the loaded dielectric. The feeding waveguide feeds the electromagnetic wave to the radiation waveguide. The circularly polarized wave radiating device is constituted by forming the opening of the feeding waveguide in a hexagonal shape.

According to another aspect of the present invention, there is provided an array antenna apparatus including a plurality of dielectric loaded antenna apparatuses which are arranged to be apart from each other by a predetermined distance. Each of the dielectric loaded antenna apparatuses includes a column-shaped loaded dielectric which is loaded on an end portion of a feeding line of the dielectric loaded antenna apparatus. The loaded dielectric has an inclined radiation surface which is inclined from a surface perpendicular to an axial direction of the loaded dielectric.

In the above-mentioned array antenna apparatus, respective inclined surfaces of the loaded dielectrics of the dielectric loaded antenna apparatuses are preferably inclined at a predetermined inclination angle in a predetermined direction so as to attain a predetermined directivity pattern of the array antenna apparatus.

The above-mentioned array antenna apparatus preferably further includes a switching device for selectively switching the loaded dielectrics to connect the selected loaded dielectric to the feeding line.

In the above-mentioned array antenna apparatus, arrangement of the respective loaded dielectrics is preferably changed according to an installation position of the array antenna apparatus.

In the above-mentioned array antenna apparatus, a part of each of the loaded dielectrics is preferably eliminated according to an installation position of the array antenna apparatus.

In the above-mentioned array antenna apparatus, the dielectric loaded antenna apparatuses are preferably arranged so that linear polarized waves of the electromagnetic waves radiated from each pair of dielectric loaded antenna apparatuses arranged to be adjacent to each other among the dielectric loaded antenna apparatuses are perpendicular to each other.

According to a further aspect of the present invention, there is provided a radio communication apparatus including a dielectric loaded antenna apparatus and a radio transceiver circuit. The dielectric loaded antenna apparatus is arranged on a substrate, and the dielectric loaded antenna apparatus includes a column-shaped loaded dielectric which is loaded on an end portion of a feeding line of the dielectric loaded antenna apparatus. The loaded dielectric has an inclined radiation surface which is inclined from a surface perpendicular to an axial direction of the loaded dielectric. The radio transceiver circuit is provided either one of on a surface of the substrate and in the substrate, and the radio transceiver circuit is connected with the dielectric loaded antenna apparatus.

The above-mentioned radio communication apparatus preferably further includes a modulator and demodulator circuit provided on the surface of the substrate or in the substrate, and the modulator and demodulator circuit is connected with the radio transceiver circuit.

According to a still further aspect of the present invention, there is provided a radio communication apparatus including an array antenna apparatus and a radio transceiver circuit. The array antenna apparatus is arranged on a substrate, and the array antenna apparatus includes a plurality of dielectric loaded antenna apparatuses which are arranged to be apart from each other by a predetermined distance. Each of the dielectric loaded antenna apparatuses includes a column-shaped loaded dielectric which is loaded on an end portion of a feeding line of the dielectric loaded antenna apparatus. The loaded dielectric has an inclined radiation surface which is inclined from a surface perpendicular to an axial direction of the loaded dielectric. The radio transceiver circuit is provided either one of on a surface of the substrate and in the substrate, and the radio transceiver circuit is connected with the array antenna apparatus.

The radio communication apparatus preferably further includes modulator and demodulator circuit provided either one of on the surface of the substrate and in the substrate, and the modulator and demodulator circuit being connected with the radio transceiver circuit.

According to the present invention, it is possible to incline a main beam of the antenna apparatus from the direction perpendicular to the surface of the antenna apparatus and to also freely set a radiation direction thereof.

Further, it is possible to realize an antenna apparatus which can freely set the radiation directivity pattern of the array antenna apparatus and which can cover a wider area with a higher gain.

Moreover, it is possible to manufacture an antenna apparatus which includes a radio transceiver circuit and the like to be small in size and light in weight as compared with the prior art.

BRIEF DESCRIPTION OF THE DRAWINGS

These and other objects and features of the present invention will become clear from the following description taken in conjunction with the preferred embodiments thereof with reference to the accompanying drawings throughout which like parts are designated by like reference numerals, and in which.

DETAILED DESCRIPTION OF THE PREFERRED EMBODIMENTS

Figure 1:
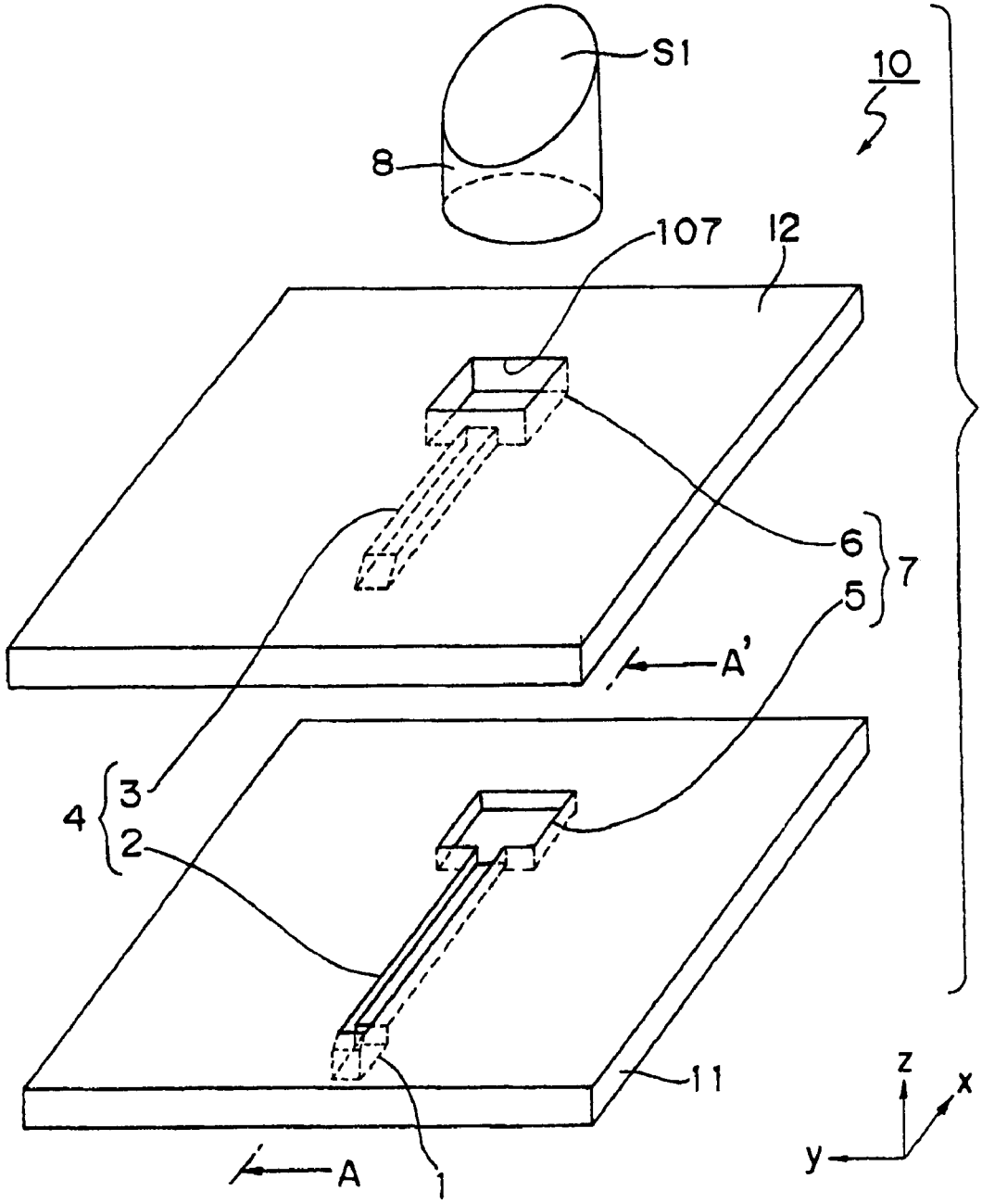
FIG. 1 is an exploded perspective view showing a configuration of a dielectric loaded antenna apparatus 10 of a first preferred embodiment according to the present invention.

Preferred embodiments according to the present invention will now be described with reference to the drawings. It should be noted, however, that the respective preferred embodiments disclosed hereinafter are given only for illustrative purposes and that the present invention is not limited to these preferred embodiments. In the drawings, the same or similar components are denoted by the same numerical references in the drawings and will not be repeatedly described.

First Preferred Embodiment

Figure 2:
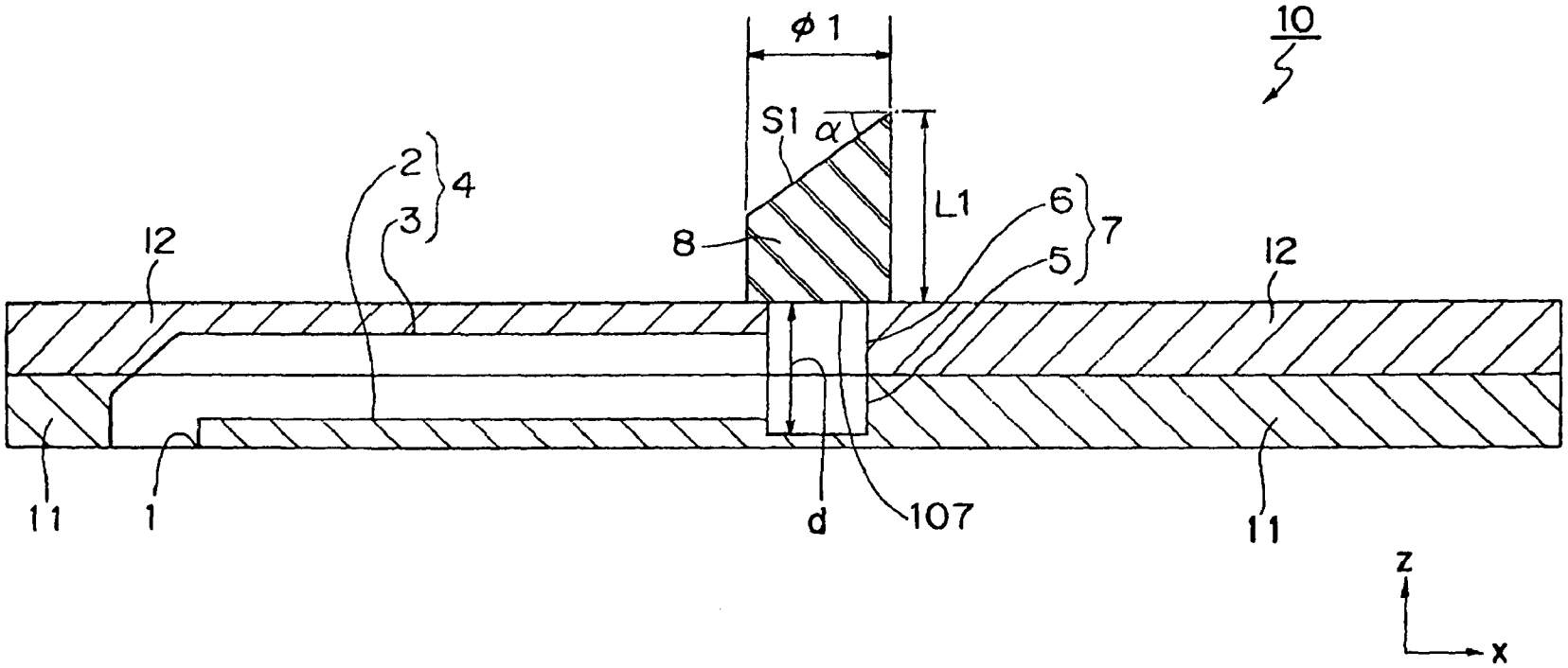
FIG. 2 is a longitudinal sectional view taken along a line A–A' of FIG. 1.

FIG. 1 is an exploded perspective view showing a configuration of a dielectric loaded antenna apparatus 10 of a first preferred embodiment according to the present invention. FIG. 2 is a longitudinal sectional view taken along a line A–A' of FIG. 1. In all the preferred embodiments to be described later, an xyz coordinate system as shown in the drawings with a center of the radiation opening 107 of the radiation waveguide 7 set as an origin is referred to hereinafter, then the +z direction is referred to as an upper direction and the −z direction is referred to as a lower direction.

Figure 41:
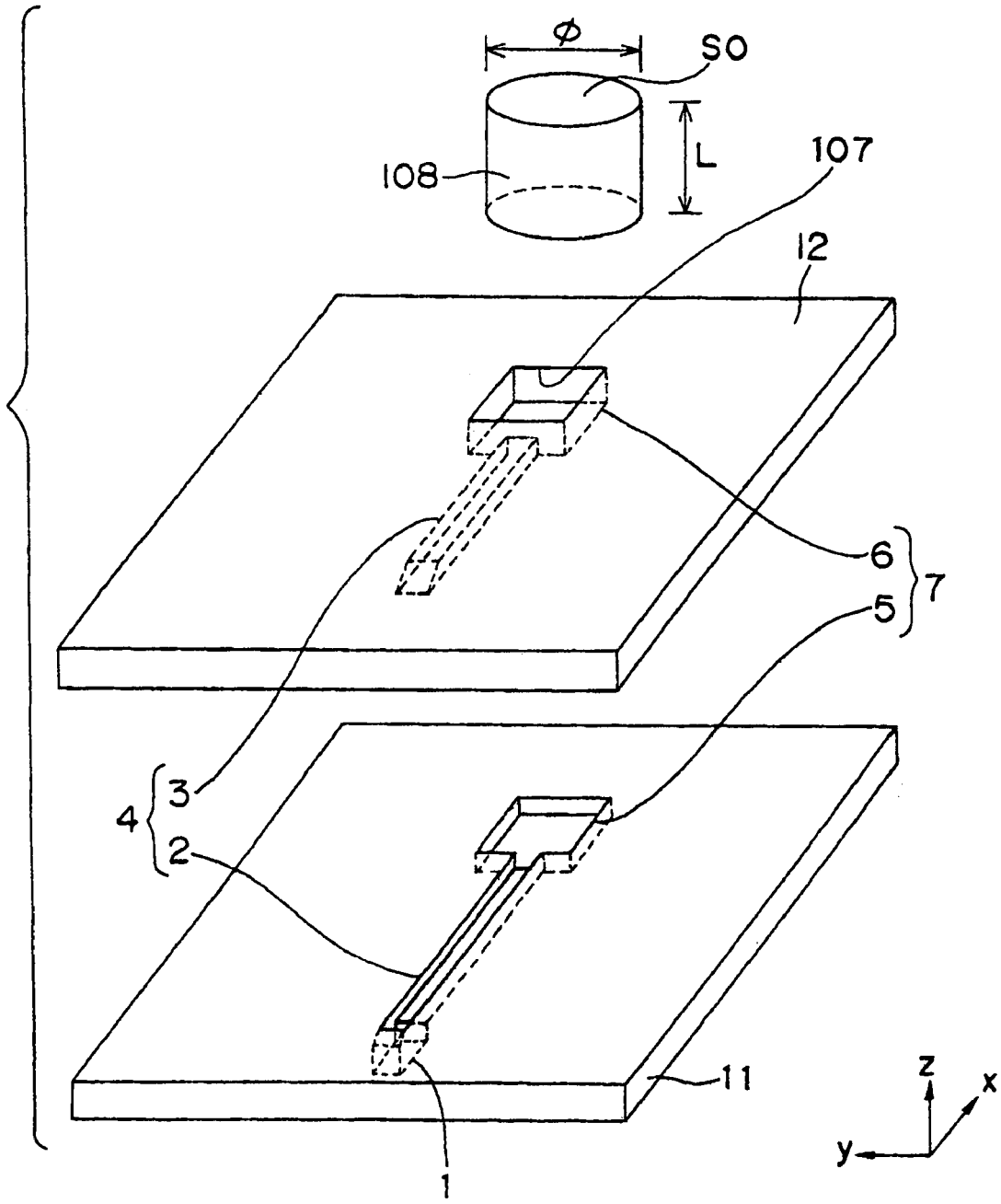
Fig.41 PRIOR ART
FIG. 41 is an exploded perspective view showing a configuration of a dielectric loaded antenna apparatus of a prior art.
Figure 42:
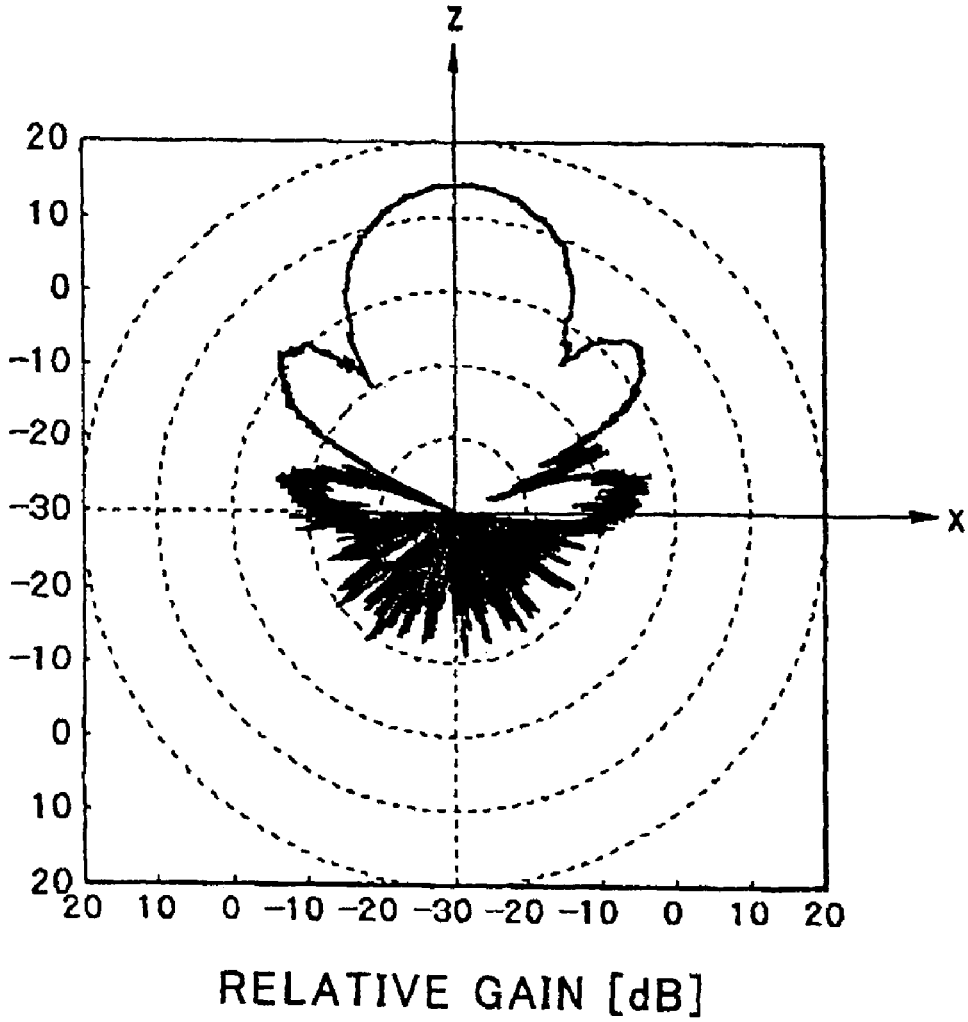
Fig. 42 PRIOR ART
FIG. 42 is a graph showing a radiation directivity pattern on the xz plane of the dielectric loaded antenna apparatus shown in FIG. 41.

The loaded dielectric 108 of the conventional dielectric loaded antenna apparatus shown in FIG. 41 has a shape of circular column having a horizontal surface S0 as the top surface thereof, from which an electromagnetic wave is radiated and received. On the other hand, the dielectric loaded antenna apparatus 10 of the present preferred embodiment includes a circular-column-shaped loaded dielectric 8 which is cut so as to be inclined from the horizontal plane and thereby has an inclined surface S1 as shown in FIGS. 1 and 2.

Referring to FIGS. 1 and 2, a lower rectangular groove 2 having a rectangular cross section is formed on a top surface of a lower conductor substrate 11. One end of the lower rectangular groove 2 vertically passes through a bottom surface of the lower conductor substrate 11 to be connected with a feeding opening 1, and another end of the lower rectangular groove 2 is connected with a lower radiation waveguide chamber 5 having a rectangular cross section. In this case, the lower radiation waveguide chamber 5 is formed by boring the lower conductor substrate 11 in the thickness direction thereof from the top surface by a predetermined depth. Further, an upper rectangular groove 3 which has a rectangular cross section and which corresponds to the lower rectangular groove 2 is formed on a bottom surface of the upper conductor substrate 12, and one end of the upper rectangular groove 3 is connected with an upper radiation waveguide chamber 6 which passes through the upper conductor substrate 12 in the thickness direction thereof and which has a rectangular cross section.

Further, when the lower conductor substrate 11 and the upper conductor substrate 12 are superimposed on each other so that the lower rectangular groove 2 opposes to the upper rectangular groove 3 and so that the lower radiation waveguide chamber 5 opposes to the upper radiation waveguide chamber 6, the lower rectangular groove 2 and the upper rectangular groove 3 constitute a feeding waveguide 4 having a rectangular cross section and the lower radiation waveguide chamber 5 and the upper radiation waveguide chamber 6 constitute a radiation waveguide 7 having a rectangular cross section. A length of the radiation waveguide 7 in a guide axial direction or a guide direction (perpendicular direction) is set to $n \times \lambda g/2$ (where n is a natural number) when a guide wavelength that corresponds to an operating wavelength of the antenna apparatus is set to $\lambda g$. The radiation waveguide 7 operates as a resonator at the operating wavelength. In this case, the loaded dielectric 8 is fixedly attached onto the radiation opening 107 of the upper conductor substrate 12 so that the central axis of the radiation waveguide 7 parallel to the vertical direction coincides with the central axis of the loaded dielectric 8 parallel to the vertical direction.

The vertical direction is defined as a direction perpendicular to the top surface of the upper conductor substrate 12, and the horizontal direction is defined as a direction parallel to the top surface of the upper conductor substrate 12.

Referring to FIG. 2, the loaded dielectric 8 has a shape resulting by cutting the circular-column-shaped dielectric having a diameter $\phi 1$ at an inclination angle $\alpha$ from the horizontal plane which is parallel to the xy plane (which is the top surface of the upper conductor substrate 2) at the position of the maximum length L1 on the side or circumferential surface thereof. The inclined surface S1 of the cut surface is rotated from the horizontal plane or the xy plane on the xz plane so as to be inclined at the inclination angle $\alpha$, and to be directed toward a direction of a combined vector of a vector in the −x direction and a vector in the +z direction. It is noted that the lower conductor substrate 11, the upper conductor substrate 12, and the loaded dielectric 8 are coupled with each other by means such as bonding, screwing, welding or the like.

An electromagnetic wave input from the feeding opening 1 progresses or travels in the feeding waveguide 4 that is formed by coupling the lower conductor substrate 11 to the upper conductor substrate 12. The progressive electromagnetic wave is fed to the loaded dielectric 8 through the radiation waveguide 7. In this case, there appear two types of waves, i.e., the electromagnetic wave that passes through the loaded dielectric 8 and a surface wave that progresses along the surface of the loaded dielectric 8. The dielectric loaded antenna apparatus 10 of the present preferred embodiment is different from the prior art apparatus shown in FIG. 41 at the following point and is also characterized in by the following: the top surface of the loaded dielectric 8 is made as the inclined surface S1 by cutting an upper portion of the column-shaped loaded dielectric 8 so as to be inclined from the horizontal plane parallel to the xy plane. Generally speaking, the propagation velocity of the electromagnetic wave is lower than that that in the free space. Due to this, if the loaded dielectric 8 is formed as mentioned above, the electromagnetic wave fed from the radiation waveguide 7 to the loaded dielectric 8 has an asymmetric phase distribution on outer peripheral surfaces of the loaded dielectric 8, i.e., an outer peripheral surface located in the +x direction and an outer peripheral surface located in the −x direction on the xy plane because of the velocity difference, and the main beam direction of the electromagnetic wave is inclined from the +z direction. In case of the configuration shown in FIG. 2, the inclined surface S1 is inclined in the −x direction whereas the main beam of the electromagnetic wave radiated from the loaded dielectric 8 is inclined in the +x direction.

The results of an experiment of a prototype dielectric loaded antenna apparatus manufactured by the inventors of the present application will now be described. It is assumed that the lower conductor substrate 11 is made of aluminum and has horizontal dimensions of 100 mm×100 mm and a thickness of 3 mm and that the upper conductor substrate 12 is made of aluminum and has horizontal dimensions of 100 mm×100 mm and a thickness of 2.5 mm. It is also assumed that the cross section of the feeding waveguide 4 when the lower conductor substrate 11 is coupled with the upper conductor substrate 12 has a vertical length of 3.76 mm and a horizontal length of 1.88 mm and that the horizontal cross section of the radiation waveguide 7 has cross sectional dimensions of 2.8 mm×2.8 mm. Further, the column-shaped loaded dielectric 8 is made of polypropylene having a dielectric constant of 2.26 and has dimensions of 6 mm in a diameter $\phi$ and 7 mm in a length L1. The inclination angle $\alpha$ is set to one of 15°, 30° and 45° in the implemental example. It is noted that the central axis of the loaded dielectric 8 parallel to the vertical direction coincides with the central axis of the radiation waveguide 7 parallel to the vertical direction.

Figure 3:
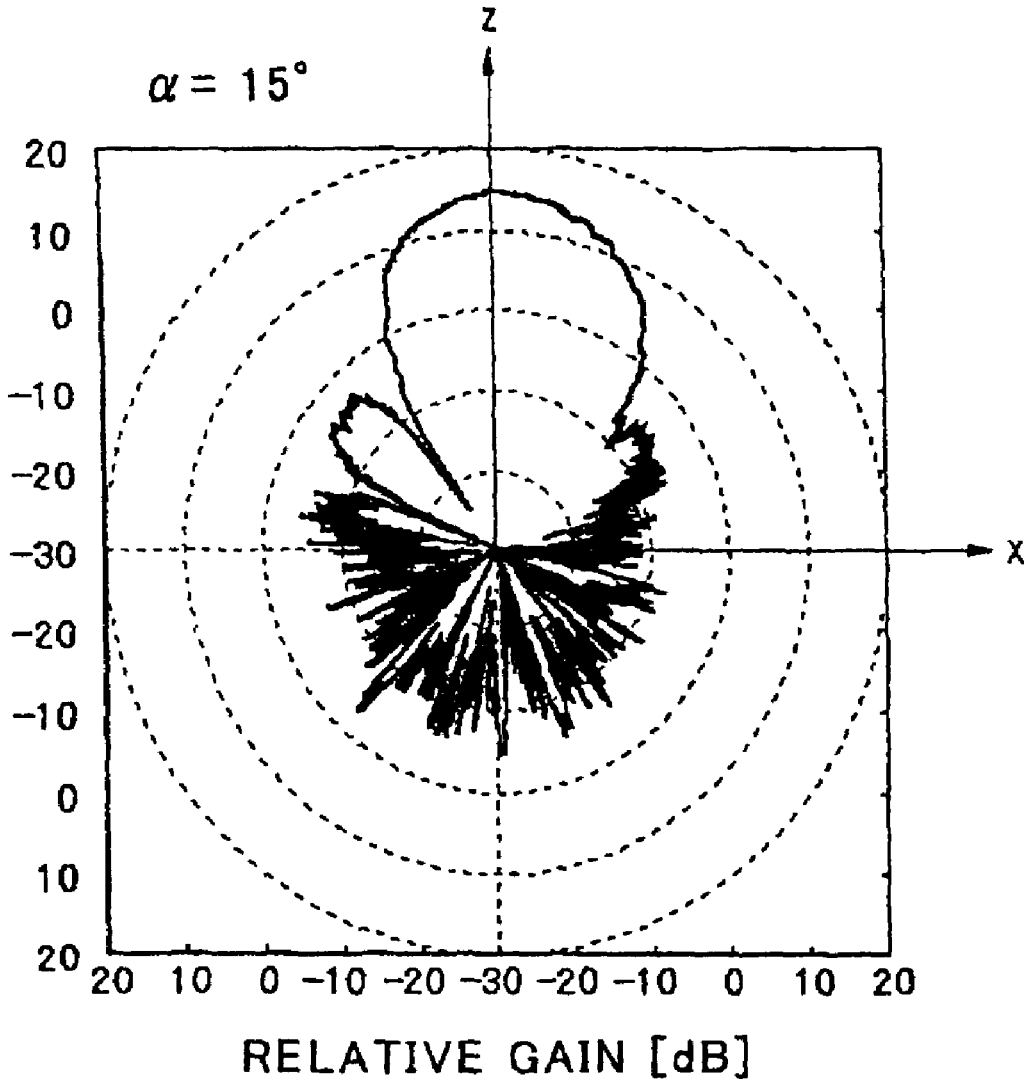
FIG. 3 is a graph showing a radiation directivity pattern of the dielectric loaded antenna apparatus 10 on an xz plane when an inclination angle $\alpha$ of FIG. 2 is set to 15°.
Figure 4:
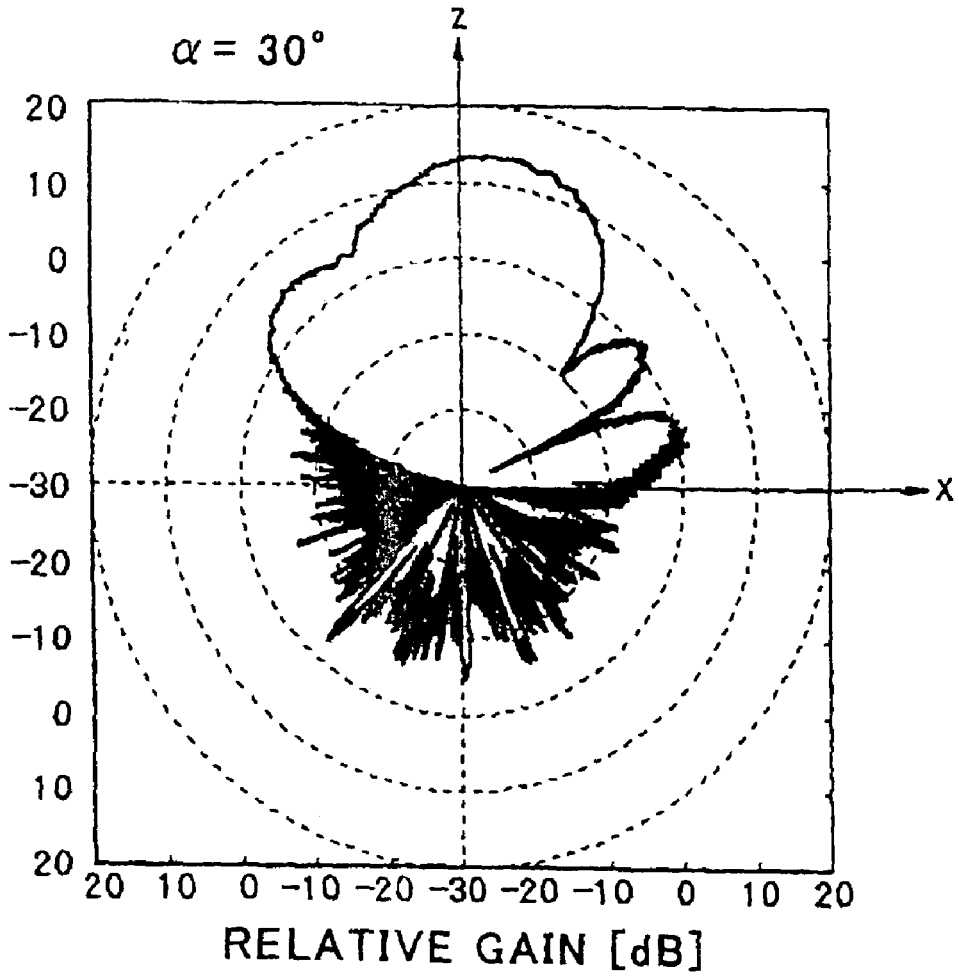
FIG. 4 is a graph showing a radiation directivity pattern of the dielectric loaded antenna apparatus 10 on the xz plane when the inclination angle $\alpha$ of FIG. 2 is set to 30°.
Figure 5:
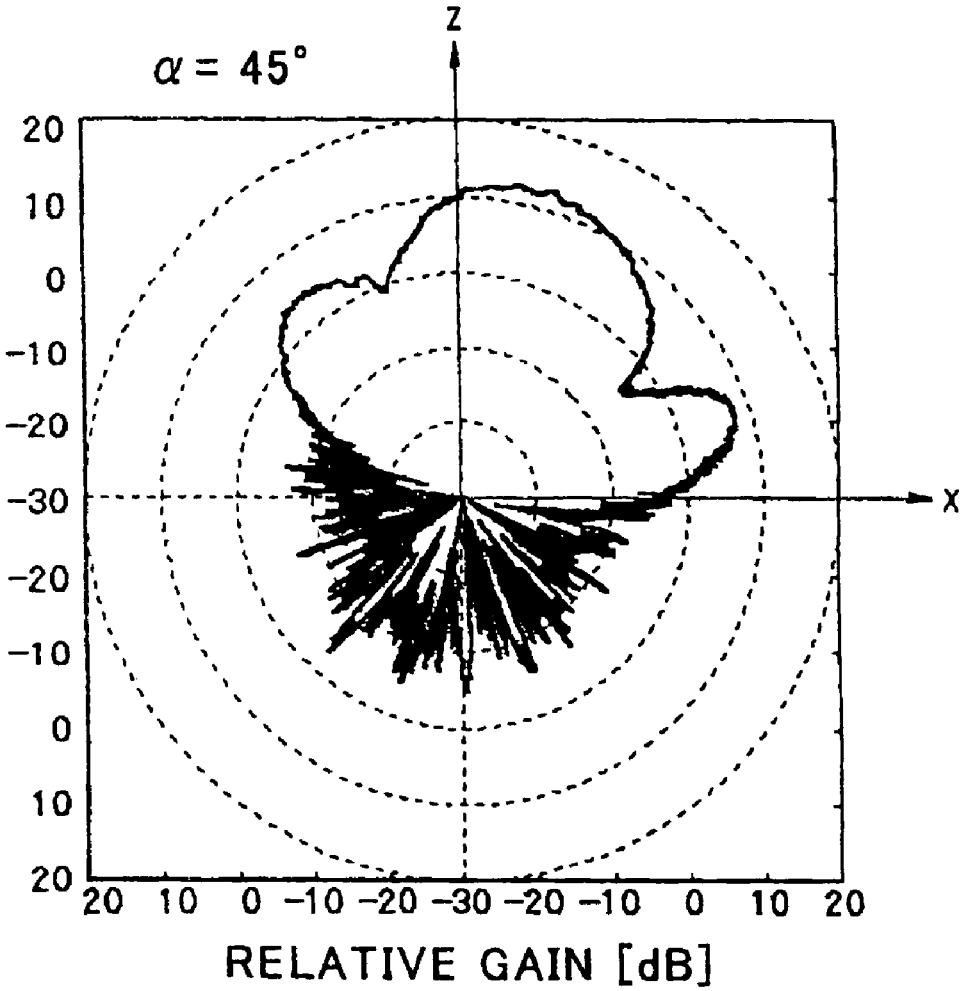
FIG. 5 is a graph showing a radiation directivity pattern of the dielectric loaded antenna apparatus 10 on the xz plane when the inclination angle $\alpha$ of FIG. 2 is set to 45°.

FIGS. 3 to 5 are graphs that illustrate radiation directivity pattern of the dielectric loaded antenna apparatus 10 manufactured to have the above-mentioned dimensions on the xz plane. FIG. 3 shows a radiation directivity pattern thereof when the inclination angle $\alpha$ shown in FIG. 2 is set to 15°, FIG. 4 shows a radiation directivity pattern thereof when the inclination angle $\alpha$ is set to 30°, and FIG. 5 shows a radiation directivity pattern thereof when the inclination angle $\alpha$ is set to 45°. As is apparent from FIGS. 3 to 5, as the inclination angle $\alpha$ is wider, the main beam of the radiated electromagnetic wave is inclined from the +z direction or the vertical direction toward the +x direction.

The results of FIGS. 3 to 5 demonstrate that by inclining the top surface or the radiation surface of the loaded dielectric 8 from the upper conductor substrate 12 to thereby form the inclined surface S1, the inclined surface S1 is inclined from the +z direction or the vertical direction toward the −x direction whereas the main beam of the dielectric loaded antenna apparatus is inclined toward the direction opposite to that of the inclined surface S1 or the +x direction. Further, by increasing the inclination angle $\alpha$of the inclined surface S1 from the horizontal plane, the inclination angle of the main beam of the antenna apparatus from the +z direction can be made to be increased.

As described above, according to the present preferred embodiment, the dielectric loaded antenna apparatus has such a radiation directivity pattern that the main beam which has been directed in the front direction relative to the upper conductor substrate 12 can be inclined and that the angle of the main beam can be controllably operated by changing the inclination angle α.

Figure 6:
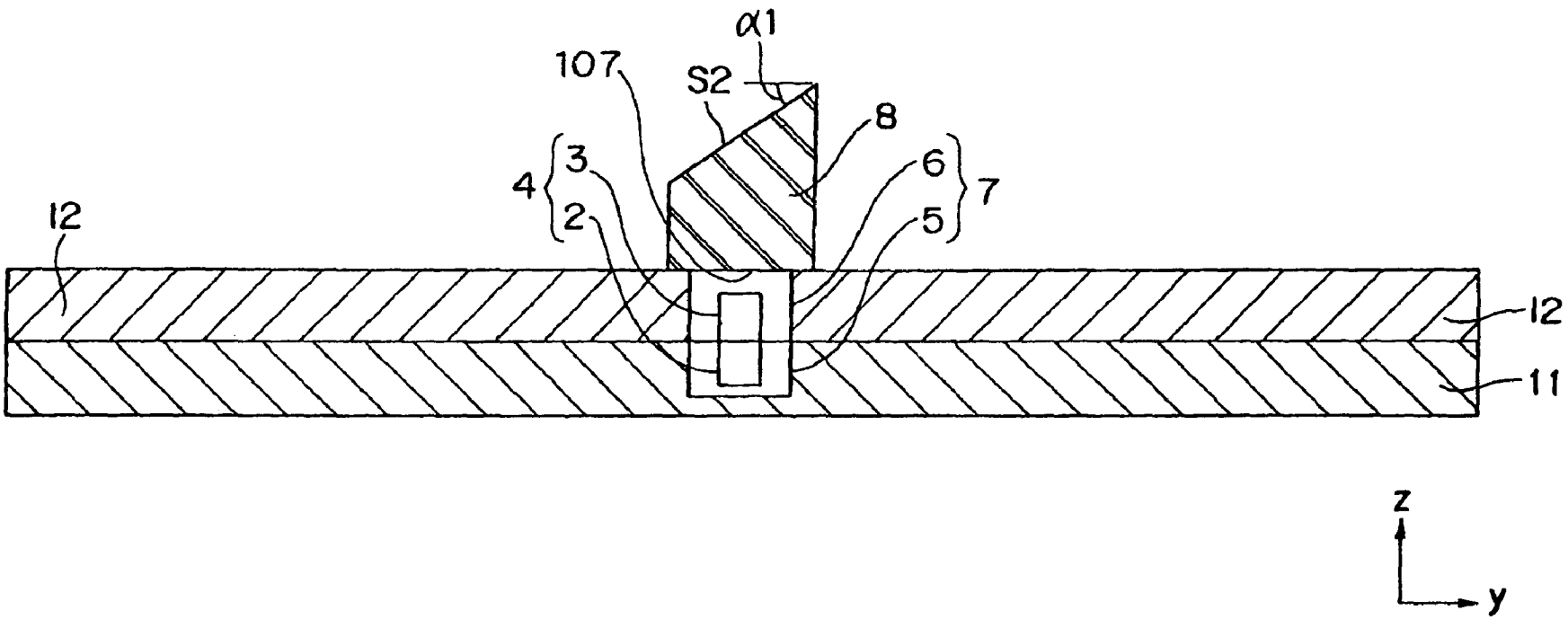
FIG. 6 is a longitudinal sectional view showing a configuration of a dielectric loaded antenna apparatus of a first modified preferred embodiment of the first preferred embodiment.

FIG. 6 is a longitudinal sectional view showing a configuration of a dielectric loaded antenna apparatus of a first modified preferred embodiment of the first preferred embodiment shown in FIG. 1.

Referring to FIG. 6, an inclined surface S2 which is the top surface or the radiation surface of the loaded dielectric 8 is inclined from the +z direction toward the −y direction so as to form an inclination angle α from the horizontal plane which is parallel to the top surface or the xy plane of the upper conductor substrate 12. In other words, the present first modified preferred embodiment is, as compared with the arrangement of the loaded dielectric 8 of the first preferred embodiment shown in FIG. 1, characterized in that the loaded dielectric 8 is arranged to be rotated by 90° from the upper conductor substrate 12. The direction in which the top surface or the radiation surface of the column-shaped loaded dielectric 8 is inclined may not depend on the polarization direction of the transmitted electromagnetic wave. That is, the inclination of the inclined surface S2 may be formed in a direction opposite to a direction (toward the +y direction of FIG. 6) in which the main beam of the antenna apparatus is to be desirably inclined. In case of FIG. 6, the main beam of the radiation characteristic on the yz plane can be inclined by changing the inclination angle α1.

In the first preferred embodiment shown in FIGS. 1 and 2, the inclined surface S1 is formed to be inclined at a predetermined inclination angle α from a plane (parallel to the xy plane of FIG. 2) parallel to the polarization surface of the electric field of the electromagnetic wave that propagates or travels in the feeding waveguide 4 and the radiation waveguide 7. In a manner similar to that as mentioned above, in the first modified preferred embodiment of the first preferred embodiment shown in FIG. 6, the inclined surface S2 is formed to be inclined at the predetermined angle α1 from the plane (parallel to the xy plane of FIG. 2) parallel to the polarization surface of the electric field of the electromagnetic wave that propagates or travels in the feeding waveguide 4 and the radiation waveguide 7.

Figure 7:
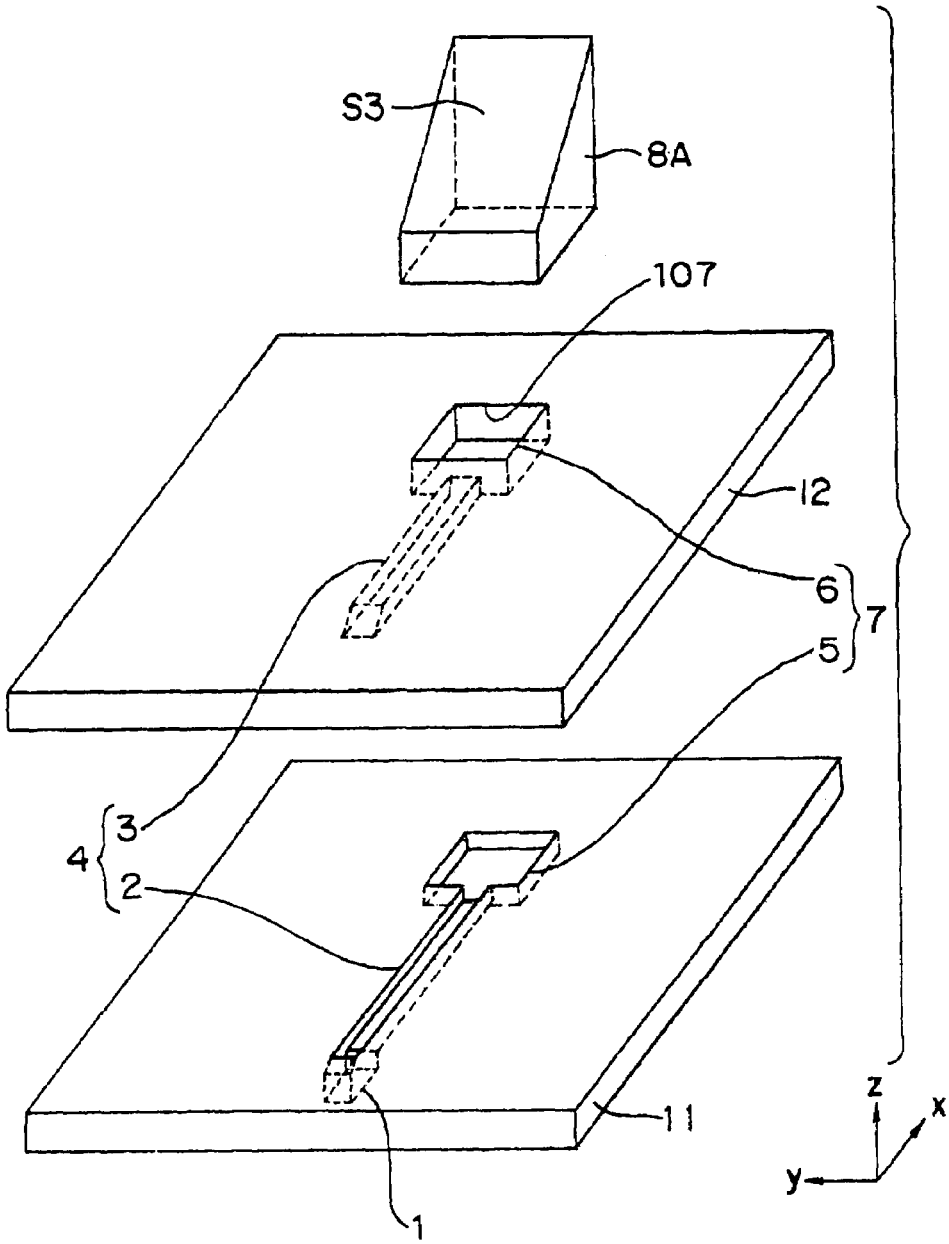
FIG. 7 is a longitudinal sectional view showing a configuration of a dielectric loaded antenna apparatus of a second modified preferred embodiment of the first preferred embodiment.

FIG. 7 is an exploded perspective view showing a configuration of a dielectric loaded antenna apparatus of a second modified preferred embodiment of the first preferred embodiment.

As shown in FIG. 7, the dielectric loaded antenna apparatus of the present second modified preferred embodiment is characterized by including a rectangular-column-shaped loaded dielectric 8A having a square cross section in place of the column-shaped loaded dielectric 8 shown in FIG. 1. In this case, the loaded dielectric 8A is arranged so that four side surfaces of the dielectric 8A are parallel to +x, +y, −x, and −y directions, respectively, and the upper portion of the loaded dielectric 8A is cut to form an inclined surface S3 rotated from the horizontal plane or the xy plane to the xz plane and inclined by a predetermined angle. The inclined surface S3 is directed in a direction of a combined vector of a vector in the −x direction and a vector in the +z direction in a manner similar to that of the first preferred embodiment. In the present second modified preferred embodiment, by providing the loaded dielectric 8A having the square cross section, the design of the antenna apparatus can be advantageously simplified. The cross sectional shape of the loaded dielectric 8 or 8A is not limited to a circular shape or a polygonal shape, however, and this can be an arbitrary shape that can be easily handled upon designing and manufacturing the same antenna apparatus.

In each of the preferred embodiments mentioned above, the antenna apparatus includes the radiation waveguide 7 having the square cross section. However, the present invention is not limited to this, and the radiation waveguide 7 may have a rectangular cross section, a circular cross section or a cross section of the other shape.

In each of the preferred embodiments mentioned above, the antenna apparatus includes the feeding waveguide 4 having the rectangular cross section. However, the present invention is not limited to this, and the feeding waveguide 4 may have a square cross section, a circular cross section or a cross section of the other shape.

Second Preferred Embodiment

Figure 8:
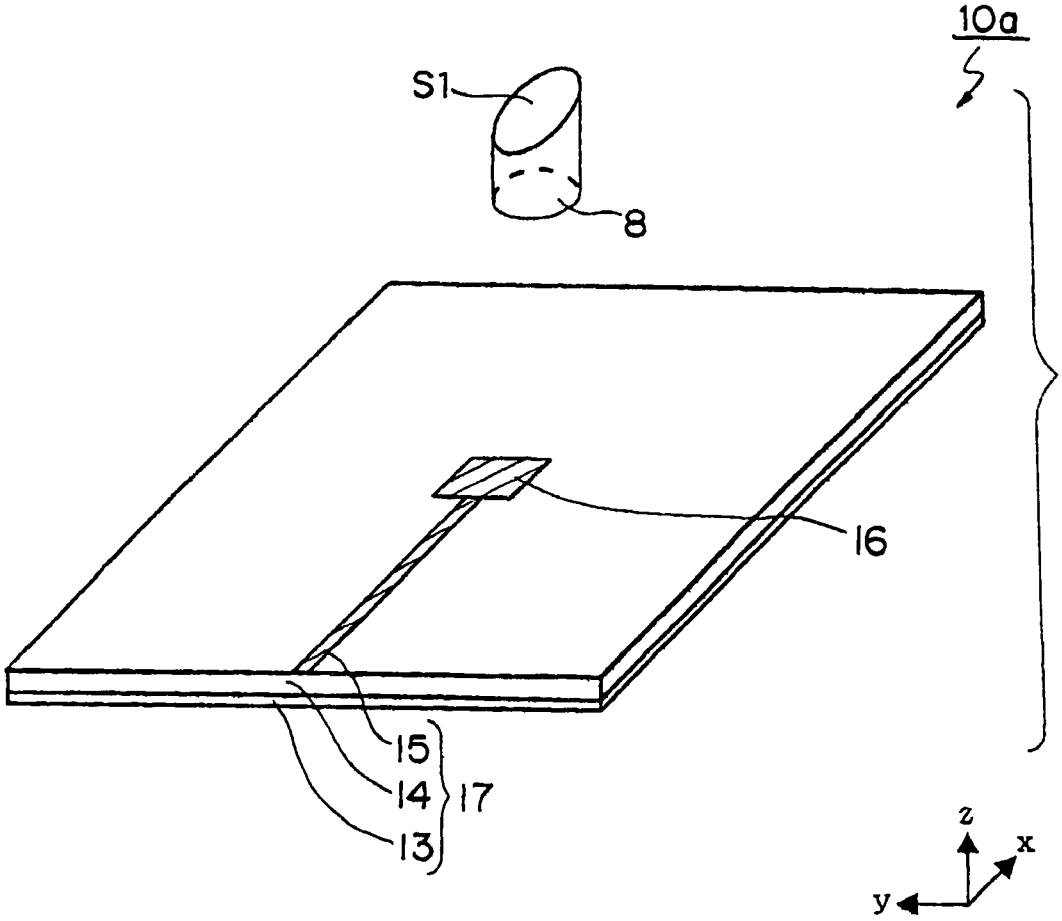
FIG. 8 is an exploded perspective view showing a configuration of a dielectric loaded antenna apparatus 10*a* of a second preferred embodiment according to the present invention.

FIG. 8 is an exploded perspective view showing a configuration of a dielectric loaded antenna apparatus 10*a* of a second preferred embodiment according to the present invention. In the first preferred embodiment shown in FIGS. 1 and 2, the electromagnetic wave is fed by the feeding waveguide 4 and the radiation waveguide 7 provided on the lower conductor substrate 11 and the upper conductor substrate 12. The second preferred embodiment is characterized by feeding an electromagnetic wave by a microstrip line 17 formed on a dielectric substrate 14.

Referring to FIG. 8, a microstrip conductor 15 and a feeding patch conductor 16 are formed on the top surface of the dielectric substrate 14 having conductor layers formed on entire upper and bottom surfaces, respectively, by etching or the like using a pattern mask or the like. In this case, the feeding patch conductor 16 is electrically connected with the microstrip line 17 and the conductor layer formed on the bottom surface of the dielectric substrate 14 serves as a ground conductor 13. The microstrip conductor 15 and the feeding patch conductor 16 are formed so that the longitudinal axis that passes through the center in the width direction of the microstrip conductor 15 can pass through the center of the feeding patch conductor 16. The ground conductor 13 and the microstrip conductor 15, between which the dielectric substrate 14 is provided, constitute the microstrip line 17, and the microstrip line 17 is employed as a transmission line which feeds an electromagnetic wave to the feeding patch conductor 16. Further, the loaded dielectric 8 having the inclined surface S1 similar to that of the first preferred embodiment is fixed onto the feeding patch conductor 16 formed on the dielectric substrate 15 by a method such as bonding, welding or the like.

In the second preferred embodiment mentioned above, the microstrip line 17 operates in a manner similar to that of the feeding waveguide 4 of the first preferred embodiment, and the feeding patch conductor 16 operates in a manner similar to that of the radiation waveguide 7. As described in the second preferred embodiment, if the electromagnetic wave is fed by the microstrip line 17, the feeding loss increases as compared with the feeding of the electromagnetic wave by the rectangular waveguide 4. However, by feeding the electromagnetic wave by the microstrip line 17, it is possible to manufacture a thinner antenna apparatus and make the antenna apparatus smaller in size and lighter in weight.

Third Preferred Embodiment

Figure 9:
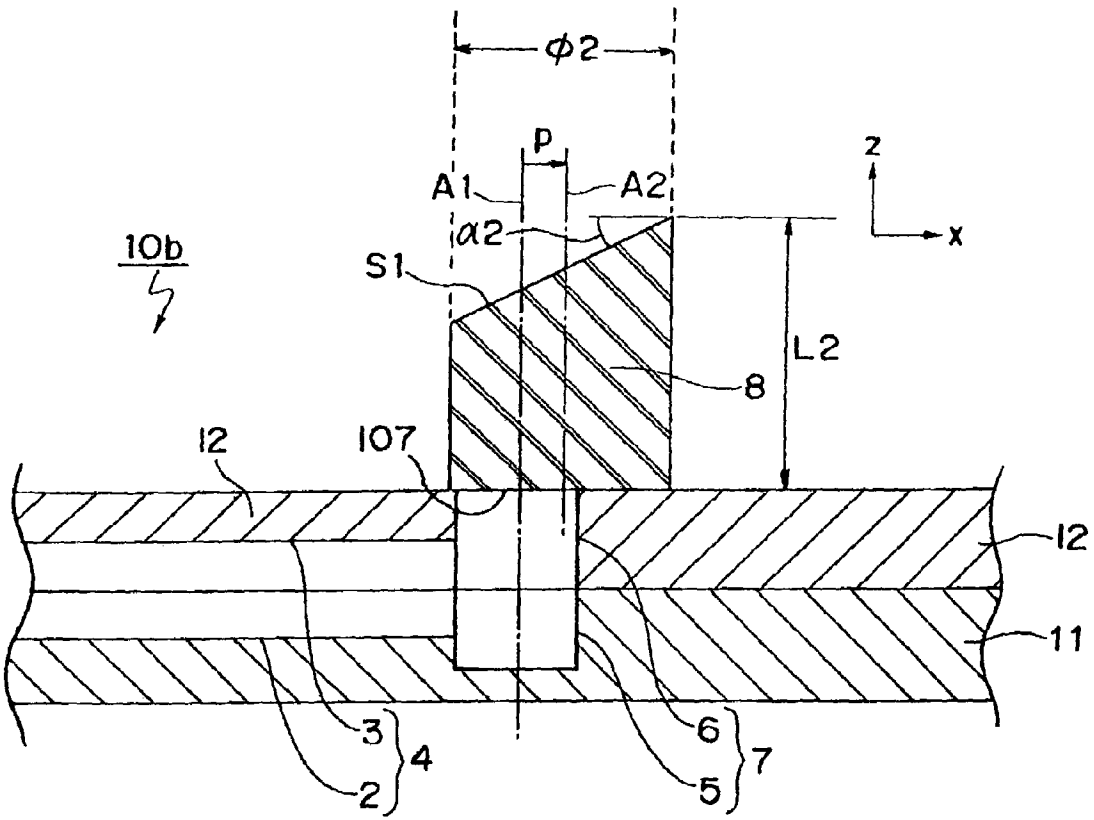
FIG. 9 is an exploded perspective view showing a configuration of a dielectric loaded antenna apparatus 10*b* of a third preferred embodiment according to the present invention.

FIG. 9 is a longitudinal sectional view showing a configuration of a dielectric loaded antenna apparatus 10*b* of the third preferred embodiment according to the present invention while the arrangement of the loaded dielectric 8 and the radiation waveguide 7 is shown to be enlarged.

Figure 10:
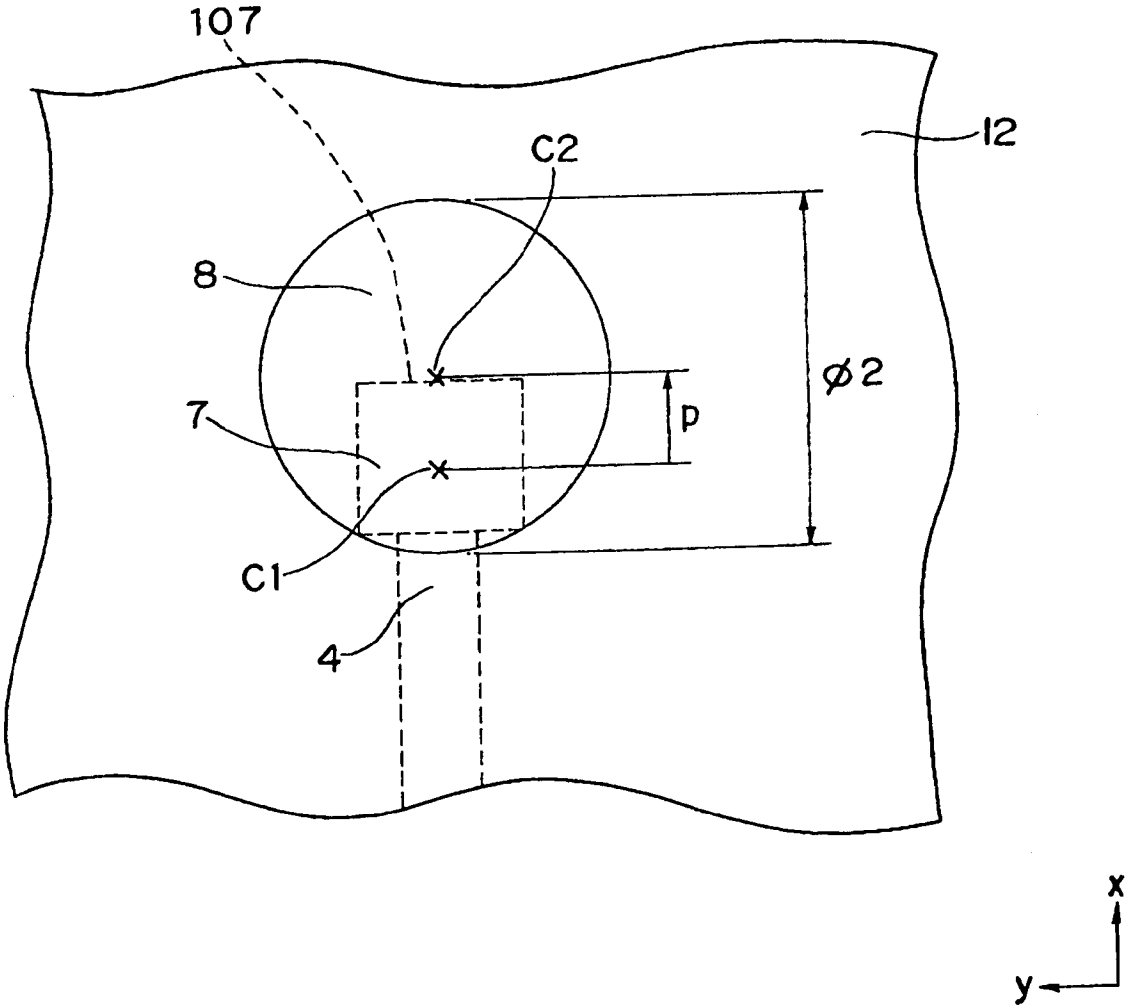
FIG. 10 is a plan view of the dielectric loaded antenna apparatus 10*b* shown in FIG. 9.

Referring to FIG. 9, the inclined surface S1 which is the top surface or the radiation surface of the loaded dielectric 8 is rotated on the xz plane and inclined at an inclination angle $\alpha$2 from the plane parallel to the xy plane in a manner similar to that of the first preferred embodiment. Further, as compared with the arrangement of the first preferred embodiment, the central axis A2 of the loaded dielectric 8 parallel to the axial direction or the guide direction (the vertical direction) is arranged to be shifted by a displacement distance p in the +x direction from the central axis A1 of the radiation waveguide 7 parallel to the guide axial direction or the vertical direction. The central axis A1 of the radiation waveguide 7 parallel to the guide axial direction or the vertical direction shown in FIG. 9 is defined as an axis which passes through the center C1 of the radiation waveguide 7 shown in FIG. 10 and which passes through the xy plane shown in FIG. 10 so as to be perpendicular to the xy plane. Further, the central axis A1 of the loaded dielectric 8 parallel to the axial direction or the vertical direction shown in FIG. 9 is an axis which passes through the center C2 of the loaded dielectric 8 shown in FIG. 10 and which passes through the xy plane shown in FIG. 10 so as to be perpendicular to the xy plane. As is apparent from FIG. 10, the center C2 of the loaded dielectric 8 is arranged to be shifted by the displacement distance p in the +x direction from the center C1 of the radiation waveguide 7, as compared with the arrangement of the first preferred embodiment.

As described above, according to the present preferred embodiment, by arranging the loaded dielectric 8 to be shifted relative to the radiation waveguide 7, the surface phase distribution of the electromagnetic wave on the outer peripheral surface of the loaded dielectric 8 can be inclined further toward the +x direction as compared with that of the first preferred embodiment. The main beam of the radiation directivity pattern can be remarkably inclined from the +z direction which is the front direction of the upper conductor substrate 12 toward the +x direction.

As one example, under conditions that the lower conductor substrate 11 and the upper conductor substrate 12 are made of the same material as that of the first preferred embodiment and that shapes and dimensions of the feeding waveguide 4 and the radiation waveguide 7 are the same as those of the first preferred embodiment, it is assumed that the loaded dielectric 8 is made of polypropylene having a dielectric constant of 2.26 and has dimensions of 6 mm in a cross-sectional diameter $\phi$ and 7 mm in a height L2, and the inclined angle $\alpha$2 of the inclined surface S1 is set to 45°. In the dielectric loaded antenna apparatus 10*b* manufactured to the above-mentioned dimensions, FIG. 11 is a graph showing a radiation directivity pattern on the xz plane when the displacement distance p shown in FIG. 9 is set to 1.3 mm, and FIG. 12 is graph showing a radiation directivity pattern on the xz plane when the displacement distance p is set to 1.7 mm.

Figure 11:
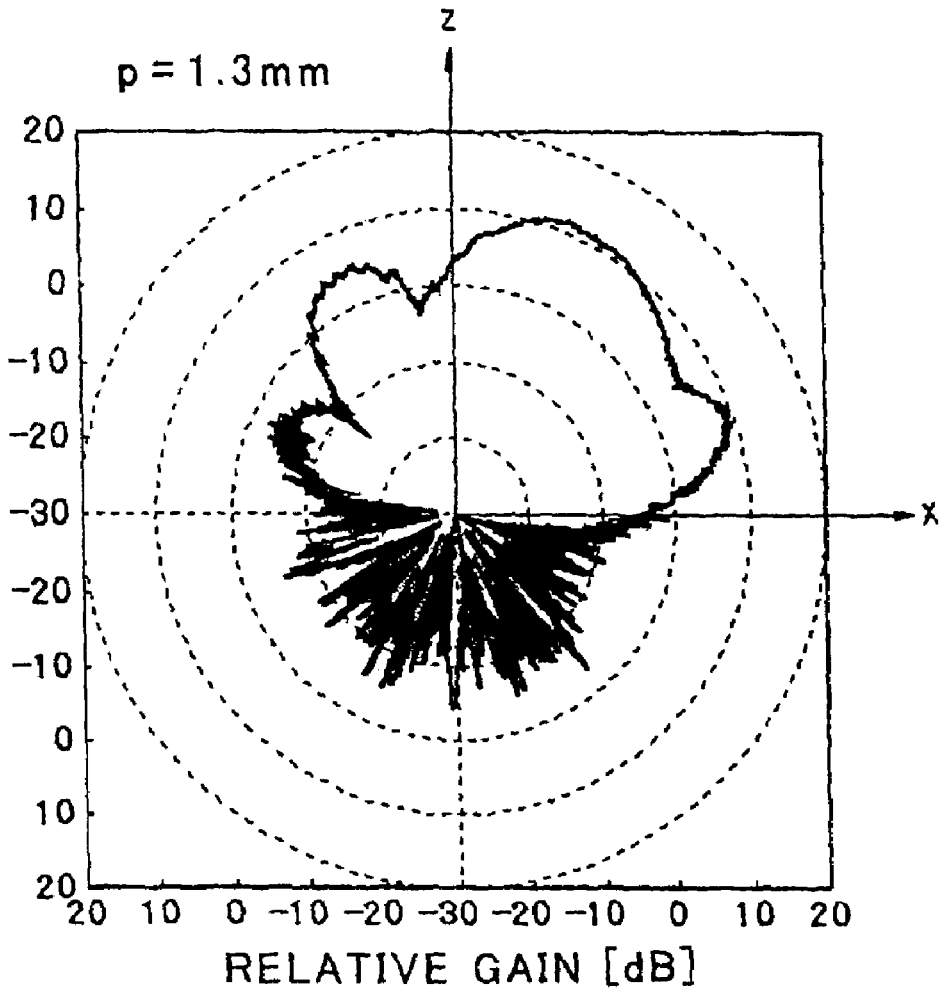
FIG. 11 is a graph showing a radiation directivity pattern of the dielectric loaded antenna apparatus 10*b* on the xz plane when a displacement distance p of FIG. 9 is set to 1.3 mm.
Figure 12:
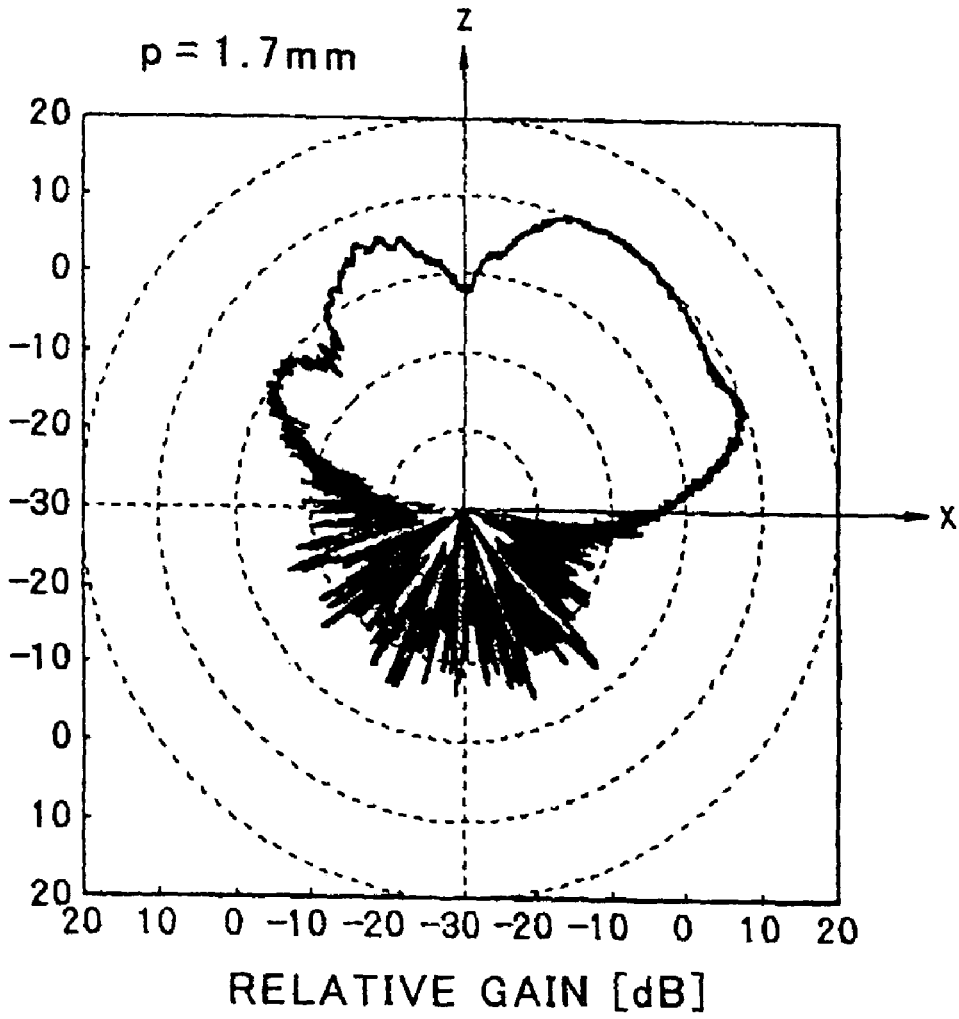
FIG. 12 is a graph showing a radiation directivity pattern of the dielectric loaded antenna apparatus 10*b* on the xz plane when the displacement distance p of FIG. 9 is set to 1.7 mm.

As is apparent from FIGS. 11 and 12, by arranging the loaded dielectric 8 to be shifted from the radiation waveguide 7, the direction of the main beam of the radiation directivity pattern can be remarkably inclined. Further, as the displacement distance p is set larger, the inclination angle in the main beam direction can be made wider.

Furthermore, the larger the displacement distance p, the wider the main beam of the antenna apparatus becomes. In the case of p=1.7 mm, the main beam exhibit a wide directivity pattern with a uniform gain in an angle range of about 50° from 20° to 70° from the +x direction. That is, by providing the inclined surface S1 as the top surface (radiation surface) of the loaded dielectric 8 and shifting the loaded dielectric 8 from the radiation waveguide 7 and then loading the dielectric 8 onto the antenna apparatus, the inclination of a phase distribution on the top surface or the radiation surface of the loaded dielectric 8 increases. As a result, it is advantageously possible to incline the main beam from the +z direction and increase a width of the main beam.

FIGS. 13 to 17 are plan views showing configurations of dielectric loaded antenna apparatuses of first to fifth modified preferred embodiments of the third preferred embodiment, respectively.

Figure 13:
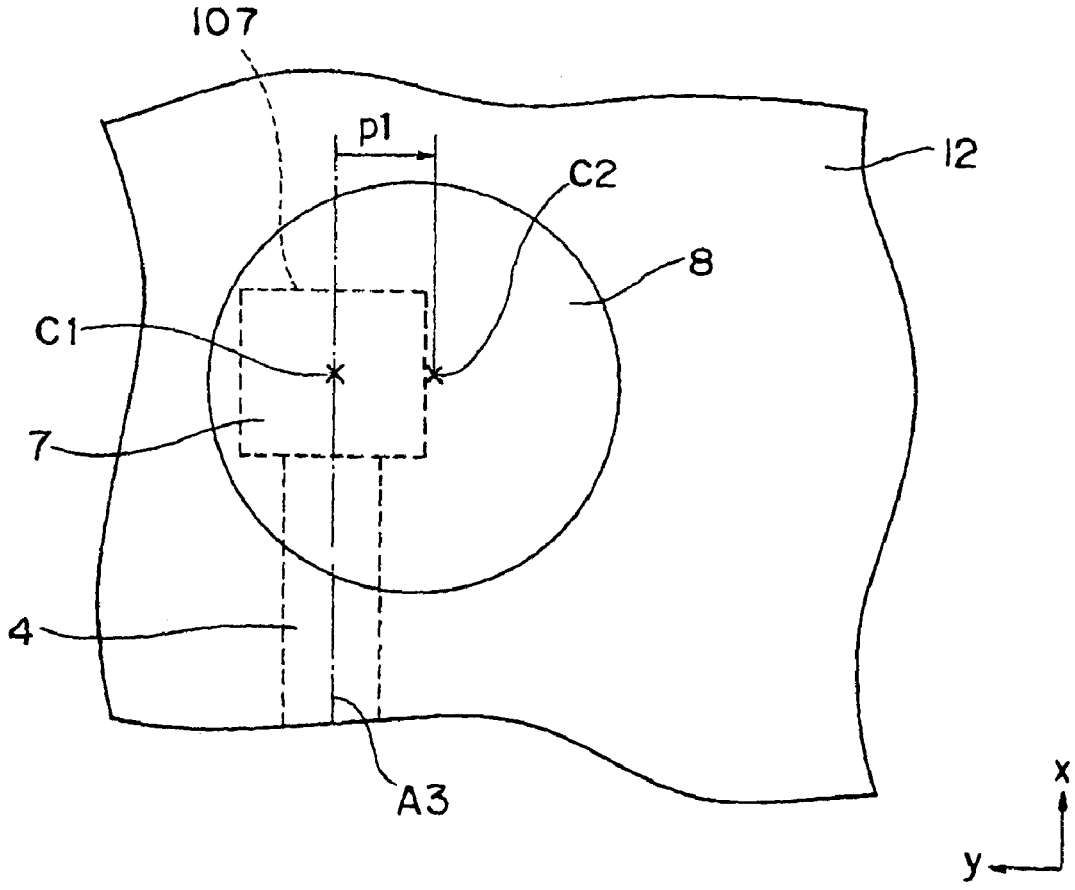
FIG. 13 is a plan view showing a configuration of a dielectric loaded antenna apparatus of a first modified preferred embodiment of the third preferred embodiment.
Figure 14:
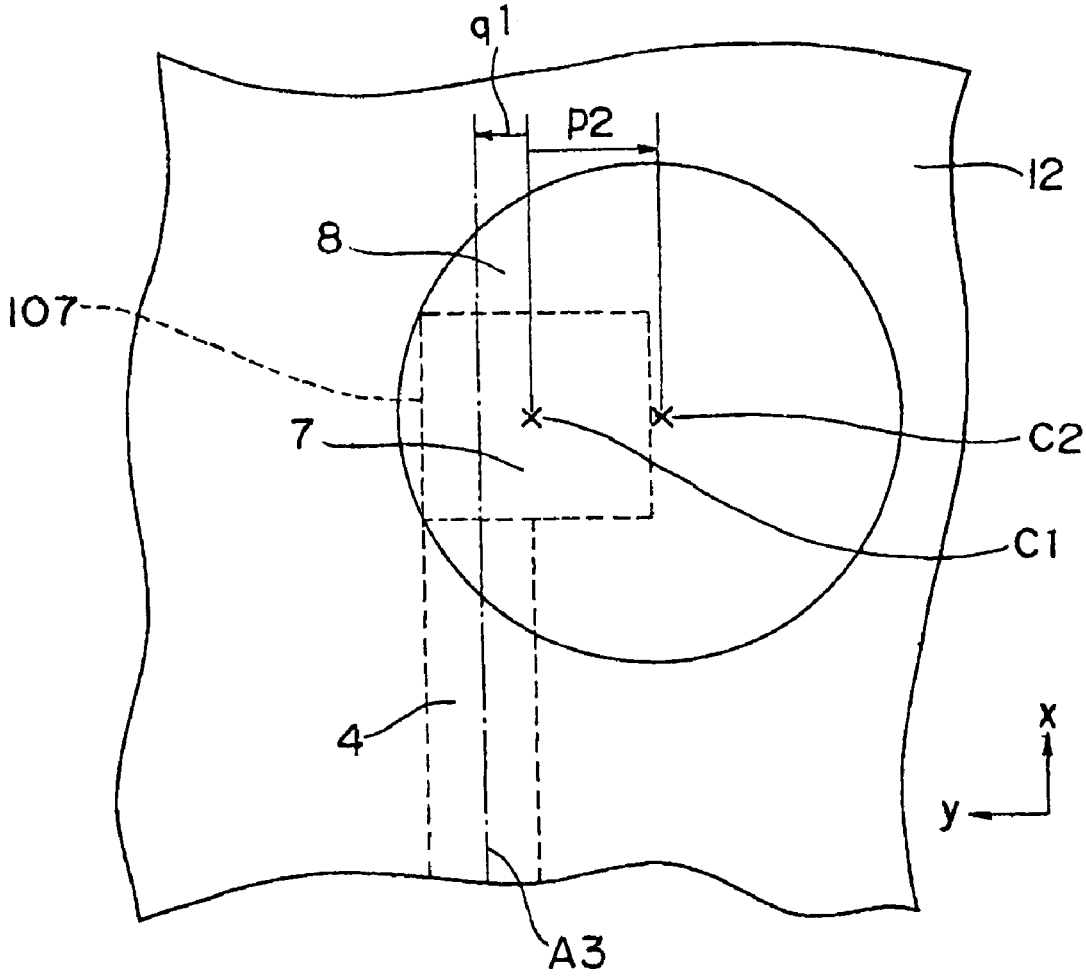
FIG. 14 is a plan view showing a configuration of a dielectric loaded antenna apparatus of a second modified preferred embodiment of the third preferred embodiment.
Figure 15:
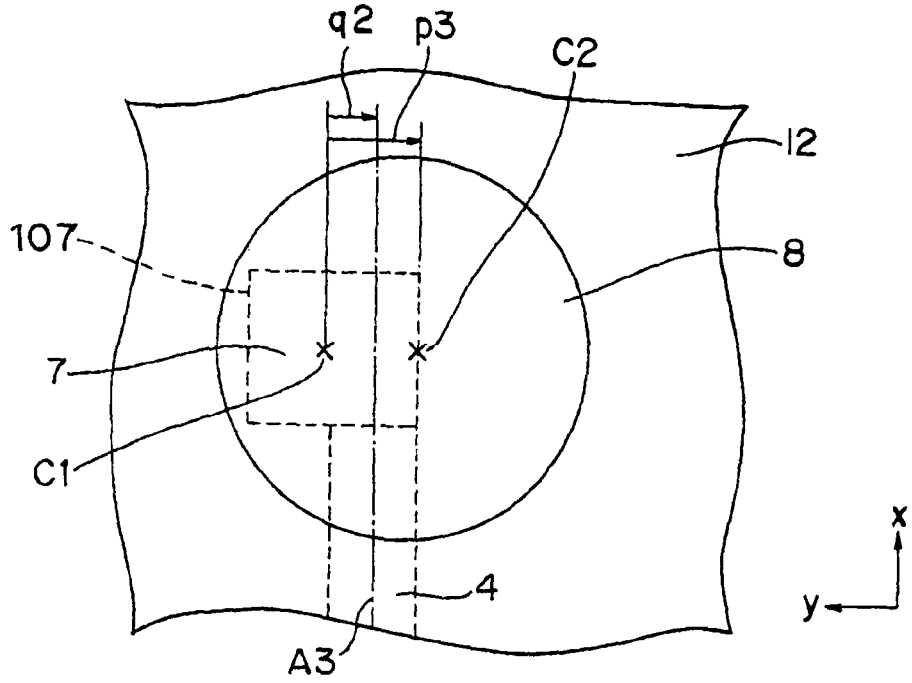
FIG. 15 is a plan view showing a configuration of a dielectric loaded antenna apparatus of a third modified preferred embodiment of the third preferred embodiment.

As shown in FIGS. 13 to 15, the loaded dielectric 8 may be arranged by being moved so that the center C2 of the loaded dielectric 8 is shifted in the −y direction from the center C1 (which passes through the central axis in the guide direction of passing through the center of the cross section of the radiation waveguide 7) of a radiation opening 107 of the radiation waveguide 7 by displacement distances p1, p2, and p3, respectively.

In the first modified preferred embodiment shown in FIG. 13, a direction of a beam of the antenna apparatus can be inclined toward the +y direction. In this case, the beam direction of the antenna apparatus can be inclined further toward the +y direction. In the second modified preferred embodiment shown in FIG. 14, the loaded dielectric 8 may be arranged by being moved, besides the first modified preferred embodiment shown in FIG. 13, so that the central axis A3 of a feeding waveguide 4 is shifted from the center C1 of the radiation opening 107 by a displacement distance q1 in the +y direction. In this case, the beam direction of the antenna apparatus can be inclined further in the +y direction. In the third modified preferred embodiment shown in FIG. 15, the loaded dielectric 8 may be arranged by being moved so that the central axis A3 of the feeding waveguide 4 is shifted in the −y-direction from the center C1 of the radiation opening 107 by a displacement distance q2. In this case, as compared with the case where the central axis A3 is not shifted by the displacement distance q2, the beam direction of the antenna apparatus can be further inclined toward the −y direction.

Figure 16:
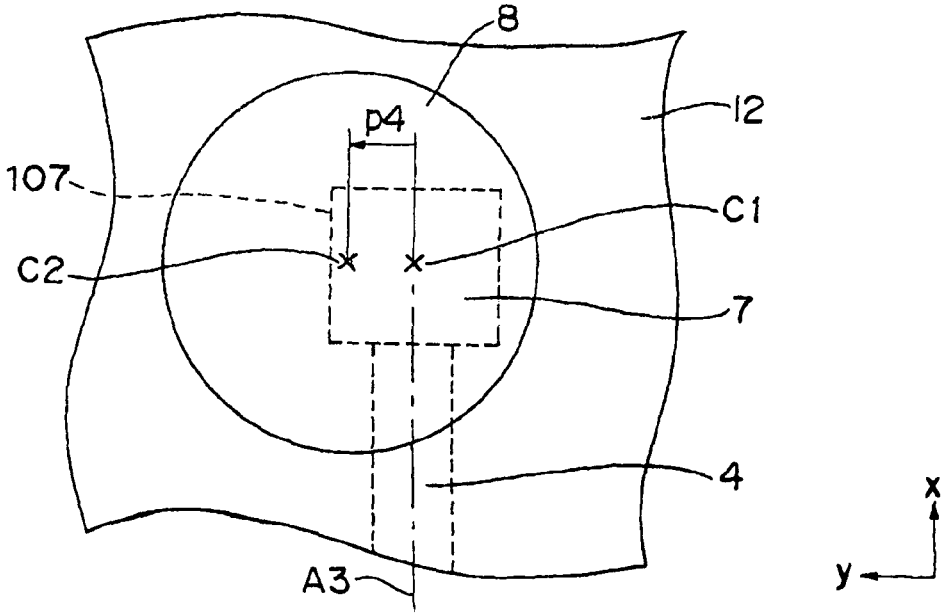
FIG. 16 is a plan view showing a configuration of a dielectric loaded antenna apparatus of a fourth modified preferred embodiment of the third preferred embodiment.
Figure 17:
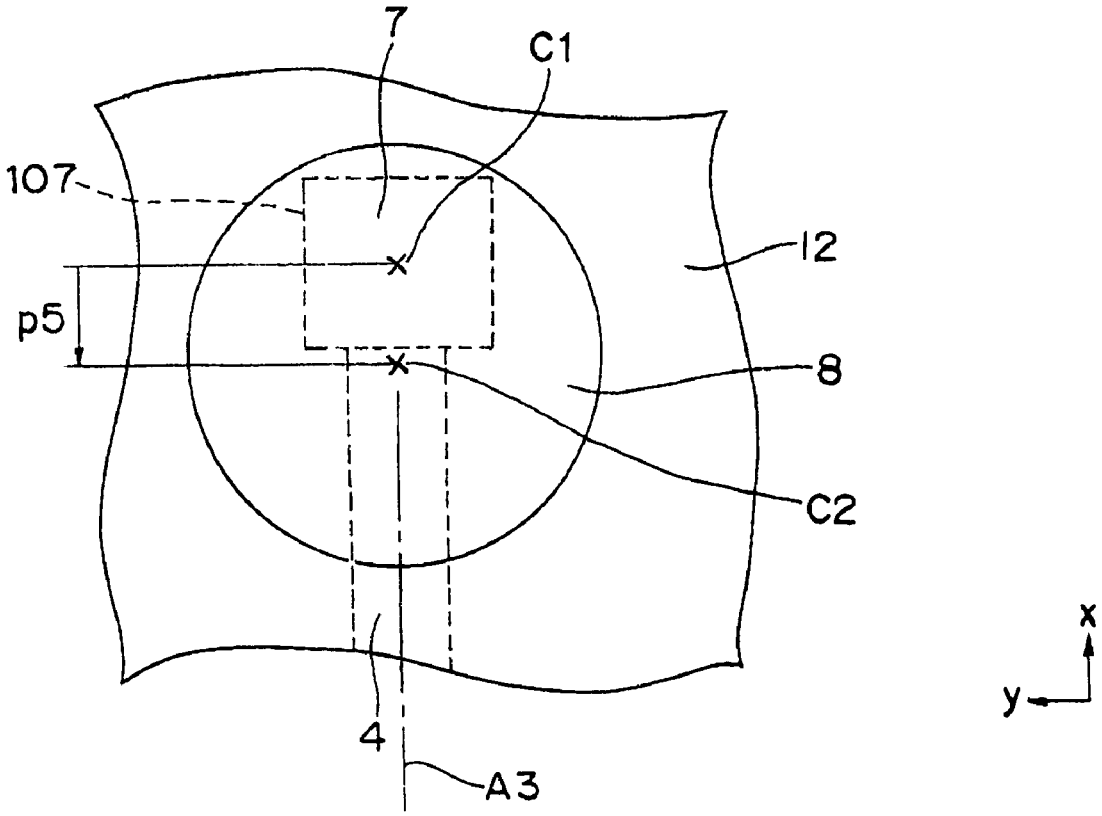
FIG. 17 is a plan view showing a configuration of a dielectric loaded antenna apparatus of a fifth modified preferred embodiment of the third preferred embodiment.

In the fourth modified preferred embodiment shown in FIG. 16, the loaded dielectric 8 may be arranged by being moved so that the center C2 of the loaded dielectric 8 is shifted in the +y direction from the center C1 of the radiation opening 107 by a displacement distance p4. In this case, the beam direction of the antenna apparatus can be further inclined toward the +y direction. In the fifth modified preferred embodiment shown in FIG. 17, the loaded dielectric 8 may be arranged by being moved so that the center C2 of the loaded dielectric 8 is shifted in the −x direction from the center C1 of the radiation opening 107 by a displacement distance p5. In this case, the beam direction of the antenna apparatus can be further inclined in the +x direction.

Further, in the dielectric loaded antenna apparatus 10*a* which feeds the electromagnetic wave using the feeding patch conductor 16 of the second preferred embodiment, if the loaded dielectric 8 is arranged by being moved so that the central axis of the loaded dielectric 8 parallel to the vertical direction is shifted from the center of the feeding patch conductor 16 (corresponding to the radiation opening 107) and loaded on the antenna apparatus, the direction of the main beam of the antenna apparatus can be inclined. Furthermore, the microstrip conductor 15 and the feeding patch conductor 16 may be formed so that the longitudinal axis that passes through the center in the width direction of the microstrip conductor 15 is shifted from the center of the feeding patch conductor 16 toward the width direction of the microstrip conductor 15. In this case, in a manner similar to that of the positional relationship between the feeding waveguide 4 and the radiation opening 107 of the third preferred embodiment, the direction of the main beam of the antenna apparatus can be inclined.

In the third preferred embodiment mentioned above, the loaded dielectric 8 is arranged to be shifted on the top surface of the upper conductor substrate 12. On the other hand, the feeding waveguide 4 is formed so that a short side direction of the rectangular cross section of the feeding waveguide 4 becomes parallel to the horizontal direction, and the polarization surface of the electromagnetic wave that propagates in the feeding waveguide 4 is parallel to the xy plane. Therefore, the loaded dielectric 8 is shifted on the polarization surface in the direction parallel to the polarization direction. However, the present invention is not limited to this, and the feeding waveguide 4 may be formed so that the short side direction of the rectangular cross section of the feeding waveguide 4 becomes parallel to the vertical direction. In this case, the polarization surface of the electromagnetic wave that propagates in the feeding waveguide 4 is parallel to the yz plane, so that the loaded dielectric 8 is shifted on the polarization surface in the direction perpendicular to the polarization direction.

Fourth Preferred Embodiment

Figure 18:
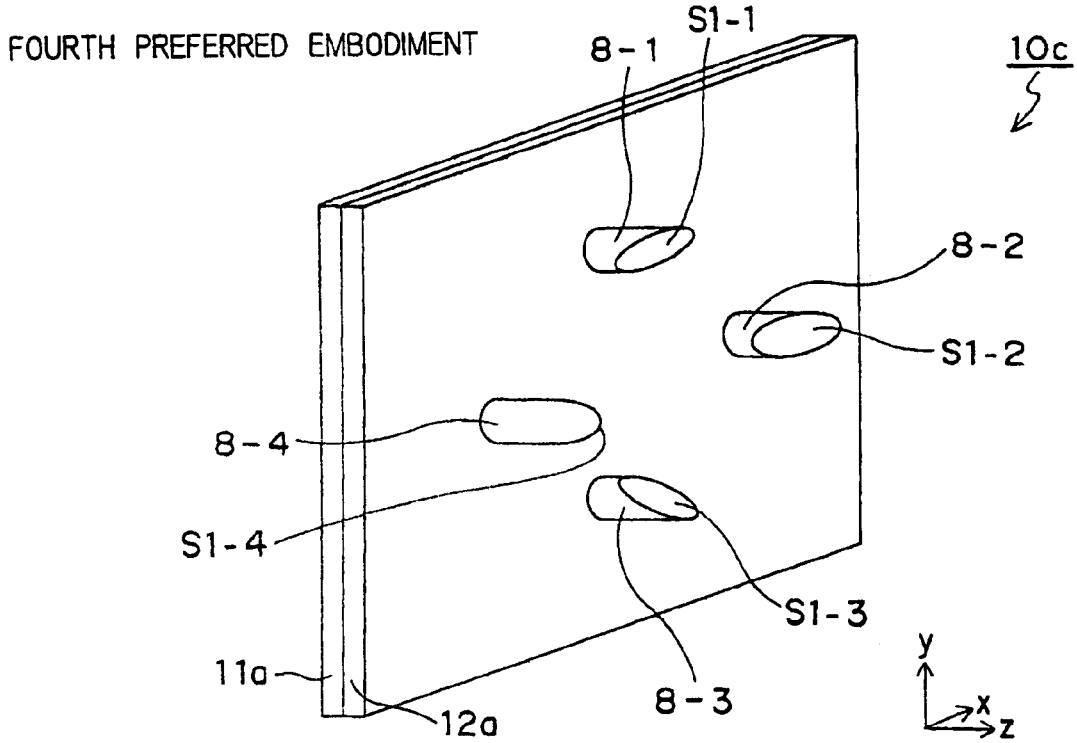
FIG. 18 is a perspective view showing a configuration of a dielectric loaded antenna apparatus 10*c* of a fourth preferred embodiment according to the present invention.
Figure 19:
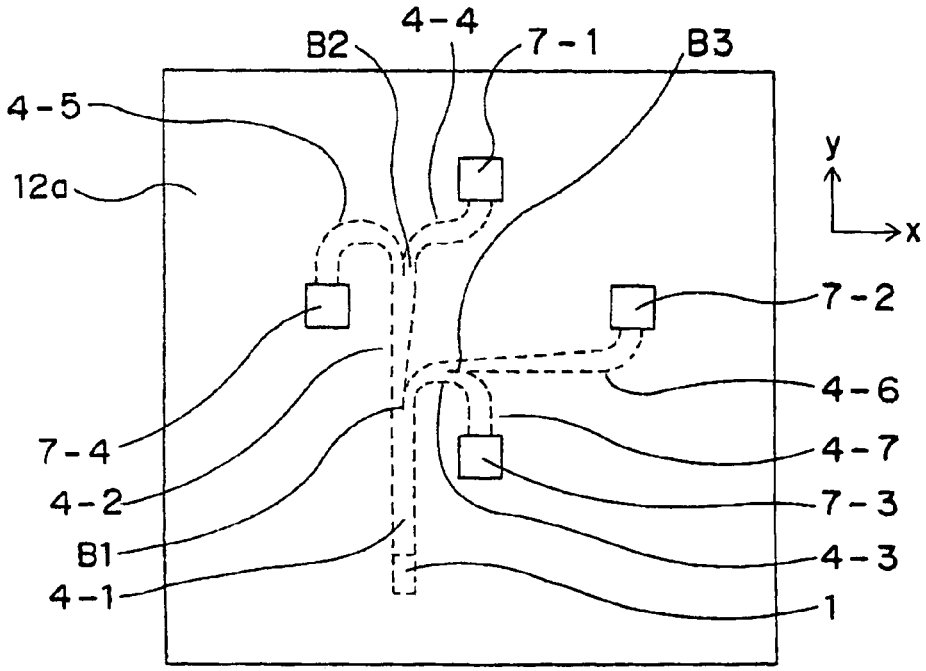
FIG. 19 is a plan view of an upper conductor substrate 12*a* shown in FIG. 18.

FIG. 18 is a perspective view showing a configuration of a dielectric loaded antenna apparatus 10*c* of a fourth preferred embodiment according to the present invention. FIG. 19 is a plan view of an upper conductor substrate 12*a* when loaded dielectrics 8-1 to 8-4 shown in FIG. 18 are removed. In FIG. 19, feeding waveguides 4-1 to 4-7 are indicated by dotted lines.

As shown in FIGS. 18 and 19, the dielectric loaded antenna apparatus 10*c* of the fourth preferred embodiment is an array antenna apparatus which includes the circular-column-shaped loaded dielectrics 8-1 to 8-4 that operate as radiation elements, respectively. In order to feed an electromagnetic wave to the loaded dielectrics 8-1 to 8-4, respectively, the feeding waveguides 4-1 to 4-7 and radiation waveguides 7-1 to 7-4 formed on a lower conductor substrate 11*a* and the upper conductor substrate 12*a* are provided in a manner similar to that of the first preferred embodiment. The loaded dielectrics 8-1 to 8-4 are arranged on a dielectric substrate 12*a* to be apart from each other by a predetermined distance of, e.g., half the wavelength.

Referring to FIG. 19, the electromagnetic wave fed from the feeding opening 1 is distributed into four branch sections B1 to B3 provided on the feeding waveguides 4-1 to 4-7, and then fed to the respective loaded dielectrics 8-1 to 8-4. That is, the feeding waveguide 4-1 coupled with feeding opening 1 is branched into the two feeding waveguides 4-2 and 4-3 by the branch section B1, the feeding waveguide 4-2 is branched into the two feeding waveguides 4-4 and 4-5 by the branch section B2, the feeding waveguide 4-4 is coupled with the radiation waveguide 7-1, and the feeding waveguide 4-5 is coupled with the radiation waveguide 7-4. Further, the feeding waveguide 4-3 is branched into the two feeding waveguides 4-6 and 4-7 by the branch section B3, the feeding waveguide 4-6 is coupled with the radiation waveguide 7-2, and the feeding waveguide 4-7 is coupled with the radiation waveguide 7-3.

Referring to FIG. 18, the loaded dielectrics 8-1 to 8-4 respectively having top surfaces or radiation surfaces formed as inclined surfaces S1-1 to S1-4 are fixed onto the radiation waveguides 7-1 to 7-4, respectively, in a manner similar to that of the first preferred embodiment. The respective inclined surfaces S1-1 to S1-4 of the loaded dielectrics 8-1 to 8-4 are inclined so that respective inclination directions thereof are different from each other. In the present preferred embodiment, the inclined surface S1-1 of the loaded dielectric 8-1 is rotated on the yz plane and inclined at a predetermined angle from the plane parallel to the upper conductor substrate 12 (this plane is referred to as a substrate parallel plane hereinafter), and directed in a direction of a combined vector of a vector in the −y direction and a vector in the +z direction. Further, the inclined surface S1-2 of the loaded dielectric 8-2 is rotated on the xz plane and inclined at a predetermined angle from the substrate parallel plane and directed in a direction of a combined vector of a vector in the −x direction and a vector in the +z direction. The inclined surface S1-3 of the loaded dielectric 8-3 is rotated on the yz plane and inclined at a predetermined angle from the substrate parallel plane and directed in a direction of a combined vector of a vector in the +y direction and a vector in the +z direction. The inclined surface S1-4 of the loaded dielectric 8-4 is rotated on the xz plane and inclined at a predetermined angle from the substrate parallel plane and directed in a direction of a combined vector of a vector in the +x direction and a vector in the +z direction. In the present preferred embodiment, the inclination angles of the four inclined surfaces S1-1 to S1-4 are set equal to each other. However, the present invention is not limited to this. The directions in which the four inclined surfaces S1-1 to S1-4 are directed are not limited to those shown in FIG. 18, and may be changed.

In the present preferred embodiment, by constituting the array antenna using the radiation waveguides 7-1 to 7-4 and the loaded dielectrics 8-1 to 8-4 and by changing the inclined angles and directions of the inclined surfaces S1-1 to S1-4 of the loaded dielectrics 8-1 to 8-4 and the respective inclined surfaces S1-1 to S1-4, it is possible to change the radiation directivity pattern of the array antenna and realize a desired radiation directivity pattern.

In the array antenna shown in FIG. 18, by controlling amplitude and/or phase of the electromagnetic wave fed to the respective loaded dielectrics 8-1 to 8-4, it is possible to change the radiation directivity pattern of the array antenna and realize a desired radiation directivity pattern. In this case, it is important control the amplitude distribution and the phase distribution of electromagnetic fields in the inclined surfaces S1-1 to S1-4 of the respective loaded dielectrics 8-1 to 8-4. For example, in order to realize a high-gain antenna, it is necessary to make the amplitudes and the phases of the electromagnetic fields on the inclined surfaces S1-1 to S1-4 of all the loaded dielectrics 8-1 to 8-4, equal to each other and be in phase, respectively.

Generally speaking, the amplitude of the electromagnetic field on each of the inclined surfaces S1-1 to S1-4 of the loaded dielectrics 8-1 to 8-4 can be controlled by changing a branching ratio or a distribution ratio of the electromagnetic wave in the branch sections B1 to B3 of the feeding waveguides 4-1 to 4-7 and the phase thereof can be controlled by changing an electric length from the feeding opening 1 to an end portion connected with each of the radiation waveguides 7-1 to 7-4 of each of the feeding waveguides 4-1 to 4-7 and the branch sections B1 to B3. In order to change each electric length, a delay circuit may be inserted so that a delay time length thereof is changed.

If an array antenna apparatus is constituted using a plurality of conventional dielectric loaded antenna apparatuses each including the conventional circular-column-shaped loaded dielectric 108 shown in FIG. 41, it is necessary to provide many loaded dielectrics 108 so as to realize a desired radiation directivity pattern. However, by using the array of the loaded dielectrics 8-1 to 8-4 in the present preferred embodiment, it is possible to set complicated amplitude and/or phase for a radiated electromagnetic wave simply by the loaded dielectrics 8-1 to 8-4 themselves. Therefore, it is possible to realize the desired radiation directivity pattern using fewer loaded dielectrics 8 and fewer radiation waveguides 7. Further, by decreasing the number of the loaded dielectrics 8 and the radiation waveguides 7, the feeding waveguides 4 can be easily designed and manufactured.

In the preferred embodiment mentioned above, the loaded dielectrics 8-1 to 8-4 may be arranged to be shifted from the radiation waveguides 7-1 to 7-4, respectively, in a manner similar to that of the present third preferred embodiment. In that case, it is possible to realize more varied kinds of radiation directivity patterns.

In the present preferred embodiment, the number of loaded dielectrics and the number of radiation waveguides are set to four, respectively. Alternatively, numbers thereof different from four may be employed.

In the present preferred embodiment, the loaded dielectrics 8-1 to 8-4 have the shapes of circular columns including the inclined surfaces S1-1 to S1-4 on their respective top surfaces. However, the present invention is not limited to this, and the respective loaded dielectrics 8-1 to 8-4 may have polygonal or the other shapes having predetermined inclined surfaces.

Fifth Preferrd Embodiment

Figure 20:
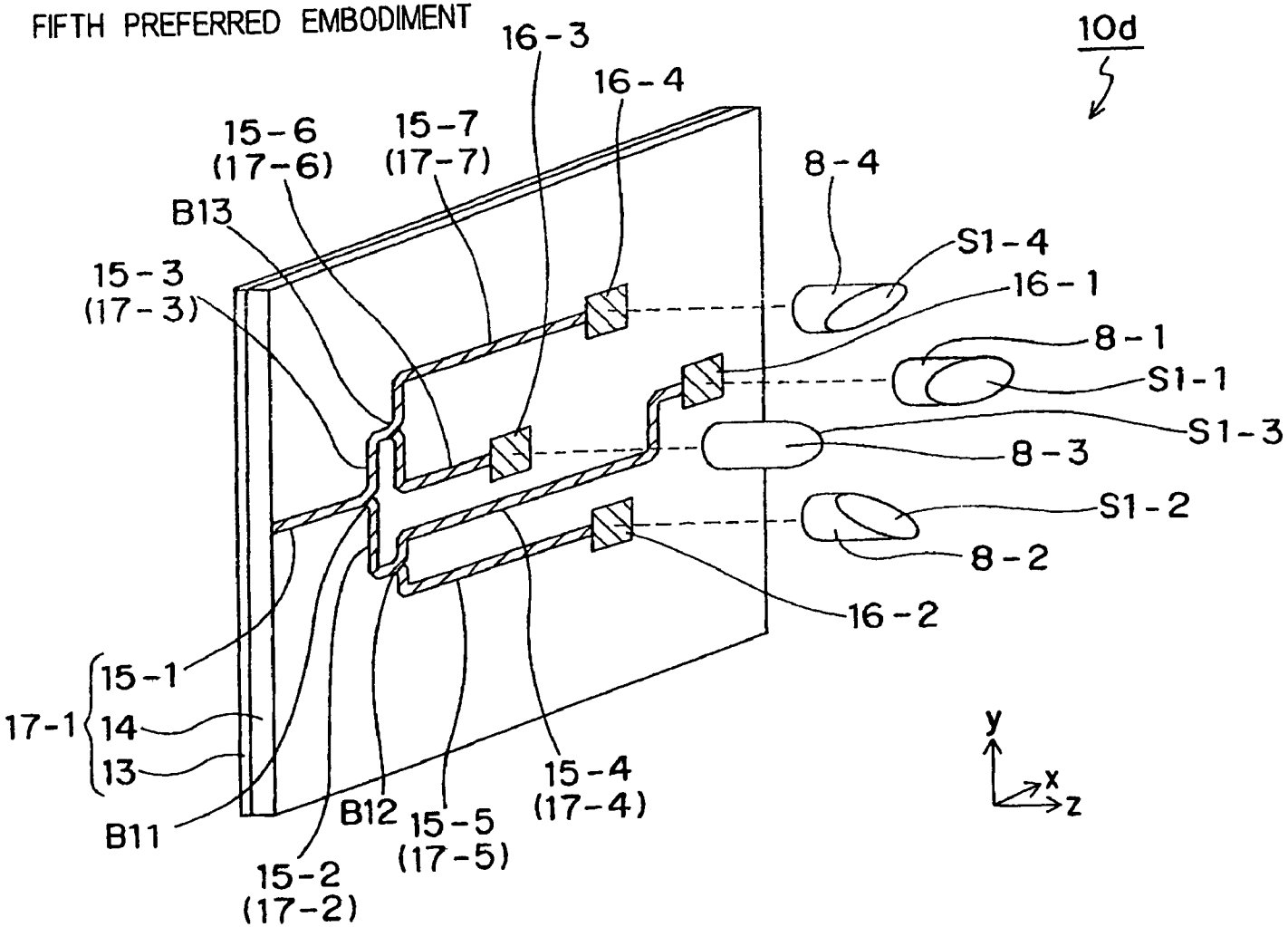
FIG. 20 is a perspective view showing a configuration of a dielectric loaded antenna apparatus 10*d* of a fifth preferred embodiment according to the present invention.

FIG. 20 is an exploded perspective view showing a configuration of a dielectric loaded antenna apparatus 10*d* of a fifth preferred embodiment according to the present invention.

The dielectric loaded antenna apparatus 10*d* of the fifth preferred embodiment is an array antenna apparatus which includes a plurality of loaded dielectrics 8-1 to 8-4 to which electromagnetic waves are fed through microstrip lines 17-1 to 17-7, respectively. The antenna apparatus or array antenna apparatus 10*d* is characterized by providing the microstrip lines 17-1 to 17-7 in place of the feeding waveguides 4-1 to 4-7 of the fourth preferred embodiment.

Referring to FIG. 20, on a front or top surface of a dielectric substrate 14 having a ground conductor 13 formed on a rear or bottom surface, microstrip conductors 15-1 to 15-7 and feeding patch conductors 16-1 to 16-4 are formed. The ground conductor 13 and the microstrip conductors 15-1 to 15-7, between which the dielectric substrate 14 is sandwiched, constitute the microstrip lines 17-1 to 17-7, respectively. Furthermore, the same loaded dielectrics 8-1 to 8-4 as those of the fourth preferred embodiment are fixed onto the feeding patch conductors 16-1 to 16-4, respectively, by a method such as bonding, welding or the like.

The microstrip conductor 15-1 is branched into the microstrip conductors 15-2 and 15-3 by a branch section B11, the microstrip conductor 15-2 is branched into the microstrip conductors 15-4 and 15-5 by a branch section B12, the microstrip conductor 15-4 is connected with the feeding patch conductor 16-1, and the microstrip conductor 15-5 is to the feeding patch conductor 16-2. Further, the microstrip conductor 15-3 is branched into the microstrip conductors 15-6 and 15-7 by a branch section B13, the microstrip conductor 15-6 is connected with the feeding patch conductor 16-3, and the microstrip conductor 15-7 is connected with the feeding patch conductor 16-4. In a manner similar to that of the fourth preferred embodiment, the loaded dielectrics 8-1 to 8-4 having the inclined surfaces S1-1 to S1-4 are fixed onto the feeding path conductors 16-1 to 16-4, respectively.

The fifth preferred embodiment constituted as mentioned above exhibits the same actions and advantageous effects as those of the fourth preferred embodiment and exhibits the same actions and advantageous effects as those of the second preferred embodiment.

Sixth Preferred Embodiment

Figure 21:
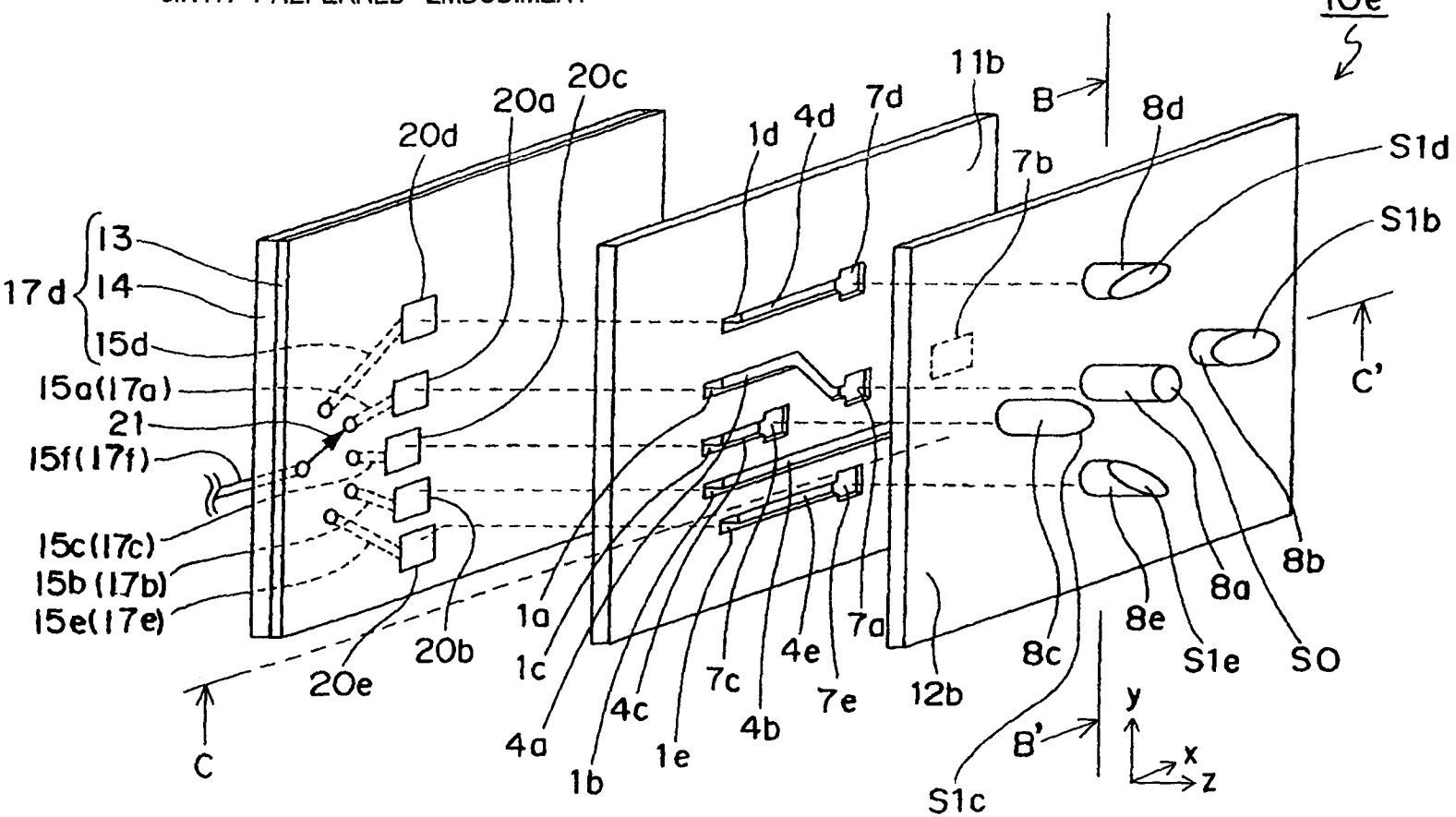
FIG. 21 is a perspective view showing a configuration of a dielectric loaded antenna apparatus 10*e* of a sixth preferred embodiment according to the present invention.
Figure 22:
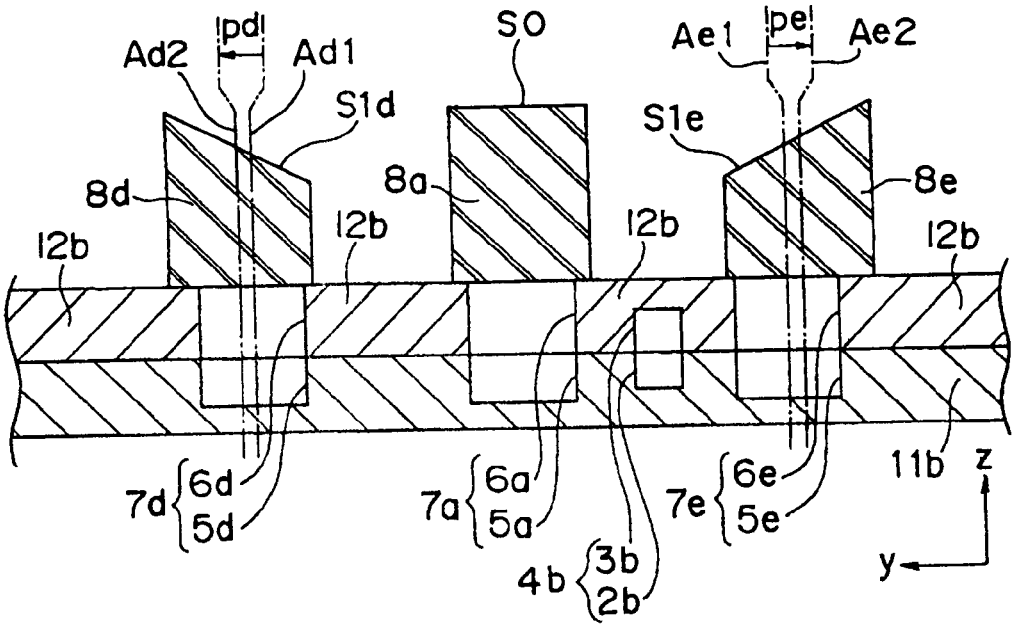
FIG. 22 is a longitudinal sectional view taken along a line B–B' of FIG. 21.
Figure 23:
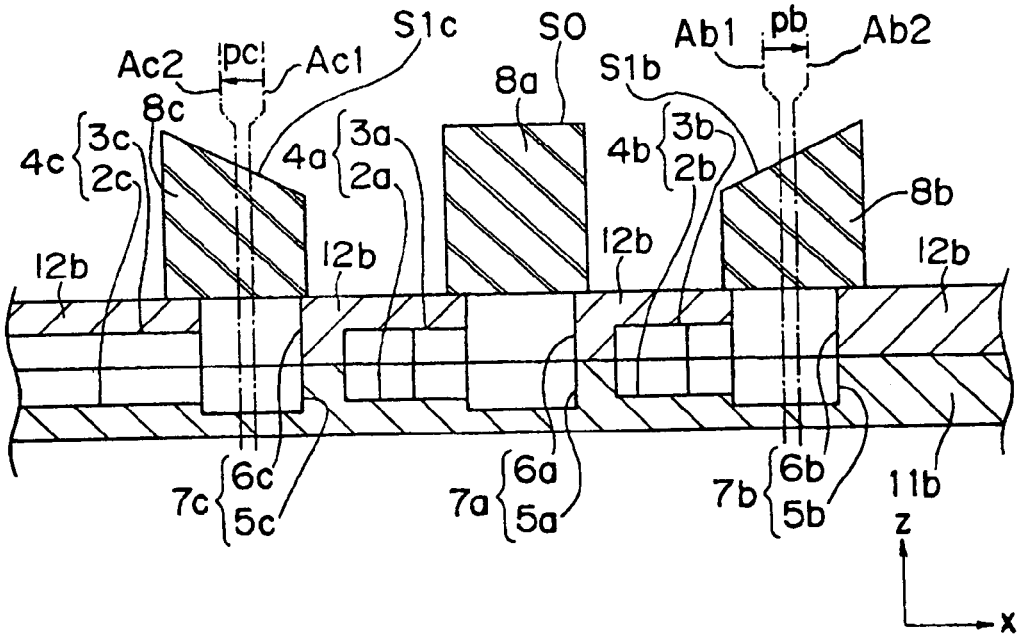
FIG. 23 is a longitudinal sectional view taken along a line C–C' of FIG. 21.

FIG. 21 is an exploded perspective view of a dielectric loaded antenna apparatus 10*e* that is a switching type array antenna apparatus of a sixth preferred embodiment according to the present invention. FIG. 22 is a longitudinal sectional view taken along a line B–B' of FIG. 21 and FIG. 23 is a longitudinal sectional view taken along a line C–C' of FIG. 21.

The present preferred embodiment is characterized by constituting the array antenna apparatus which includes five antenna apparatuses including loaded dielectrics 8*a*, 8*b*, 8*c*, 8*d*, and 8*e*, respectively, and by switching the respective antenna apparatuses by a switch 21. The switch 21 is a one-input and five-output type microwave switching circuit. The switch 21 includes microstrip lines formed on the dielectric substrate 14, semiconductor switches which turn on and off the connected microstrip lines and the like. The switch 21, as well as the dielectric substrate 14, is provided on the rear or bottom surface of the lower conductor substrate 11*b*.

Referring to FIG. 21, the xyz coordinate system with a radiation opening of a radiation waveguide 7*a* set as a center or origin of the coordinate system is referred to hereinafter, the +z direction is referred to as an upper direction and the −z direction is referred to as a lower direction. The switch 21 and microstrip conductors 15*a* to 15*e* are formed on the bottom surface of the dielectric substrate 14, and microstrip line to rectangular waveguide converters 20*a* to 20*e* and the ground conductor 13 are formed on the top surface of the dielectric substrate 14. The ground conductor 13 and the respective microstrip conductors 15*a* to 15*f*, between which the dielectric substrate 14 is sandwiched, constitute the microstrip lines 17*a* to 17*f*. A radio signal fed through the microstrip line 17*f* is selectively switched over from the microstrip line 17*f* to one of the microstrip lines 17*a* to 17*e* by the switch 21, and then fed, through the microstrip line to rectangular waveguide converters 20*a* to 20*e* and feeding openings 1*a* to 1*e*, further being fed to feeding waveguides 4*a* to 4*e* formed on the bottom surface of the lower conductor substrate 11*b*.

In a manner similar to that of the first preferred embodiment, the feeding waveguides 4*a* to 4*e* and the radiation waveguides 7*a* to 7*e* connected with the feeding waveguides 4*a* to 4*e*, respectively, are formed in the lower conductor substrate 11*b* and the upper conductor substrate 12*b*. For example, the feeding waveguide 4*a* is constituted by making a lower rectangular groove 2*a* formed in the lower conductor substrate 11*b* oppose to an upper rectangular groove 3*a* formed in the upper conductor substrate 12*b*, and the radiation waveguide 7*a* is constituted by a lower radiation waveguide chamber 5*a* formed in the lower conductor substrate 11*b* and an upper radiation waveguide chamber 6*a* formed in the upper conductor substrate 12*b*. The lower radiation waveguide chamber 5*a* is coupled with the lower rectangular groove 2*a*, and the upper radiation waveguide chamber 6*a* is coupled with the upper rectangular groove 3*a*. The feeding waveguides 4*b* to 4*e* and the radiation waveguides 7*b* to 7*e* are formed in a manner similar to that of the feeding waveguide 4*a* and the radiation waveguide 7*a*, respectively. Accordingly, radio signals fed from the feeding openings 1*a* to 1*e* to the feeding waveguides 4*a* to 4*e* are input into the radiation waveguides 7*a* to 7*e* on an opposite side to the feeding openings 1*a* to 1*e* through the feeding waveguides 4*a* to 4*e*, and then radiated through the loaded dielectrics 8*a* to 8*e* provided on the radiation waveguides 7*a* to 7*e*, respectively.

In the present preferred embodiment, the loaded dielectrics 8*a* to 8*e* constitute a crisscross array antenna on the upper conductor substrate 12*b*. The loaded dielectrics 8*a* to 8*e* are arranged on the dielectric substrate 12*b* to be apart from each other by a predetermined distance of, e.g., half the wavelength. The loaded dielectric 8*a* has a shape of circular column having a horizontal surface S0 parallel to the conductor substrate surface while the loaded dielectrics 8*b* to 8*e* have a shape of circular column which is cut so that the top surfaces or the radiation surfaces become inclined surfaces S1*b* to S1*e*, respectively. The loaded dielectrics 8*b* to 8*e* are arranged to surround the loaded dielectric 8*a*, the loaded dielectrics 8*b* and 8*c* are arranged to be located extending in the +x and −x directions of FIG. 21, respectively, and the loaded dielectrics 8*d* and 8*e* are arranged to be located extending in the +y and −y directions, respectively.

Referring to FIG. 22, the top surfaces or the radiation surfaces of the loaded dielectrics 8*d* and 8*e* are formed by the inclined surfaces S1*d* and S1*e*, respectively, which are inclined to oppose to a direction in which the loaded dielectric 8*a* is located. The central axis of the loaded dielectric 8*a* parallel to the vertical direction coincides with the central axis of the radiation waveguide 7*a* parallel to the vertical direction, the loaded dielectric 8*d* is loaded and arranged so that a central axis Ad2 of the loaded dielectric 8*d* parallel to the vertical direction is shifted from a central axis Ad1 of the radiation waveguide 7*d* parallel to the vertical direction by a displacement distance pd in the +y direction, and the loaded dielectric 8*e* is loaded and arranged so that a central axis Ae2 of the loaded dielectric 8*e* parallel to the vertical direction is shifted from a central axis Ae1 of the radiation waveguide 7*e* parallel to the vertical direction by a displacement distance pe in the −y direction.

Referring to FIG. 23, the top surfaces or the radiation surfaces of the loaded dielectrics 8*b* and 8*c* are formed by the inclined surfaces S1*b* and S1*c*, respectively, which are inclined to oppose to the direction in which the loaded dielectric 8*a* is located. The loaded dielectric 8*b* is loaded and arranged so that a central axis Ab2 of the loaded dielectric 8*b* parallel to the vertical direction is shifted from a central axis Ab1 of the radiation waveguide 7*b* parallel to the vertical direction by a displacement distance pb in the +x direction, and the loaded dielectric 8*c* is loaded and arranged so that a central axis Ac2 of the loaded dielectric 8*c* parallel to the vertical direction is shifted from a central axis Ac1 of the radiation waveguide 7*c* parallel to the vertical direction by a displacement distance pc in the −x direction.

In the preferred embodiment constituted as mentioned above, the loaded dielectric 8*a* has a main beam in the front direction or the +z direction perpendicular to the upper conductor substrate 12*b*, and the loaded dielectrics 8*b* to 8*e* have main beams inclined from the z-axial direction toward an outer edge portion of the antenna apparatus, respectively. One of the loaded dielectrics 8*a* to 8*e* to which an electromagnetic wave is radiated is selected by the switch 21, and the selected dielectric is selected through switching over by the switch 21 according to a direction in which a communication destination station is located, and this leads to that it is possible to perform radio communication with a higher antenna gain. In the other word, the loaded dielectrics 8*a* to 8*e* have the main beams in directions different from each other. Therefore, by constituting a selective type array antenna in combination with the switch 21, it is possible to realize a dielectric loaded antenna apparatus capable of ensuring a higher gain and covering a wider area.

The results of an experiment of a prototype dielectric loaded antenna apparatus manufactured by the inventors of the present application will now be described. The loaded dielectric 8*a* is made of polypropylene having a dielectric constant of 2.26 and has a shape of a circular column of 6 mm in diameter and 7 mm in height. Each of the loaded dielectrics 8*b* to 8*e* has a shape of a circular column having the same height as that of the loaded dielectric 8*a*, and is cut so that the top surface or the radiation surface thereof becomes an inclined surface inclined at an angle of 45° from the plane parallel to the xy plane. The materials of the feeding openings 1*a* to 1*e*, the lower conductor substrate 11*b*, and the upper conductor substrate 12*b* and the cross-sectional shapes and dimensions of the feeding waveguides 4*a* to 4*e* and the radiation waveguides 7*a* to 7*e* are set to be similar to those of the first preferred embodiment.

The loaded dielectrics 8*b* to 8*e* are loaded and arranged so that the central axes Ab2 to Ae2 thereof parallel to the vertical direction are shifted from the central axes Ab1 to Ae2 of the radiation waveguides 7*b* to 7*e* parallel to the vertical direction by a displacement distance of 1.7 mm from the center at which the loaded dielectric 8*a* is located in an outside direction of the antenna apparatus, respectively.

In this case, based on the experimental results of a single loaded dielectric of the dielectric loaded antenna apparatus which does not constitute an array antenna (See DESCRIPTION OF RELATED ART and FIRST PREFERRED EMBODIMENT), the radiation directivity pattern on the yz plane and that on the xz plane according to the present preferred embodiment are calculated. Calculation results are shown in FIGS. 24 and 25.

Figure 24:
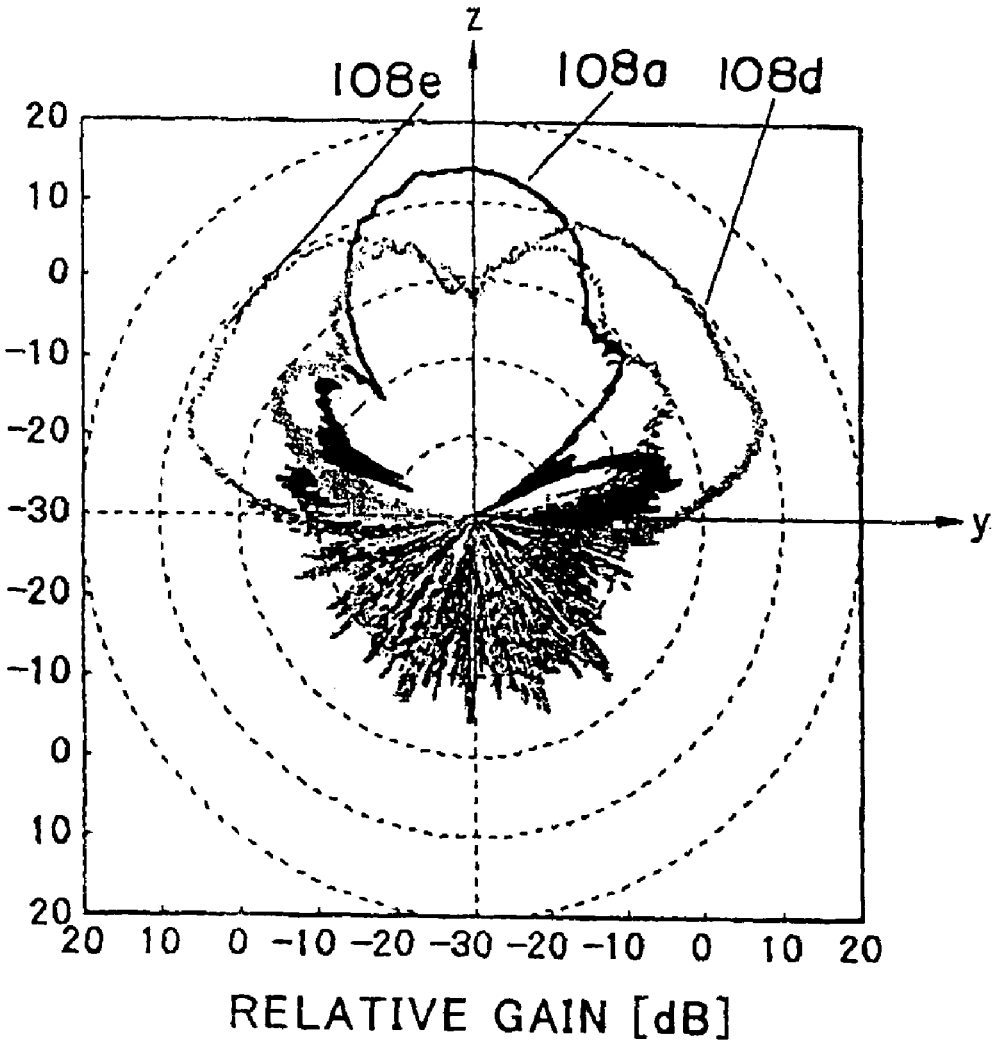
FIG. 24 is a graph showing a radiation directivity pattern on the yz plane of the dielectric loaded antenna apparatus 10*e* shown in FIG. 21.
Figure 25:
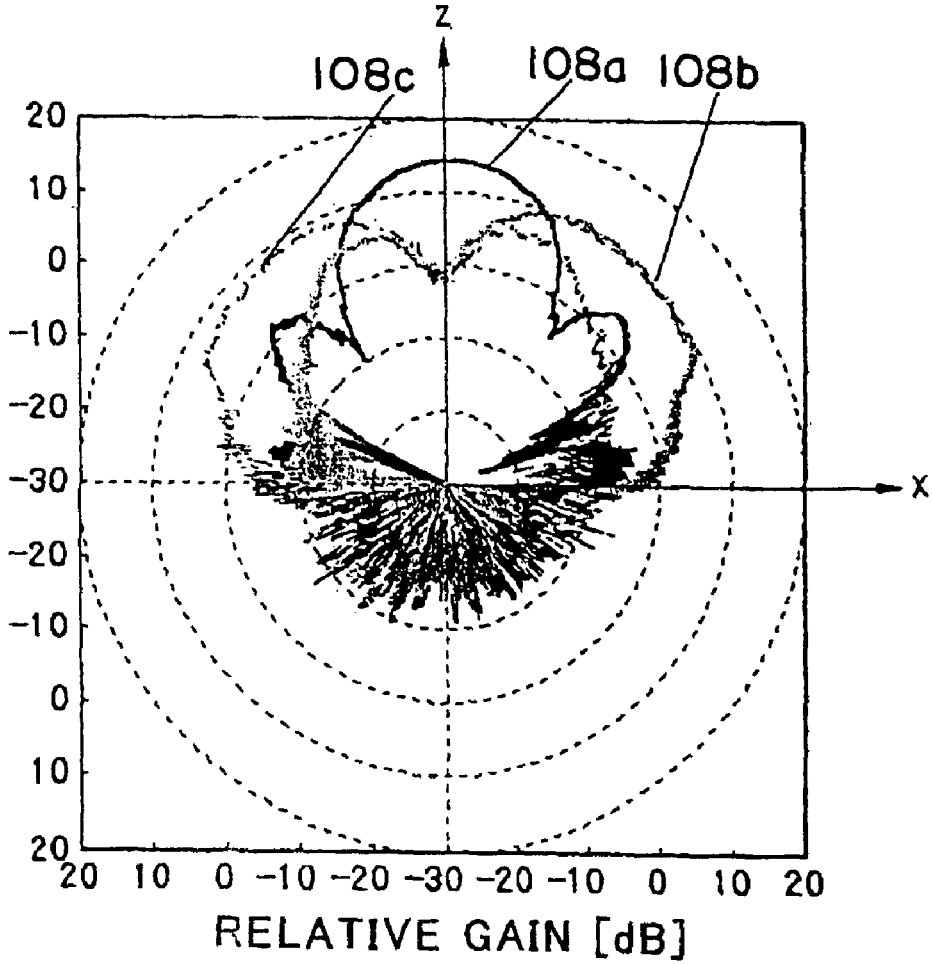
FIG. 25 is a graph showing a radiation directivity pattern on the xz plane of the dielectric loaded antenna apparatus 10*e* shown in FIG. 21.

Referring to FIGS. 24 and 25, the directivity patterns of the dielectric loaded antenna apparatus 10*e* when one of the loaded dielectrics 8*a* to 8*e* is selected by the switch 21 are denoted by numerical references 108*a* to 108*e*, respectively. As is apparent from FIGS. 24 and 25, the dielectric loaded antenna apparatus 10*e* of the present preferred embodiment can have a range of an angle of 140° with a gain of about 10 dBi on either the yz plane or the xz plane. Therefore, by employing the dielectric loaded antenna apparatus 10*e*, it is possible to increase the antenna gain and to widen the coverage area.

Figure 26:
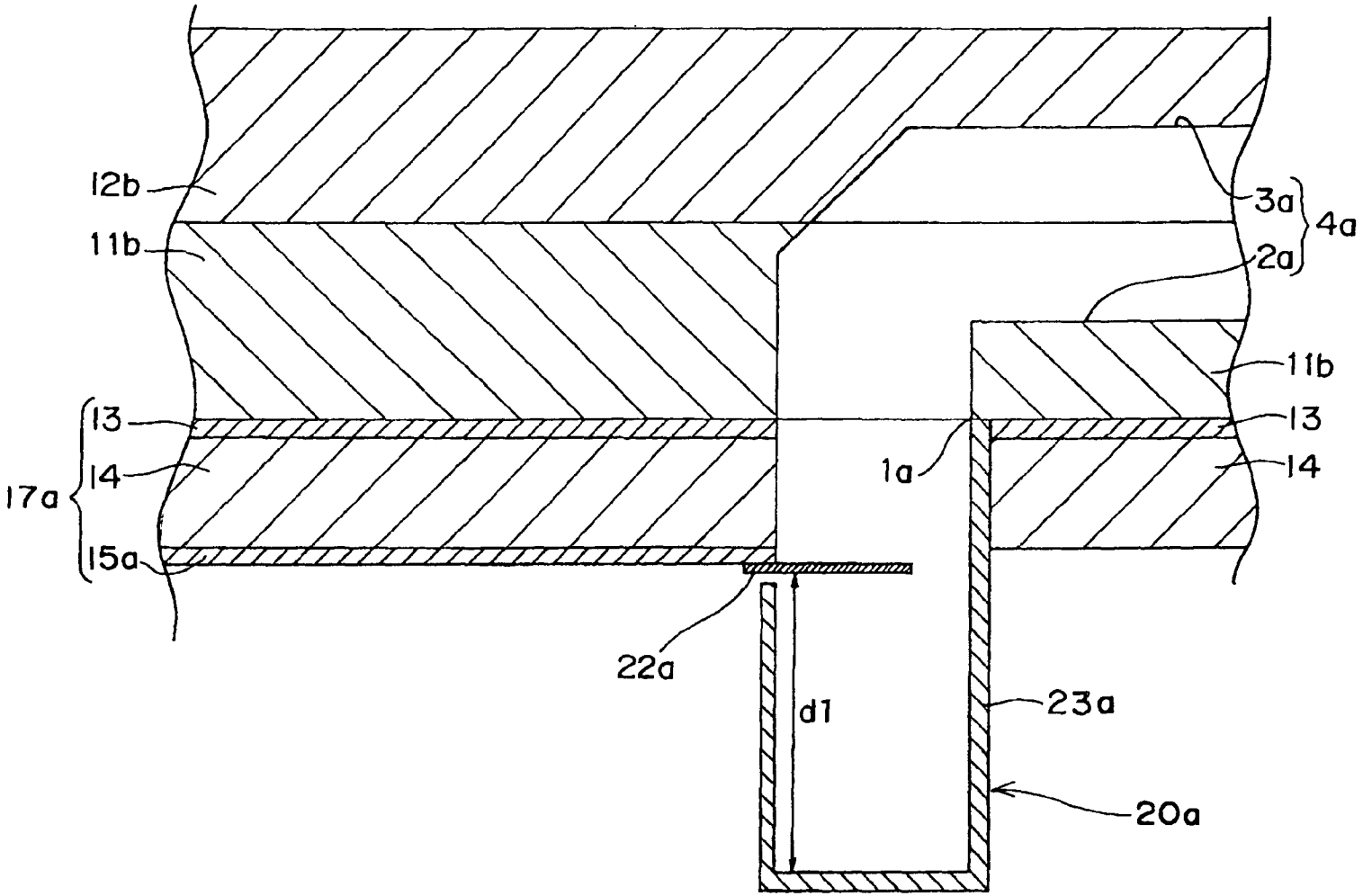
FIG. 26 is a longitudinal sectional view showing a detailed configuration of a microstrip line to rectangular waveguide converter 20*a* shown in FIG. 20.

In the present preferred embodiment, when the switch 21 is constituted by the microstrip lines 17*a* to 17*e*, the semiconductor switch and the like on the dielectric substrate 14, the microstrip line to rectangular waveguide converters 20*a* to 20*e* shown in FIG. 26 are employed as impedance matching units so that the microstrip lines 17*a* to 17*e* are matched to the feeding waveguides 4*a* to 4*e* in impedance, respectively.

Referring to FIG. 26, a probe 22*a* is provided on an end portion of the microstrip conductor 15*a* of the microstrip line 17*a* so that a longitudinal direction of the probe 22*a* is parallel to the longitudinal direction of the microstrip conductor 15*a*. The probe 22*a* protrudes inward in a central portion of a longer side of a rectangular cross section of a matched rectangular waveguide 23*a*, so that the longitudinal direction of the probe 22*a* is parallel to a shorter side thereof to be able to detect an electric field of the matched rectangular waveguide 23*a*. Further, one end of the matched rectangular waveguide 23*a* is an open end, another end thereof is a short-circuit end, and an open end-side waveguide 23*a* is coupled with the feeding waveguide 4*a* through the feeding opening 1*a*. The probe 22*a* is electrically isolated from the matched rectangular waveguide 23*a*. In this case, by setting a distance d1 between the probe 22*a* and the short-circuit end of the matched rectangular waveguide 23*a* to $n \times \lambda g/2$ (where n is a natural number) and setting the length of the probe 22*a* to a predetermined value such as a quarter wavelength, the matched rectangular waveguide 23*a* is allowed to operate as a resonator at an operating wavelength. By constituting the antenna apparatus as mentioned above, the probe 22*a* is allowed to operate as a simple monopole antenna and the radio signal propagated through the microstrip line 17*a* is fed to the feeding waveguide 4*a* through the matched rectangular waveguide 23.

In the preferred embodiment mentioned above, the transmission of radio signals between the switch and the feeding waveguides 4*a* to 4*e* is performed using the microstrip lines 15*a* to 15*e*. However, the present invention is not limited to this, and various kinds of transmission lines such as coaxial cables or the like may be employed in place of the microstrip lines 15*a* to 15*e*.

Seventh Preferred Embodiment

Figure 27:
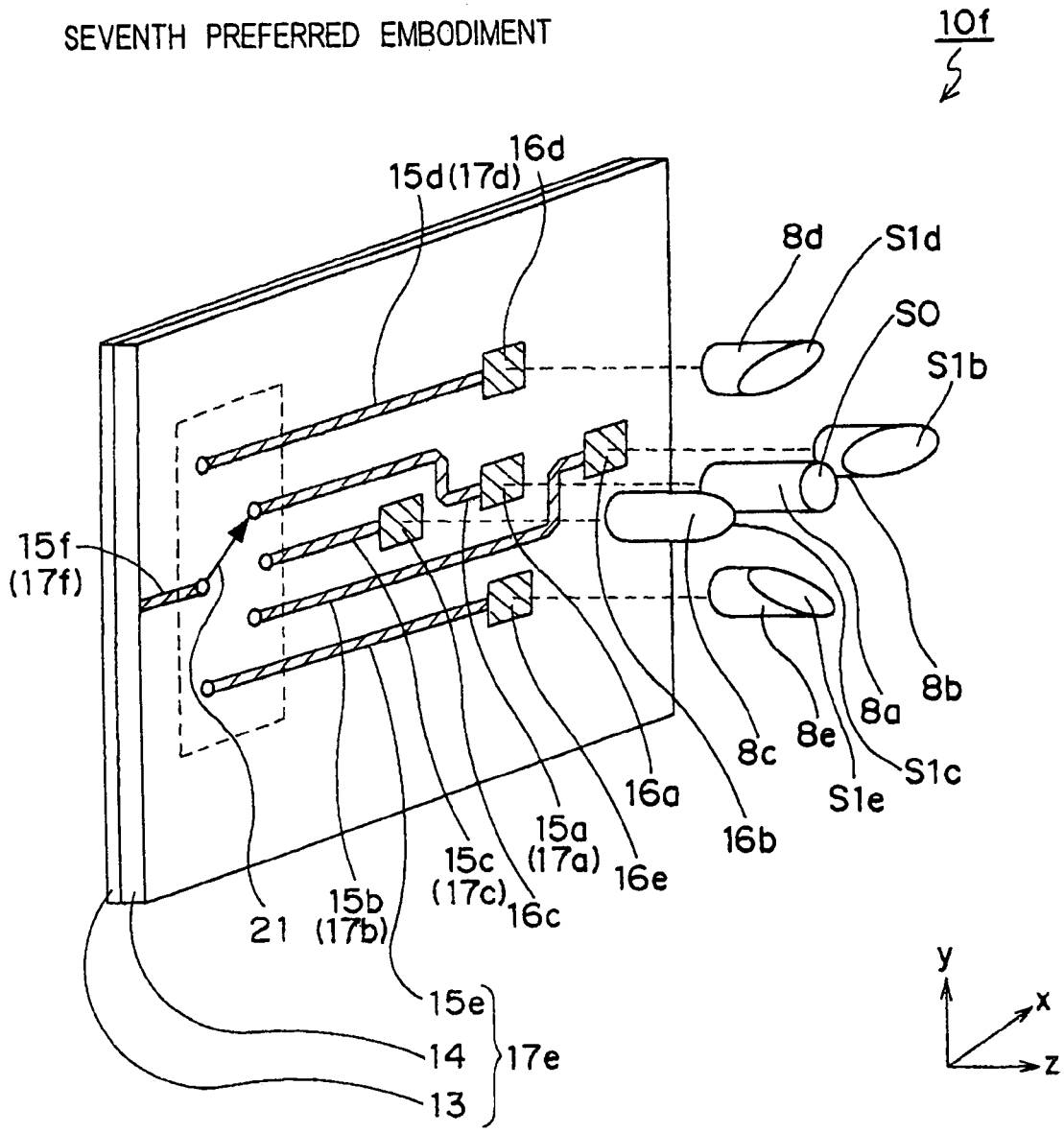
FIG. 27 is an exploded perspective view showing a configuration of a dielectric loaded antenna apparatus 10*f* of a seventh preferred embodiment according to the present invention.

FIG. 27 is an exploded perspective view showing a configuration of a dielectric loaded antenna apparatus 10*f* of a seventh preferred embodiment according to the present invention.

The dielectric loaded antenna apparatus 10*f* of the present preferred embodiment is characterized by constituting an array antenna apparatus of a type of switching the feeding of an electromagnetic wave to a microstrip line. That is, the present preferred embodiment is characterized in that microstrip lines 17*a* to 17*e* are employed in place of the feeding waveguides 4*a* to 4*e*, and the radiation waveguides 7*a* to 7*e* provided in the dielectric loaded antenna apparatus 10*e* of the sixth preferred embodiment.

Referring to FIG. 27, the configuration of the microstrip lines 17*a* to 17*f* and that of feeding patch conductors 16*a* to 16*e* are similar to those of the second and fifth preferred embodiments, and the configuration of loaded dielectrics 8*a* to 8*e* are similar to that of the sixth preferred embodiment. The present preferred embodiment is different from the sixth preferred embodiment at the following point: it is unnecessary to provide the waveguide to microstrip converters 20*a* to 20*e*. Therefore, the dielectric loaded antenna apparatus 10*f* of the present preferred embodiment can be manufactured more easily than the antenna apparatus of the sixth preferred embodiment.

Figure 28:
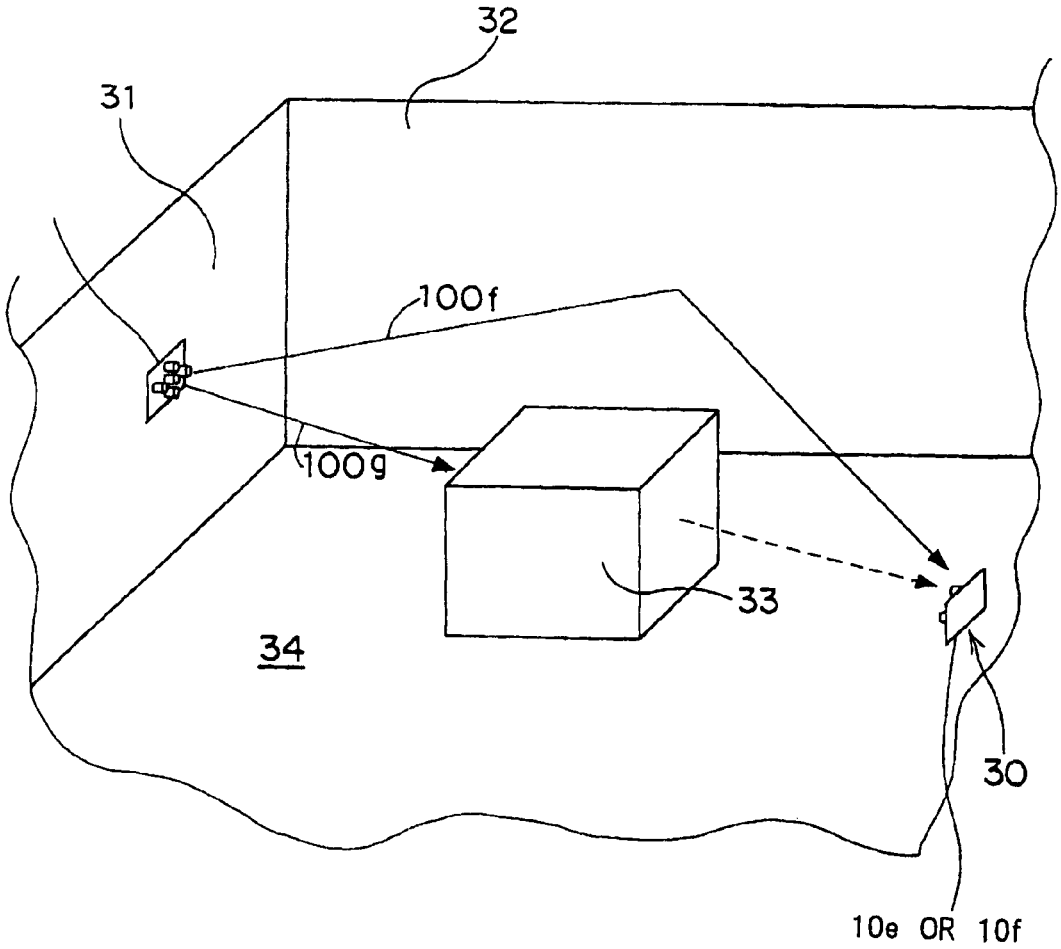
FIG. 28 is a perspective view showing antenna arrangement of a first implemental example of the sixth and seventh preferred embodiments according to the present invention.

FIG. 28 is a perspective view showing antenna arrangement of a first implemental example of the sixth and seventh preferred embodiments, which is an antenna element switching type array antenna apparatus. FIG. 28 shows that radio waves reflected by walls are utilized when the dielectric loaded antenna apparatus 10*e* or 10*f* is used. While the dielectric loaded antenna apparatus 10*e* or 10*f* is installed on a wall surface 31 of a room 34 and the other dielectric loaded antenna apparatus 10*e* or 10*f* is provided at a certain point 30 on a floor of the room 34, a shielding member 33 is present between the two antenna apparatuses. Due to this, a radio signal cannot sometimes be transmitted and received by a path 100*g* of a direct radio wave. In order to solve the present problem, the dielectric loaded antenna apparatus 10*e* or 10*f* of the present preferred embodiment employs the switch 21 which selectively switches the direction of the main beam, and this leads to that radio communication can be established using a path 100*f* of a reflected wave through a wall surface 32.

In the present implemental example, the direction of the main beam is selectively switched by the switch 21. As the selective switching method, a method based on spatial diversity or frequency diversity may be used. However, the number of the loaded dielectrics 8*a* to 8*e* is not limited to five, and five or more loaded dielectrics may be used.

Figure 29:
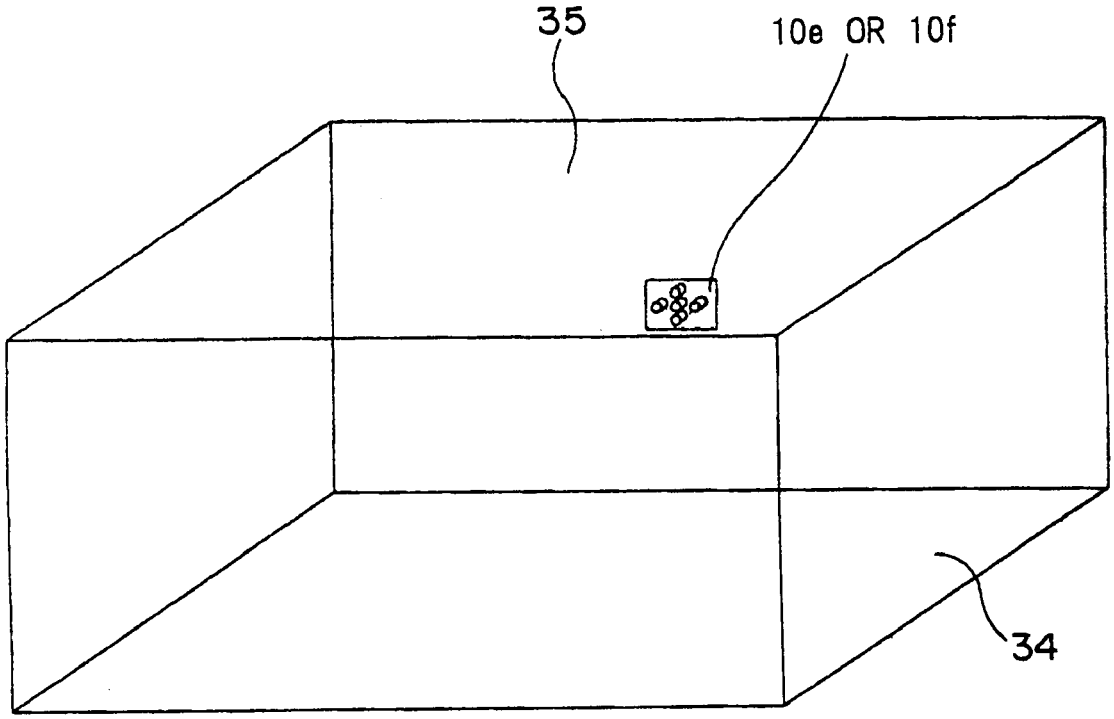
FIG. 29 is a perspective view showing antenna arrangement of a second implemental example of the sixth and seventh preferred embodiments according to the present invention.
Figure 30:
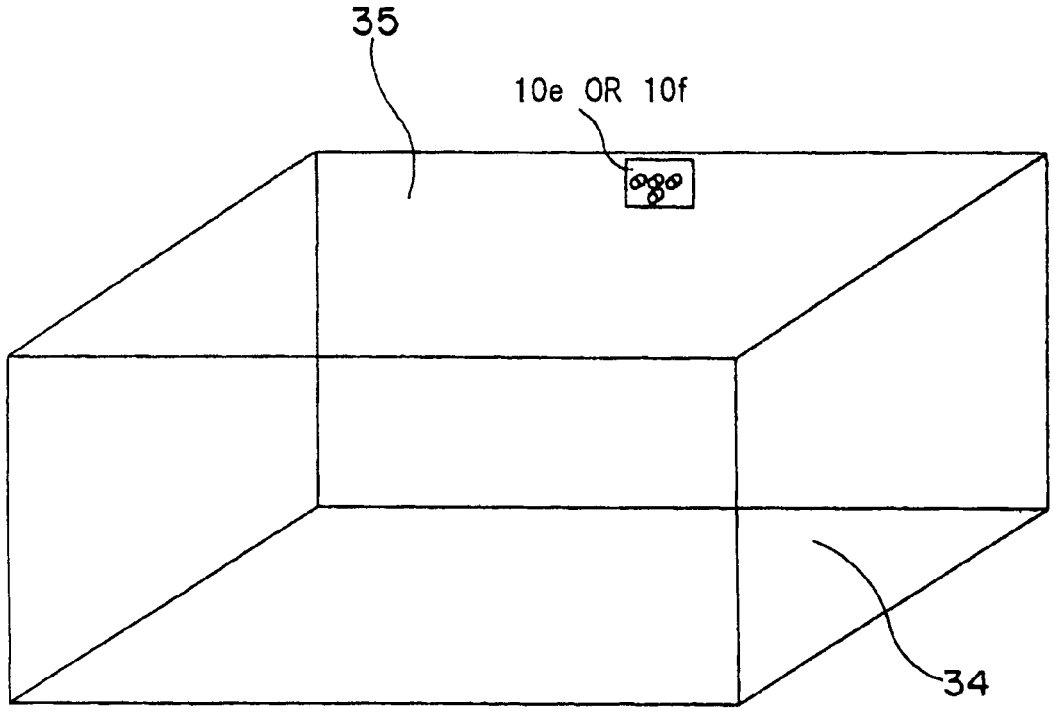
FIG. 30 is a perspective view showing antenna arrangement of a first modified preferred embodiment of the sixth and seventh preferred embodiments according to the present invention.
Figure 31:
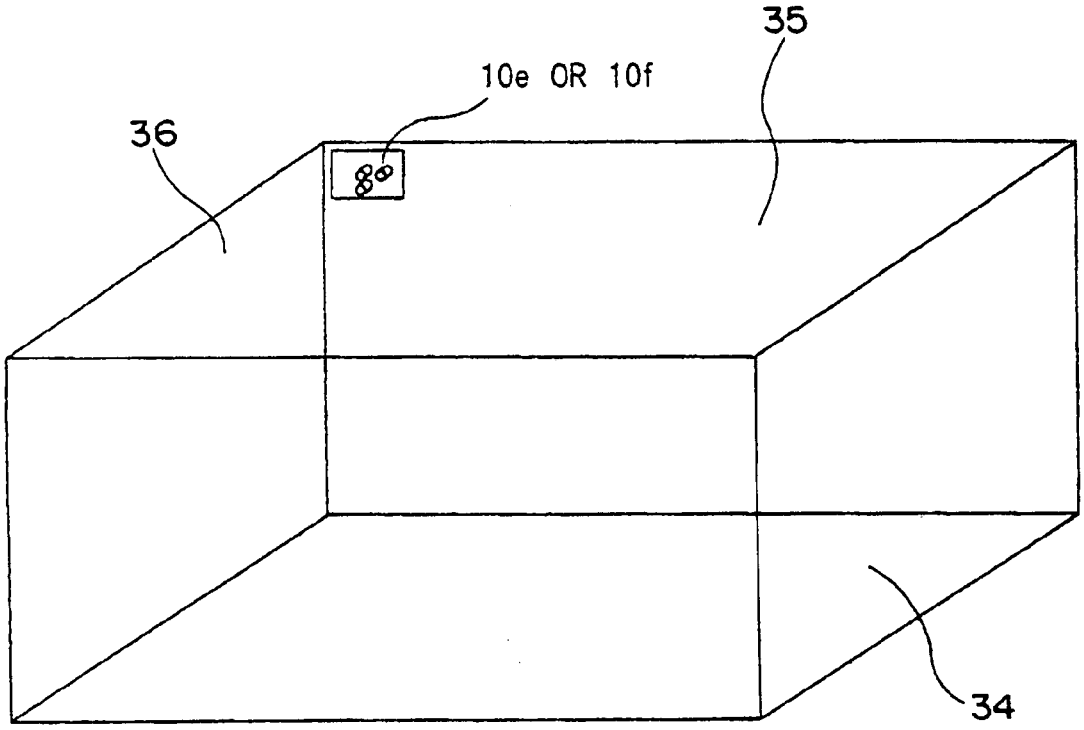
FIG. 31 is a perspective view showing antenna arrangement of a second modified preferred embodiment of the sixth and seventh preferred embodiments according to the present invention.

FIG. 29 is a perspective view showing a second implemental example of the sixth and seventh preferred embodiments. FIG. 30 is a perspective view showing a first modified preferred embodiment of the sixth and seventh preferred embodiments. FIG. 31 is a perspective view showing a second modified preferred embodiment of the sixth and seventh preferred embodiments. The implemental example and the modified embodiments will now be described.

When the dielectric loaded antenna apparatus 10*e* or 10*f* of the sixth or seventh preferred embodiment is provided in the room 34 and the apparatus 10*e* or 10*f* is provided at the center of a wall surface 35 of the room 34 as shown in FIG. 29, then all the five antenna elements corresponding to the loaded dielectrics 8*a* to 8*e* are required so as to radiate the electromagnetic wave in a wider area of the room 34.

However, if the antenna apparatus is provided on an upper end of the wall surface 35 close to a ceiling or on an end of the wall surface 35 such as a corner, which is adjacent to the ceiling and the other wall surface 36 as shown in FIGS. 30 and 31, all of the five antenna elements are not always necessary. That is, in the example of FIG. 30, it is unnecessary to provide the loaded dielectric 8*d* of FIG. 21 for inclining the main beam in a direction toward the ceiling (referred to as a ceiling direction hereinafter). In this case, in the sixth preferred embodiment in which an electromagnetic wave is fed to the waveguide, it is unnecessary to provide the radiation waveguide 7*d* and the feeding waveguide 4*d*, thus simplifying the configuration of the antenna apparatus.

In a manner similar to above, if the antenna apparatus is installed in an upper corner of the wall surface 31 as shown in FIG. 31, it is unnecessary to provide the loaded dielectric 8*c* for inclining the main beam in a direction toward the wall surface 36 and the loaded dielectric 8*d* of FIG. 21 for inclining the main beam in the ceiling direction. In this case, in the sixth preferred embodiment in which the radio wave is fed to the waveguide, it is unnecessary to provide the radiation waveguides 7*c* and 7*d* and the feeding waveguides 4*c* and 4*d*. As can be seen from this, the arrangement of the loaded dielectrics 8*a* to 8*e* is changed or a part of which is deleted depending on an installation position of the antenna apparatus. This leads to a decrease in the number of unnecessary components and the number of manufacturing steps. Further, this leads to making the whole antenna apparatus smaller in size and lighter in weight.

In the present preferred embodiment, it is assumed that the antenna apparatus is installed in the room 34. The antenna apparatus may be installed not indoors but outdoors or the like. For example, even if the antenna apparatus is installed outdoors, the above-mentioned implemental example and modified preferred embodiments can be applied by changing the arrangement of the loaded dielectrics 8*a* to 8*e* or deleting a part of them. Furthermore, if an unnecessary loaded dielectric 8 is present because of the presence of an obstruction or the like on a radio propagation path, the whole antenna apparatus can be made smaller in size and lighter in weight by deleting the loaded dielectric 8.

Eighth Preferred Embodiment

Figure 32:
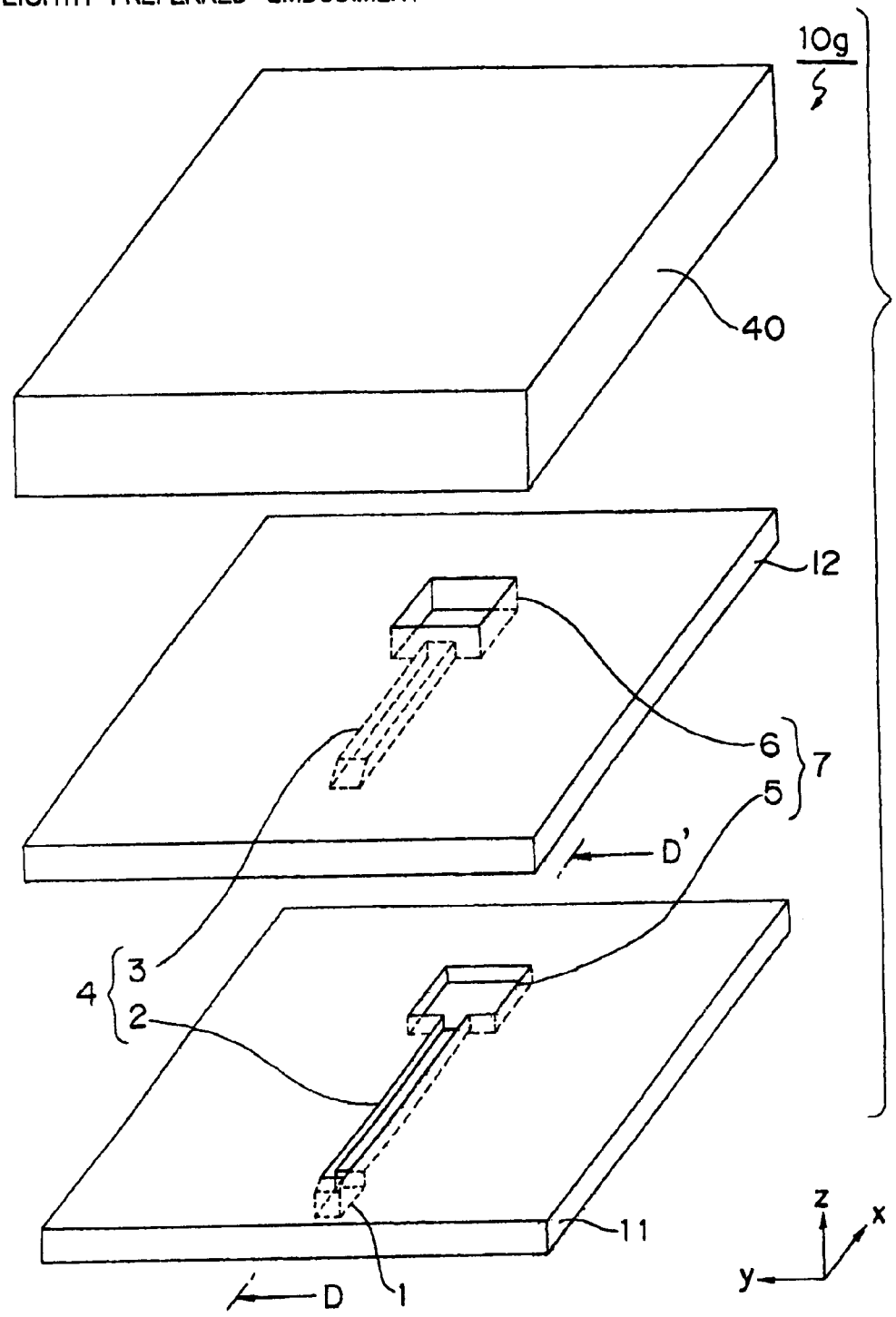
FIG. 32 is an exploded perspective view showing a configuration of a dielectric loaded antenna apparatus 10*g* of an eighth preferred embodiment according to the present invention.
Figure 33:
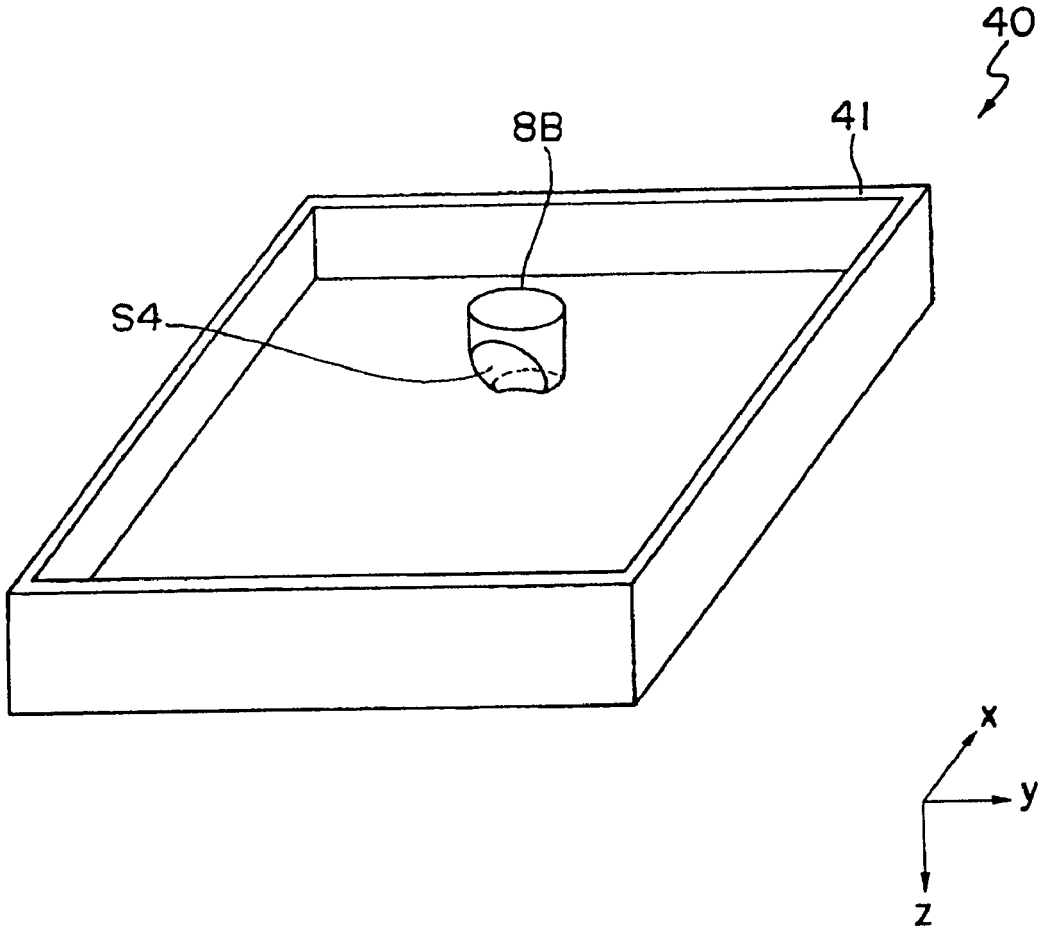
FIG. 33 is a perspective view showing a rear surface of a radome 40 shown in FIG. 32.
Figure 34:
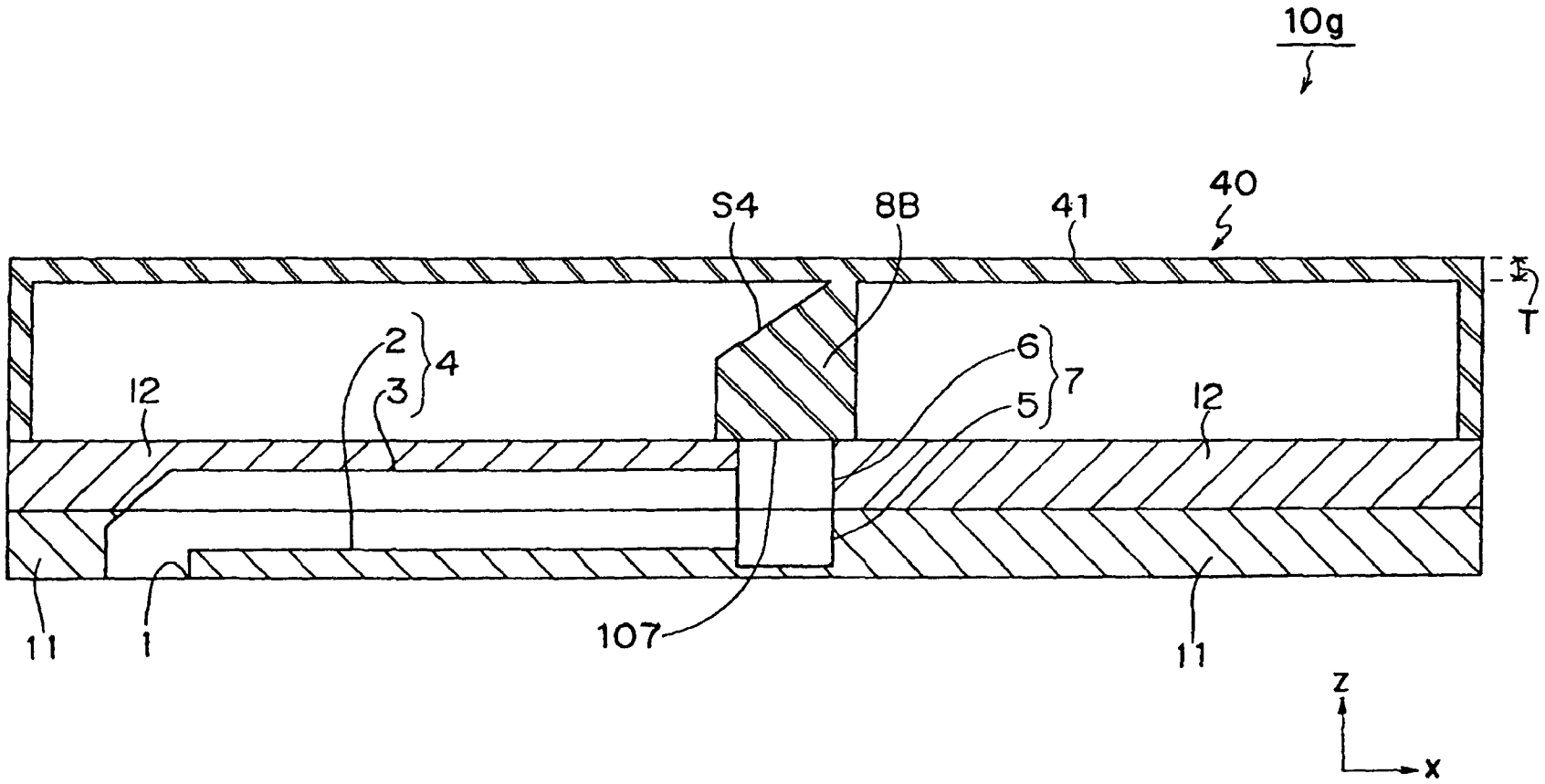
FIG. 34 is a longitudinal sectional view taken along a line D–D' of FIG. 32.

FIG. 32 is an exploded perspective view showing a configuration of a loaded dielectric-radome integrated dielectric loaded antenna apparatus 10*g* of an eighth preferred embodiment according to the present invention. FIG. 33 is a perspective view showing a rear surface of a loaded dielectric-integrated radome 40 shown in FIG. 32. FIG. 34 is a longitudinal sectional view taken along a line D–D' of FIG. 32. The dielectric loaded antenna apparatus 10*g* of the present preferred embodiment is characterized by including the loaded dielectric-integrated radome 40 having a loaded dielectric 8*b* and a radome 41 which are formed integrally.

In the present preferred embodiment, the loaded dielectric-integrated radome 40 in which the loaded dielectric 8B and the radome 41 are formed integrally with each other is formed by either cutting a predetermined rectangular parallelepiped shape made of a resin, for example, using a cutter or a file or molding the predetermined rectangular parallelepiped shape. The radome 41 has a hollow rectangular parallelepiped shape and has no bottom surface in the lower portion thereof, so that the radome 41 is opened. Further, a thickness T of the radome 41 of FIG. 34 is generally designed to be a thickness of an odd number multiple of about $$\frac{\lambda_g}{2\sqrt{\varepsilon_r}}$$

so as to suppress the reflected wave of the radiated electromagnetic wave. In this case, $\lambda g$ denotes a guide wavelength that corresponds to an operating wavelength, and $\epsilon_r$ indicates a dielectric constant of the resin used to form the loaded dielectric-integrated radome 40. Although the loaded dielectric 8B has an inclined surface S4 on the top surface or the radiation surface, the dielectric 8B is formed integrally with the radome 41 while a part of an upper end thereof is buried in the radome 41 as shown in FIG. 34.

In the conventional dielectric loaded antenna apparatus shown in FIG. 41, it is difficult to adjust installation positions of the loaded dielectric 108 and the radiation waveguide 7. In a high frequency band such as a millimeter wave band, in particular, the loaded dielectric 108 and the radiation waveguide 7 are formed smaller, which makes it more difficult to adjust the installation positions. If the installation positions are deviated, this leads to deterioration in gain and a change in main beam direction. Further, since the loaded dielectric 108 is provided on the radiation waveguide 7, an adhesive or the like forms one layer. As a result, the antenna apparatus disadvantageously exhibits an electric characteristic different from a desired electric characteristic. These factors cause variation in the product. In order to solve these disadvantages, the antenna apparatus includes the loaded dielectric-integrated radome 40 having the loaded dielectric 8B and the radome 41 formed integrally with each other in the present preferred embodiment. Therefore, it is possible to eliminate the difficulty of individually installing the loaded dielectric 8B.

In the present preferred embodiment, instead of bonding the loaded dielectric 8B onto the upper conductor substrate 12, a lower outer peripheral bottom of the radome 41 may be bonded onto the upper conductor substrate 12. If so, the adhesive layer which bonds the loaded dielectric 8B to the radiation waveguide 7 is not present on the upper conductor substrate 12. Therefore, the loss of the radiated electromagnetic wave can be decreased, the designing of the antenna apparatus can be easily done, and variation in the electric characteristic of the antenna apparatus can be eliminated.

In the present preferred embodiment, the radome 41 is rectangular parallelepiped. However, the present invention is not limited to this, and the radome 41 may have a shape other than the shape of rectangular parallelepiped such as a polygonal shape, a polyhedral shape, a cylindrical shape or a semicircular shape. Further, if the array antenna onto which a plurality of dielectrics 8 is loaded is employed, the plurality of loaded dielectrics 8 may be formed integrally with the radome 41.

In the present preferred embodiment, the dielectric loaded antenna apparatus 10*g* in which an electromagnetic wave is fed by means of the waveguide is described above. However, the present invention is not limited to this. In a dielectric loaded antenna apparatus in which an electromagnetic wave is fed by means of a microstrip line, the loaded dielectric 8 may be formed integrally with the radome 41.

Ninth Preferred Embodiment

Figure 35:
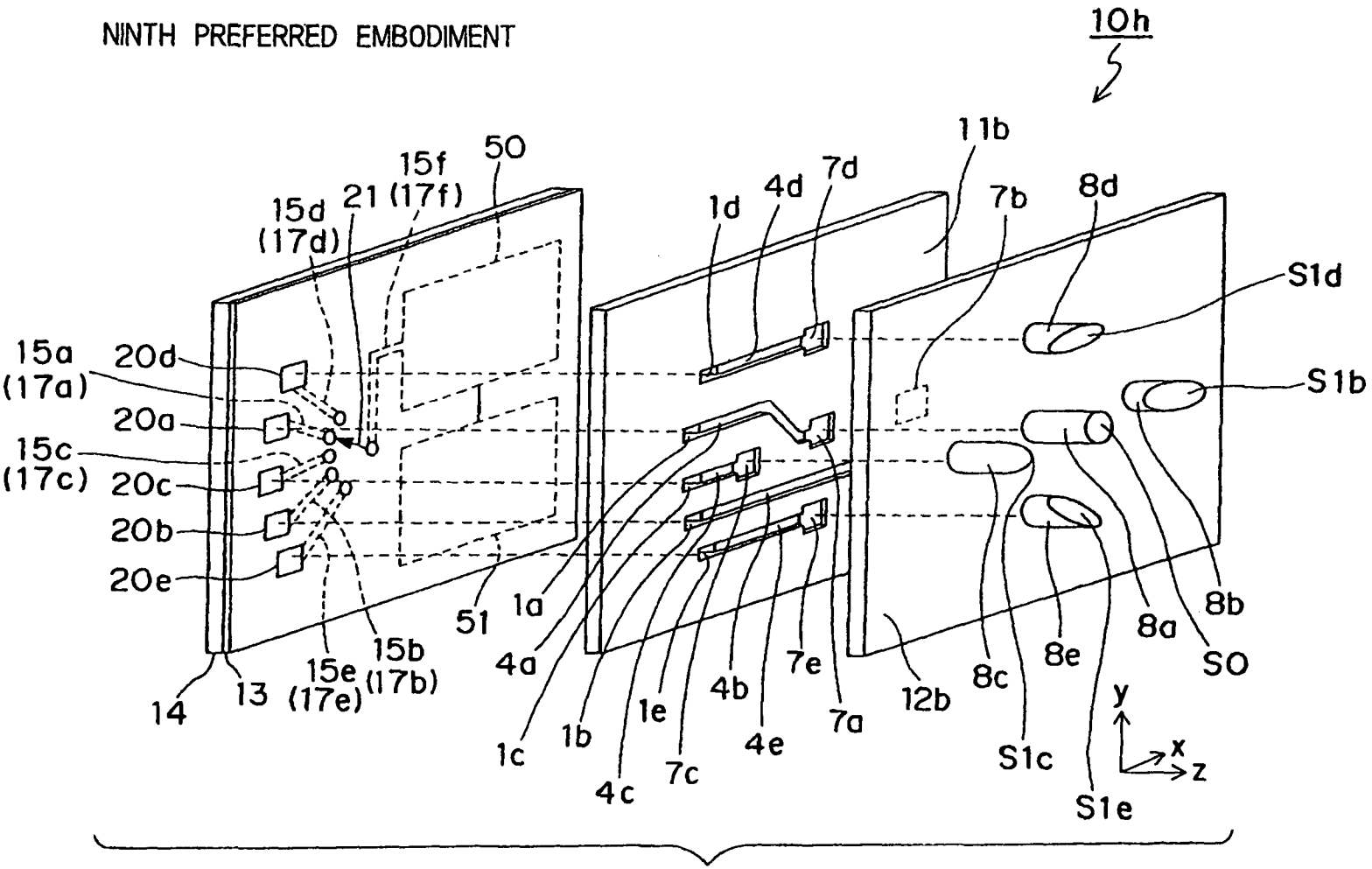
FIG. 35 is an exploded perspective view showing a configuration of a dielectric loaded antenna apparatus 10*h* of a ninth preferred embodiment according to the present invention.

FIG. 35 is an exploded perspective view showing a configuration of a dielectric loaded antenna apparatus 10*h* of a ninth preferred embodiment according to the present invention.

The ninth preferred embodiment is characterized in that in the dielectric loaded antenna apparatus 10*e* as described in the sixth preferred embodiment shown in FIG. 21, that is a switching type array antenna apparatus which selects a plurality of antenna elements using the switch 21, (a) a radio transceiver circuit (or a radio transmitter and receiver circuit) 50 which transmits and receives a radio signal and (b) a modulator and demodulator circuit (or a modem circuit) 51 which modulates and demodulates the radio signal are formed on the dielectric substrate 14 on which the switch 21 is formed. The other components of the antenna apparatus 10*h* of the present preferred embodiment are formed in a manner similar to that of the dielectric loaded antenna apparatus 10*e* of the sixth preferred embodiment.

Referring to FIG. 35, an electromagnetic wave arriving from a free space is incident onto the loaded dielectrics 8*a* to 8*e*, passes through radiation waveguides 7*a* to 7*e* and feeding waveguides 4*a* to 4*e*, and arrives at feeding openings 1*a* to 1*e*. The electromagnetic wave is introduced to a microstrip line 17*f*, the radio transceiver circuit 50, and the modulator and demodulator circuit 51 provided on the dielectric substrate 14 through microstrip line to rectangular waveguide converters 20*a* to 20*e* provided in lower portions of the feeding openings 1*a* to 1*e*, microstrip lines 17*a* to 17*e* and the switch 21. In this case, the radio transceiver circuit 50, which includes a filter, an amplifier, a mixer, an oscillator and the like, converts a signal output from the modulator and demodulator circuit 51 into a radio signal at a higher radio frequency, amplifies the resulting radio signal, and outputs and radiates the resultant radio signal as a transmitted radio signal to the dielectric loaded antenna apparatus 10*h* through the switch 21. Further, the circuit 50 subjects the radio signal received by the dielectric loaded antenna apparatus 10*h* to low noise amplification, converts the radio signal into an intermediate frequency signal at a predetermined intermediate frequency, and outputs the resultant signal to the modulator and demodulator circuit 51. The modulator and demodulator circuit 51 digitally modulates a carrier wave by a predetermined digital modulation method according to a data signal input from an external circuit, and outputs the modulated signal to the radio transceiver circuit 50. Further, the circuit 51 digitally demodulates the intermediate frequency signal from the radio transceiver circuit 50 by predetermined digital demodulation method, and outputs the demodulated data signal to an external circuit.

According to the present preferred embodiment constituted as mentioned above, the antenna apparatus has not only such advantageous effects as the dielectric loaded antenna apparatus 10*h* being small in size and light in weight, but also such an advantageous effect that the radio transceiver circuit 50 and the modulator and demodulator circuit 51 can be formed to be quite small in size in a high frequency band such as a millimeter wave band. Due to this, when the radio transceiver circuit 50 and the modulator and demodulator circuit 51 are formed by bonding the circuits 50 and 51 onto the bottom surface of the dielectric substrate 14, the whole antenna apparatus which includes the radio circuit can be constituted as a radio transmission apparatus that is a small-sized transmission and reception module (or transceiver module).

Figure 36:
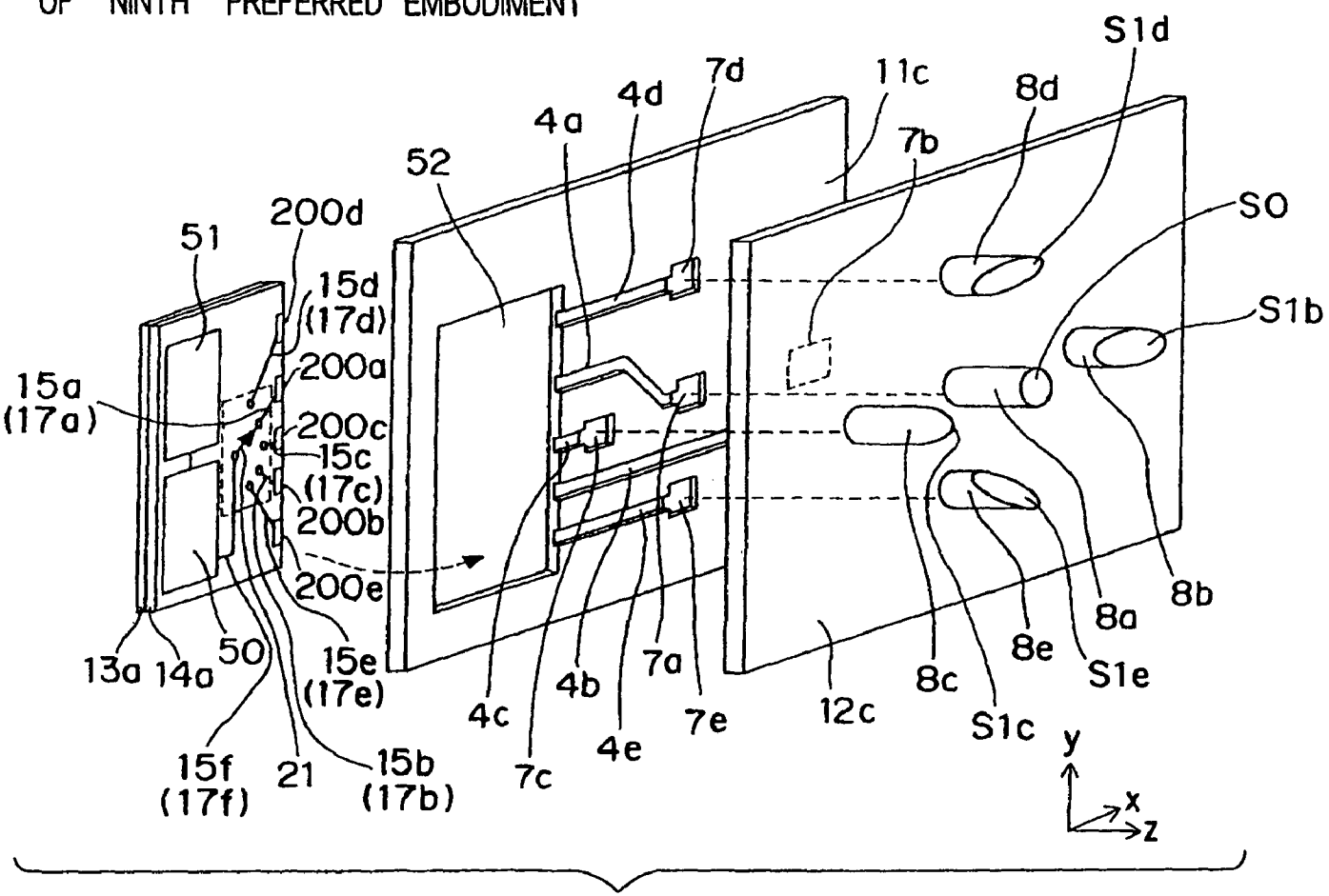
FIG. 36 is an exploded perspective view showing a configuration of a dielectric loaded antenna apparatus of a modified preferred embodiment of the ninth preferred embodiment.
Figure 37:
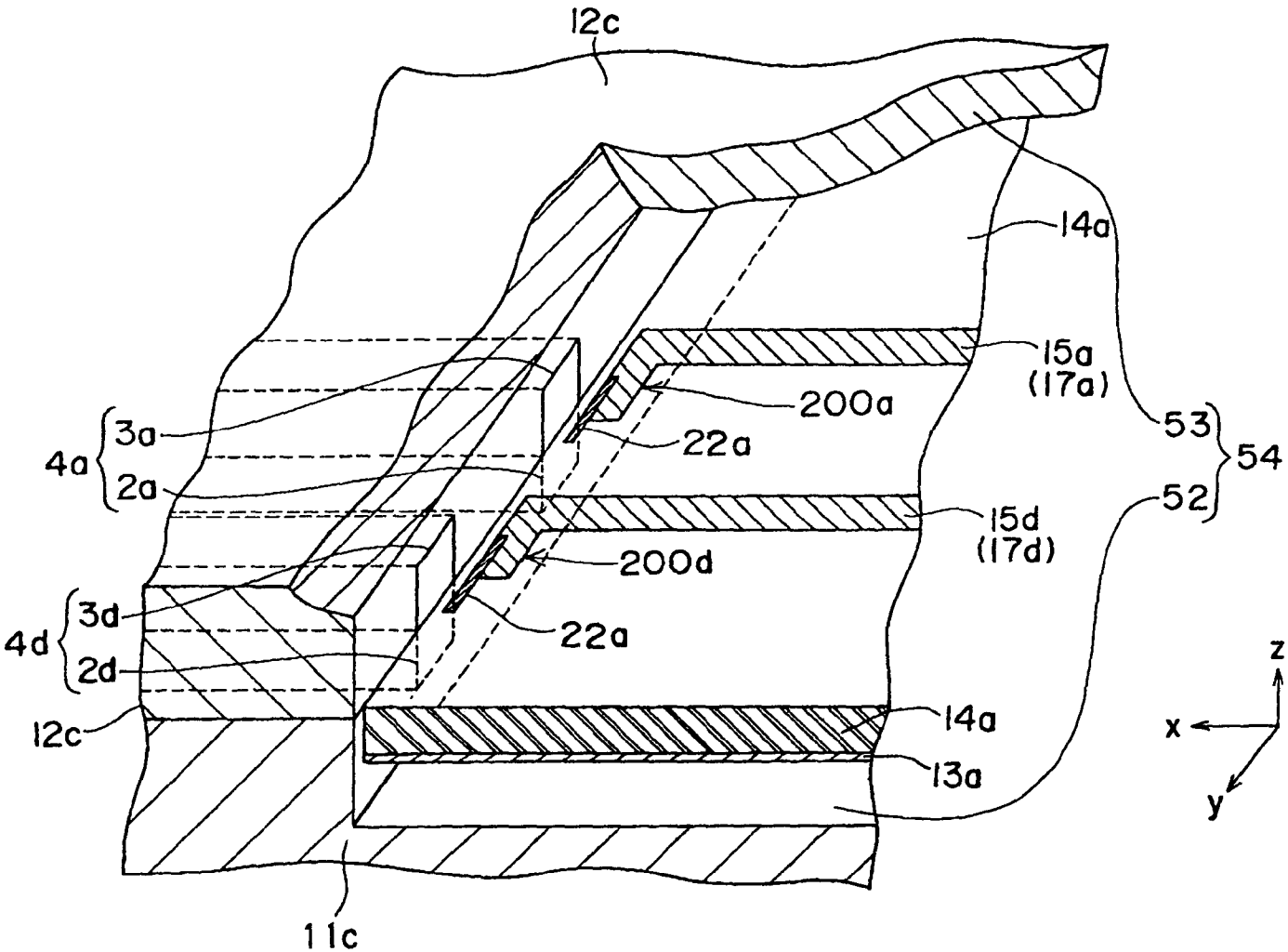
FIG. 37 is a perspective view showing a detailed configuration of a microstrip line to rectangular waveguide converter shown in FIG. 36.

FIG. 36 is an exploded perspective view showing a dielectric loaded antenna apparatus in a modified preferred embodiment of the ninth preferred embodiment. FIG. 37 is a perspective view showing a detailed configuration of a microstrip line to rectangular waveguide converter 200*a* or 200*d* shown in FIG. 36.

As shown in FIGS. 36 and 37, in the modified preferred embodiment of the ninth preferred embodiment, a lower cavity 52 having a predetermined rectangular shape is formed to pass through a thickness direction of a lower conductor substrate 11*c*. Further, as shown in FIG. 37, an upper cavity 53 having a predetermined rectangular shape is formed in a lower portion of an upper conductor substrate 12*c* at a position opposing to the lower cavity 52. The two cavities 52 and 53 constitute a cavity 54. In the cavity 54, a dielectric substrate 14*a* which includes the radio transceiver circuit 50 and the modulator and demodulator circuit 51 is provided.

On the dielectric substrate 14*a*, microstrip line to rectangular waveguide converters 200*a* to 200*e*, the microstrip conductors 15*a* to 15*f*, and the switch 21 are formed. A ground conductor 13*a* and the respective microstrip conductors 15*a* to 15*f*, between which the dielectric substrate 14*a* is sandwiched, constitute the microstrip lines 17*a* to 17*f*, respectively. The respective microstrip line to rectangular waveguide converters 200*a* to 200*e* are connected respectively with the radio transceiver circuit 50 and the modulator and demodulator circuit 51 through the microstrip lines 17*a* to 17*e*, the switch 21, and the microstrip line 17*f*.

According to the modified preferred embodiment of the ninth preferred embodiment constituted as mentioned above, the radio transceiver circuit 50 and the modulator and demodulator circuit 51 are provided in the cavity 54 formed in the lower conductor substrate 11*c* and the upper conductor substrate 12*c*, and this leads to the whole antenna apparatus including the radio transceiver circuit 50 and the modulator and demodulator circuit 51 being made smaller in size. Further, the lower conductor substrate 11*c* and the upper conductor substrate 12*c* can be used as shielding plates for the radio transceiver circuit 50 and the modulator and demodulator circuit 51.

FIG. 37 is a perspective view showing a detailed configuration of the microstrip line to rectangular waveguide converter 200*a* or 200*d* shown in FIG. 36.

As shown in FIG. 37, a probe 22*a* is provided on an end portion of the microstrip conductor 15*a* on the microstrip line 17*a* so that a longitudinal direction of the probe 22*a* is parallel to that of the microstrip conductor 15*a*. The probe 22*a* is located in a central portion of a longer side direction of a rectangular cross section of the open end of the feeding waveguide 4*a* so as to be able to detect an electric field of the feeding waveguide 4*a*, and so that the longitudinal direction of the probe 22*a* is parallel to a shorter side of the rectangular cross section. Further, a probe 22*d* is provided on an end portion of the microstrip conductor 15*d* on the microstrip line 17*d* so that a longitudinal direction of the probe 22*d* is parallel to that of the microstrip conductor 15*d*. The probe 22*d* is located in a central portion of a longer side direction of a rectangular cross section of the open end of the feeding waveguide 4*d* so as to be able to detect an electric field of the feeding waveguide 4*d*, and so that the longitudinal direction of the probe 22*d* is parallel to a shorter side of the rectangular cross section. In a manner similar to the above, probes are formed for the other microstrip line to rectangular waveguide converters 200*b*, 200*c*, and 200*e*. That is, the respective probes 22*a* to 22*e* are connected with end portions of the microstrip conductors 15*a* to 15*e* and electrically isolated from the lower conductor substrate 11*c* and the upper conductor substrate 12*c*. The respective probes 22*a* to 22*e* detect electric fields of electromagnetic waves from the feeding waveguides 4*a* to 4*e*, respectively, and output the detected electric fields to the microstrip conductors 17*a* to 17*e*. On the other hand, the probes 22*a* to 22*e* feed the electromagnetic waves of radio signals from the microstrip lines 17*a* to 17*e* of the microstrip conductors 15*a* to 15*e* to the feeding waveguides 4*a* to 4*e*, respectively.

Figure 38:
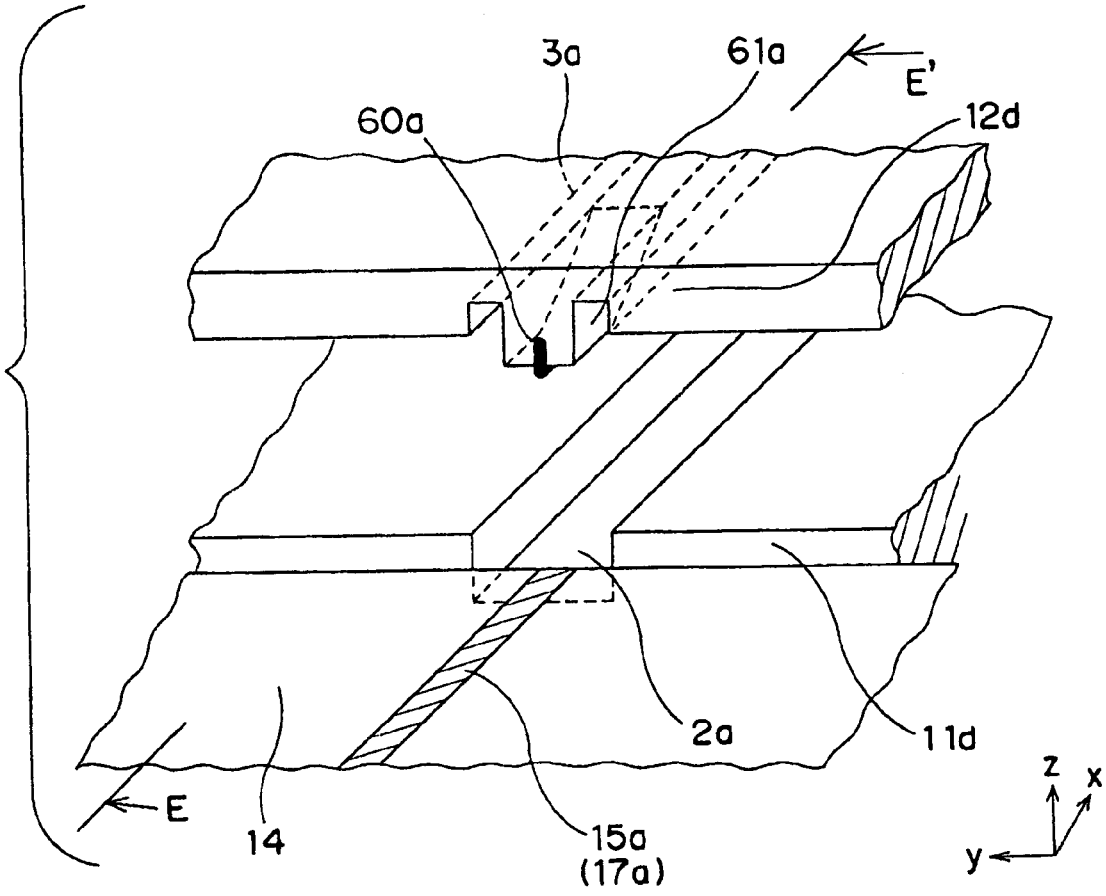
FIG. 38 is an exploded perspective view showing a modified preferred embodiment of the microstrip line to rectangular waveguide converter shown in FIG. 36.
Figure 39:
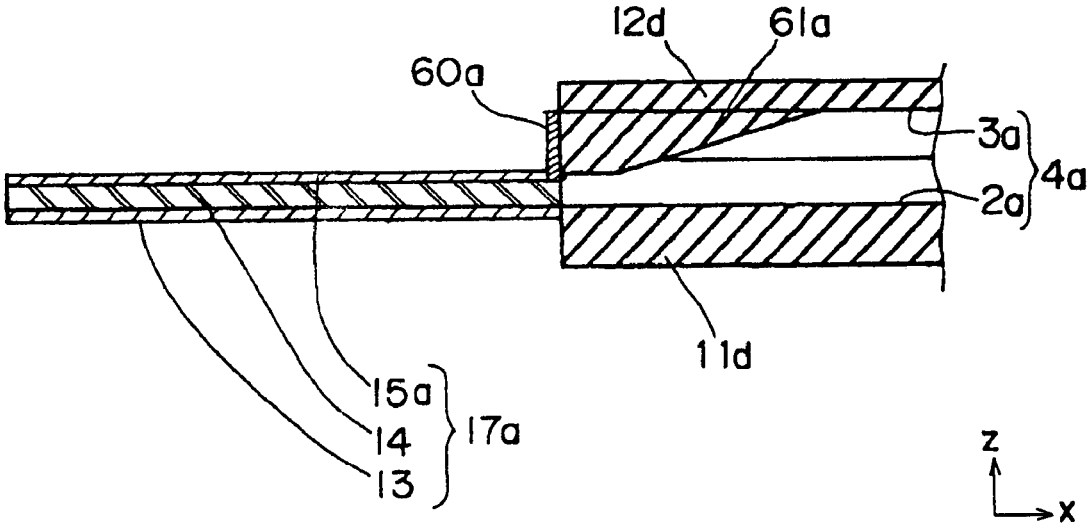
FIG. 39 is a longitudinal sectional view taken along a line E–E' of FIG. 38.

FIG. 38 is an exploded perspective view showing a configuration of a ridge waveguide converter of a modified preferred embodiment of the microstrip line to rectangular waveguide converter shown in FIG. 36. FIG. 39 is a longitudinal sectional view taken along a line E–E' of FIG. 38.

As shown in FIGS. 38 and 39, the ridge waveguide converter has a tapered portion 61*a* provided on the open end of the feeding waveguide 4*a* so as to shorten the shorter side of the rectangular cross section of the open end in a tapered manner. The ridge waveguide converter converts an electromagnetic wave propagating into the feeding waveguide 4*a* as a TE wave into a TEM wave, detects the converted TEM wave using the probe 60*a* connected with an end portion of the tapered portion 61*a*, and outputs the TEM wave to the microstrip line 17*a* of the microstrip conductor 15*a*. The tapered portion 61*a* is formed integrally with the upper conductor substrate 12*c*.

In the modified preferred embodiment of the ninth preferred embodiment shown in FIG. 36, electromagnetic waves are fed to the loaded dielectrics 8*a* to 8*e* through the feeding waveguides 4*a* to 4*e* and the radiation waveguides 7*a* to 7*e*. However, the present invention is not limited to this. As described in the seventh preferred embodiment shown in FIG. 27, the electromagnetic waves may be fed thereto through the microstrip lines 15*a* to 15*e* and the feeding path conductors 16*a* to 16*e*. In this case, the radio transceiver circuit 50 and the modulator and demodulator circuit 51 are formed on either the top surface or the bottom surface of the dielectric substrate 14*a* on which the microstrip lines 15*a* to 15*e* are formed.

According to the ninth preferred embodiment and the modified preferred embodiment of the ninth preferred embodiment constituted as mentioned above, the dielectric loaded antenna apparatus 10*h* can be constituted as a small-sized radio communication apparatus. Further, impedance mismatching that occurs in the connected portion between the feeding line of the antenna apparatus and the radio transceiver circuit 50 can be eliminated by the microstrip line to rectangular waveguide converters 200*a* to 200*e* or the ridge waveguide converter.

In the ninth preferred embodiment and the modified preferred embodiment of the ninth preferred embodiment, five antenna elements corresponding to the loaded dielectrics 8*a* to 8*e* are provided. However, the present invention is not limited to this, and the number of antenna elements may be plural other than five.

In the ninth preferred embodiment and the modified preferred embodiment of the ninth preferred embodiment, the radio transceiver circuit 50 and the modulator and demodulator circuit 51 are constituted by different circuits. However, the present invention is not limited to this, and the radio transceiver circuit 50 and the modulator and demodulator circuit 51 may be constituted by an integral circuit.

Tenth Preferred Embodiment

Figure 40:
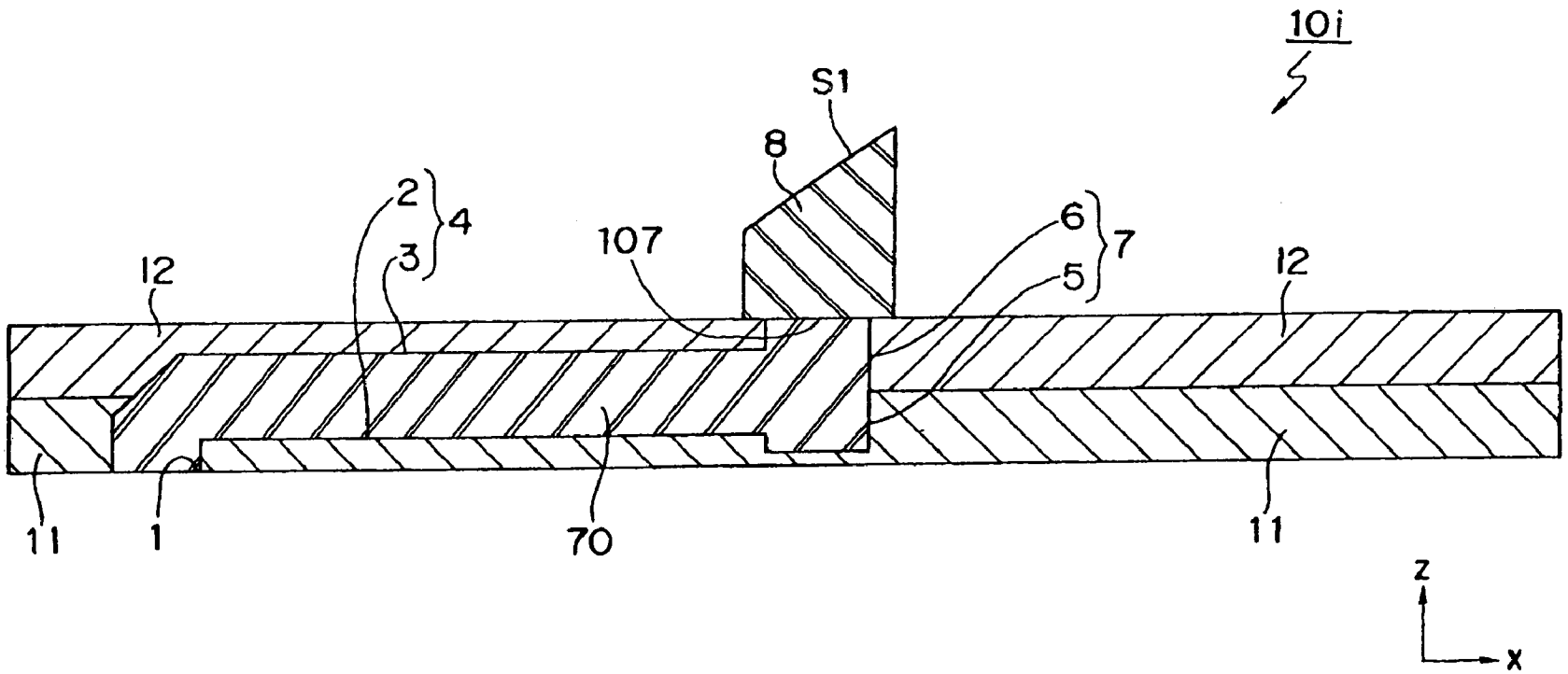
FIG. 40 is a longitudinal sectional view showing a configuration of a dielectric loaded antenna apparatus 10*i* of a tenth preferred embodiment according to the present invention.

FIG. 40 is a longitudinal sectional view showing a configuration of a dielectric loaded antenna apparatus 10*i* of the tenth preferred embodiment according to the present invention. The dielectric loaded antenna apparatus 10*i* of the tenth preferred embodiment is characterized in that a dielectric 70 is filled into the feeding waveguide 4 and the radiation waveguide 7 according to the first preferred embodiment.

Generally speaking, the propagation velocity of the electromagnetic wave in the dielectric is smaller than that in the free space. Accordingly, by filling each of the feeding waveguide 4 and the radiation waveguide 7 with the dielectric 70, it is possible to reduce cross-sectional dimensions of the feeding waveguide 4 and the radiation waveguide 7. By this structure, the feeding waveguide 4 and the radiation waveguide 7 can be made smaller or thinner and lighter, so that the whole antenna apparatus can be made smaller in size and lighter in weight.

The filling of the dielectric into the feeding waveguide 4 and the radiation waveguide 7 as mentioned above may be applied to the above-mentioned third, fourth, sixth, eighth, and ninth preferred embodiments.

Modified Preferred Embodiment of First Preferred Embodiment

Figure 43:
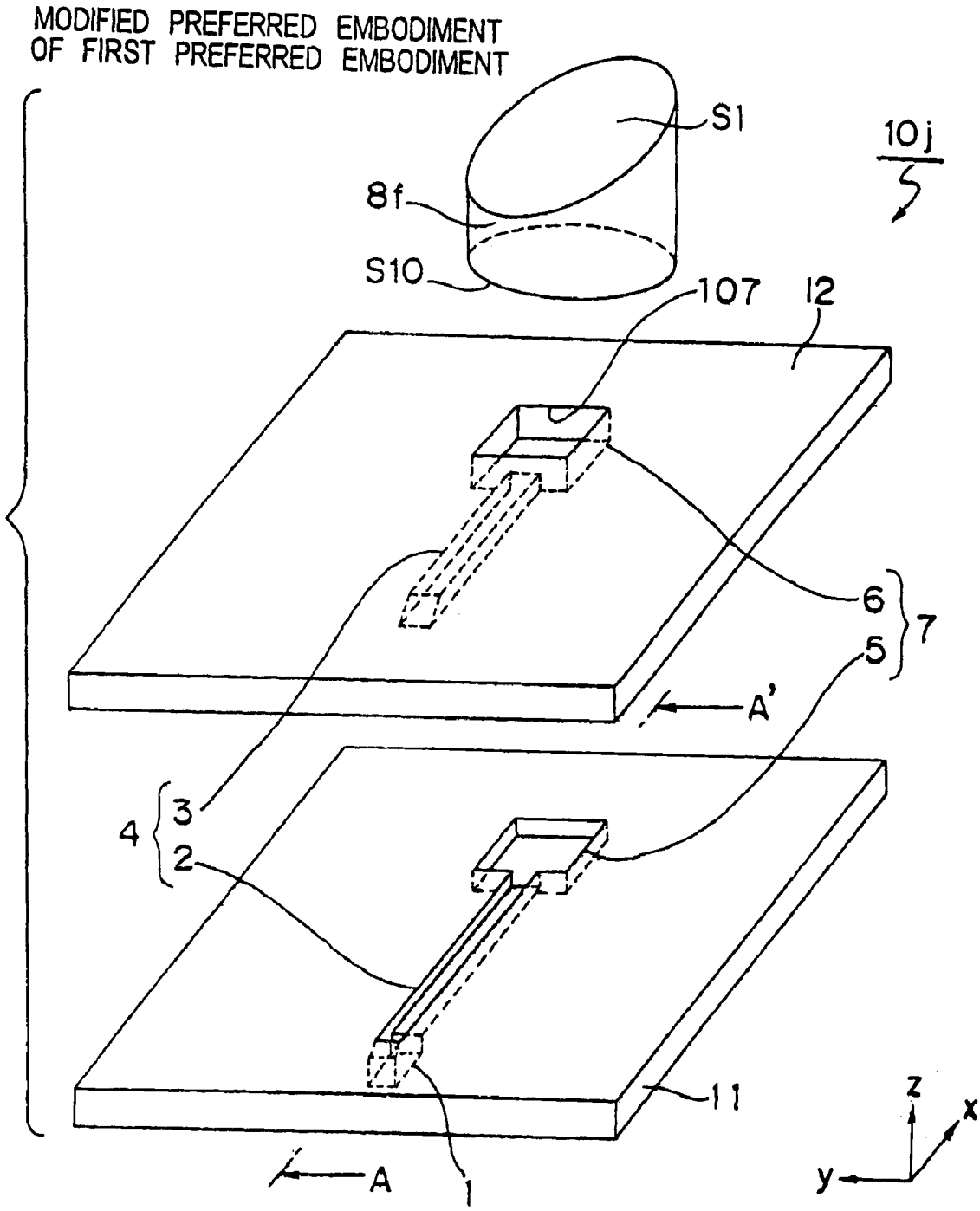
FIG. 43 is an exploded perspective view showing a configuration of a dielectric loaded antenna apparatus of a modified preferred embodiment of the first preferred embodiment according to the present invention.

FIG. 43 is an exploded perspective view of a dielectric loaded antenna apparatus of a modified preferred embodiment of the first preferred embodiment according to the present invention. The dielectric loaded antenna apparatus of the present modified preferred embodiment is characterized by providing a loaded dielectric 8*f* having an elliptic cross section perpendicular to the axial direction thereof and an elliptic bottom surface S10 in place of the loaded dielectric 8 provided in the dielectric loaded antenna apparatus of the first preferred embodiment shown in FIG. 1.

Referring to FIGS. 1 and 43, it is assumed that the feeding waveguide 4 is a rectangular waveguide having a rectangular opening and that an electromagnetic wave of the fundamental mode is propagated based on the height and the width of the opening. In this case, an electric field is generated in the width direction or the y-axial direction in FIGS. 1 and 43 intersecting the longitudinal direction or the axial direction of the feeding waveguide 4. Since the feeding waveguide 4 guides this generated electric field in the electric field direction as it is, the electric field is also generated in the opening 107 of the radiation waveguide 7 in the y-axial direction. As the surface on which the electric field is generated is defined as an electric field plane and the surface on which a magnetic field is generated is defined as the magnetic field plane for an ordinary antenna, the surface in the direction in which the electric field is generated on the surface of the opening 107 can be defined as the electric field plane parallel to the yz plane and the surface perpendicular to the electric field plane can be defined as the magnetic field parallel to the xz plane for the dielectric loaded antenna apparatus in the present modified preferred embodiment.

In other words, referring to FIG. 43, the electromagnetic wave guided by the feeding waveguide 4 is radiated from the radiation surface that is the inclined surface S1 of the loaded dielectric 8*f* toward the free space through the radiation waveguide 7. The radiated electromagnetic wave has an electric field plane parallel to the yz plane and a magnetic field plane parallel to the xz plane. Accordingly the electric field plane of the radiated electromagnetic wave is inclined from the inclined surface 8*f* and the magnetic field plane of the radiated electromagnetic wave is inclined from the inclined surface 8*f*. In the present modified preferred embodiment, the inclined surface S1 is inclined from the electric field plane or the magnetic field plane. However, the direction in which the inclined surface S1 is directed is not limited to this.

Eleventh Preferred Embodiment

Figure 44:
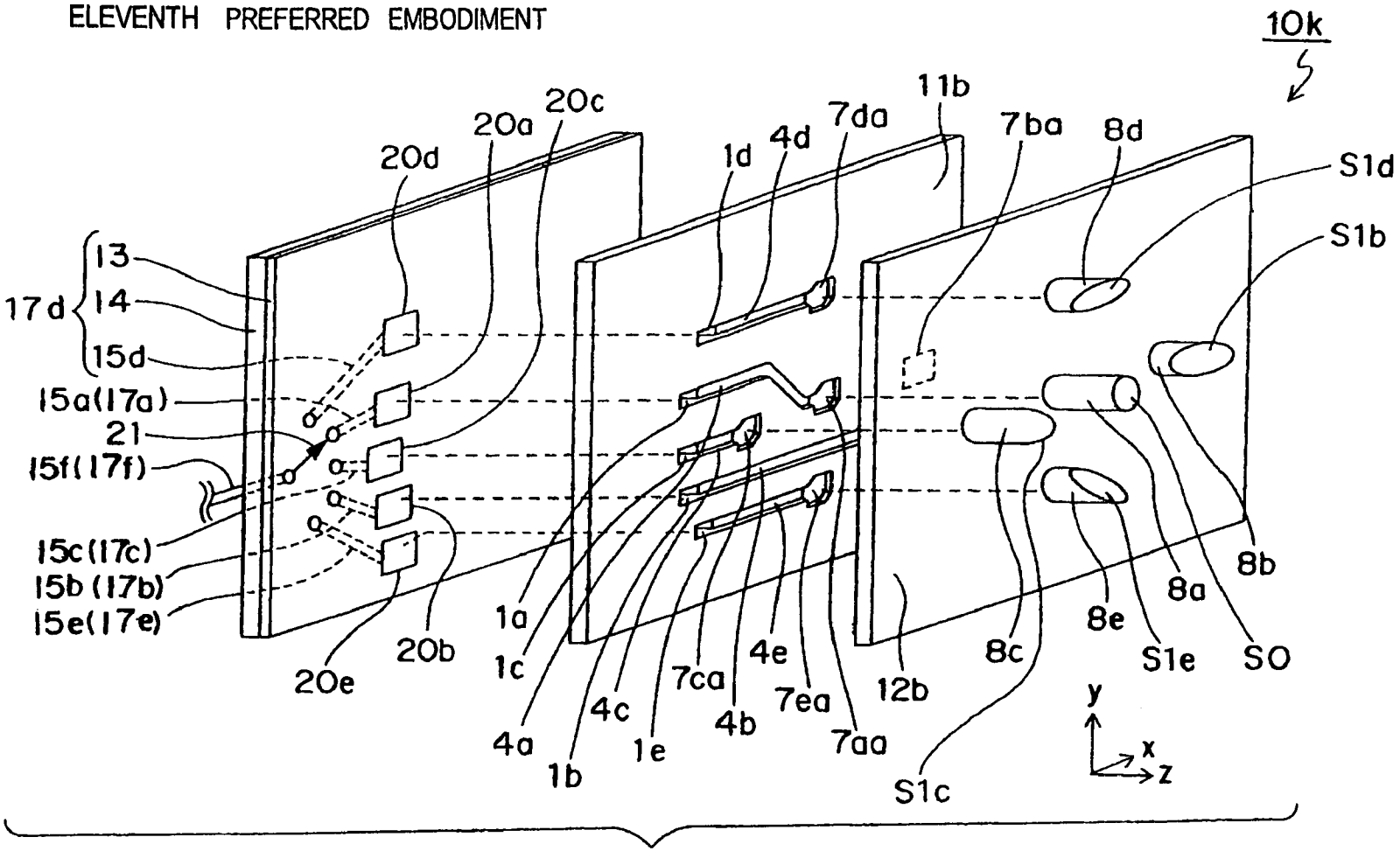
FIG. 44 is an exploded perspective view showing a configuration of a dielectric loaded antenna apparatus of a modified preferred embodiment of the eleventh preferred embodiment according to the present invention.
Figure 45:
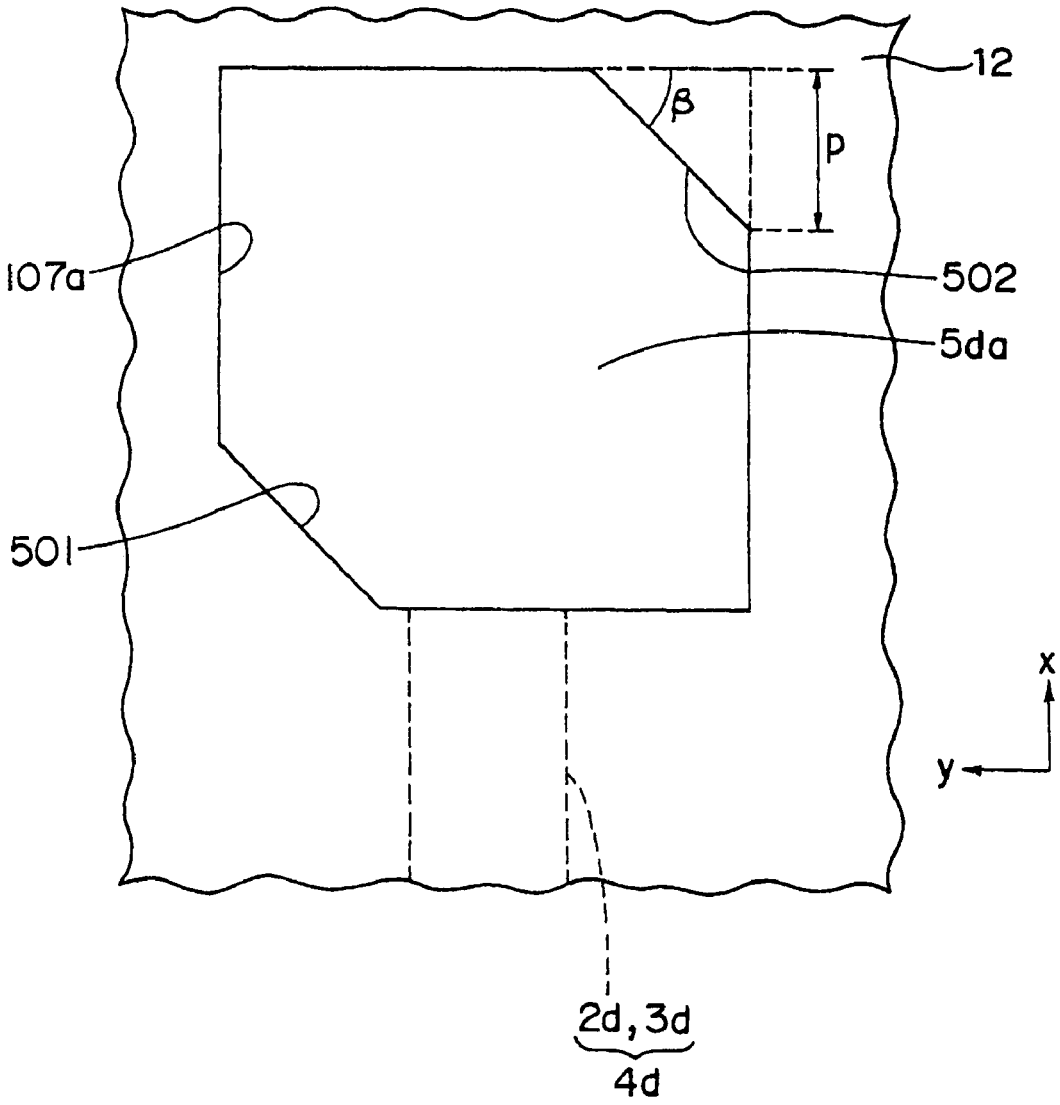
FIG. 45 is a top view showing a shape of a radiation opening 107*a* shown in FIG. 44.

FIG. 44 is an exploded perspective view of a dielectric loaded antenna apparatus of an eleventh preferred embodiment according to the present invention. FIG. 45 is a top view showing a shape of a radiation opening 107*a* shown in FIG. 44. The dielectric loaded antenna apparatus of the eleventh preferred embodiment is a modified preferred embodiment of the dielectric loaded antenna apparatus of the sixth preferred embodiment shown in FIG. 21. As compared with the dielectric loaded antenna apparatus of the sixth preferred embodiment shown in FIG. 21, the dielectric loaded antenna apparatus of the eleventh preferred embodiment is characterized in that the square opening 107 of each of the radiation waveguides 7*a*, 7*b*, 7*c*, 7*d* and 7*e* shown in FIG. 21 is formed as a hexagonal opening 107*a* and radiation waveguides 7*aa*, 7*ba*, 7*ca*, 7*da* and 7*ea* are formed.

As shown in FIG. 45, among four corners of the square opening 107 shown in FIG. 21, notches 501 and 502 are formed in the two opposing corners, to thereby form the hexagonal opening 107*a*. Each of the radiation waveguides 7*aa*, 7*ba*, 7*ca*, 7*da* and 7*ea* has the hexagonal opening 107*a*. In the sixth preferred embodiment shown in FIG. 21, the electric field is generated in the y-axial direction. In the present preferred embodiment, by contrast, the electric field is generated in the x-axial direction by the hexagonal opening 107*a*, as well. Therefore, electric fields are generated in both of the x-axial direction and the y-axial direction and a phase difference occurs between the fields in the two axes, so that an elliptically polarized wave is generated. In the manner of the opening 107*a* shown in FIG. 45, the radiated electromagnetic wave is a left-handed polarized wave. If the hexagonal opening is formed by cutting diagonal corners other than the two corners in which the notches 501 and 502 are formed in FIG. 45, a radiated electromagnetic wave is a right-handed polarized wave.

Referring to FIG. 45, by changing an angle β at which each of the notches 501 and 502 is formed and a cutting position p, the amplitude ratio of the electric fields in the x- and y-axial directions and the phase difference therebetween can be changed. In other words, the axial ratio or the ellipticity of the elliptically polarized wave can be changed. Therefore, if the angle β and the cutting position p are changed and the amplitudes of the two electric fields in the x and y-axial directions are set to be substantially equal to each other, and the phase difference between the two electric fields is set to 90 degrees, the electromagnetic wave of circularly polarized wave can be radiated from the opening 107*a* of each of the radiation waveguides 7*aa* to 7*ea*, and then radiated through each of the loaded dielectrics 8*a* to 8*e*. It is thereby possible to radiate the circularly polarized electromagnetic wave from the array antenna apparatus.

In the present preferred embodiment, the loaded dielectrics 8*a* to 8*e* each having an inclined radiation surface are loaded on the openings 107*a* of the radiation waveguides 7*aa* to 7*ae*, respectively. Therefore, there can be realized a circularly polarized wave radiating array antenna apparatus capable of changing a radiation direction according to the radiation surface. Further, as shown in FIG. 44, the respective dielectric loaded antenna apparatuses can be selectively switched over using the switch 21. Therefore, there can be realized the array antenna apparatus which radiates a circularly polarized wave with a higher gain and has a wider coverage area.

Twelfth Preferred Embodiment

Figure 46:
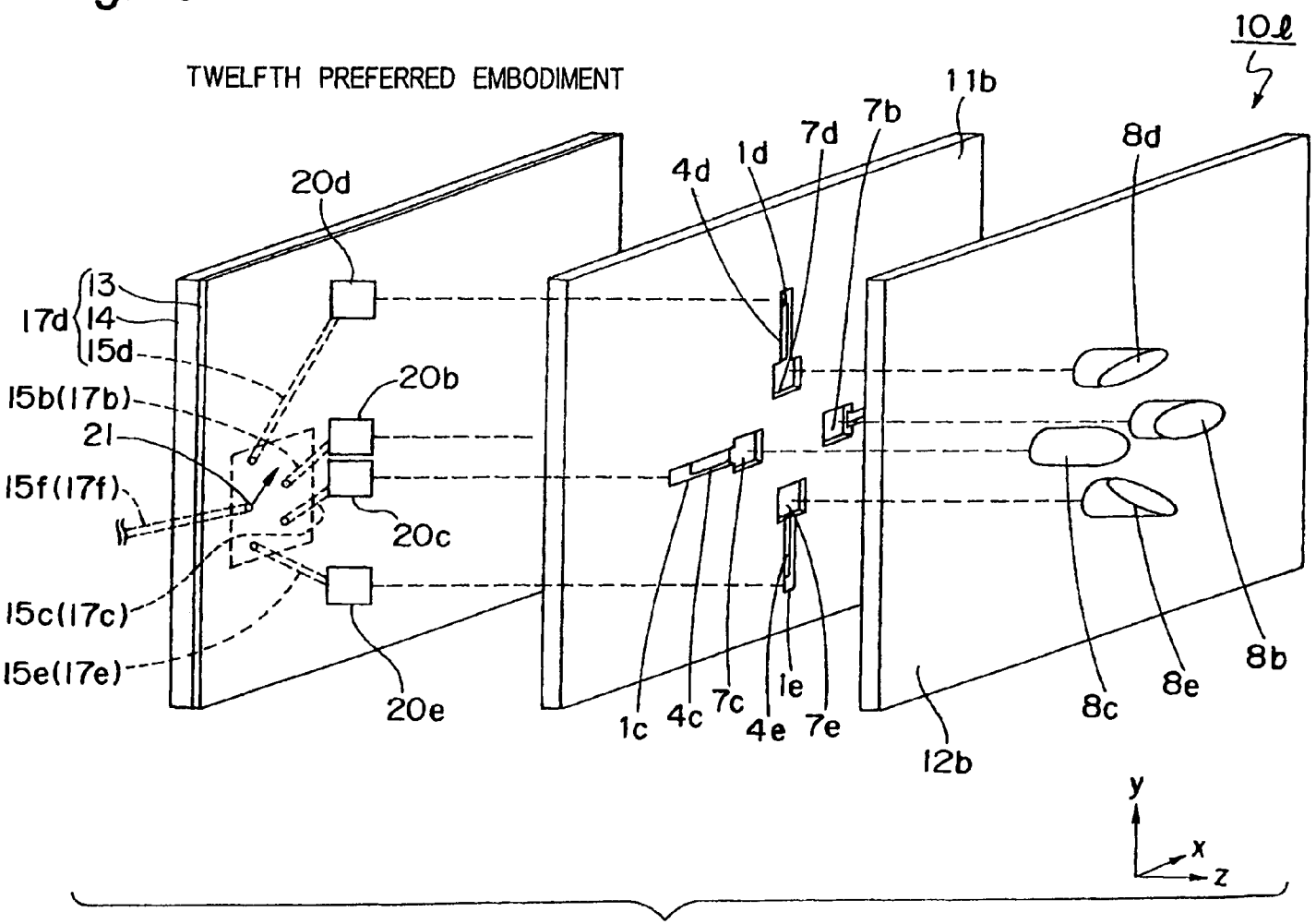
FIG. 46 is an exploded perspective view showing a dielectric loaded antenna apparatus of a twelfth preferred embodiment according to the present invention.

FIG. 46 is an exploded perspective view of a dielectric loaded antenna apparatus of a twelfth preferred embodiment according to the present invention.

The dielectric loaded antenna apparatus of the twelfth preferred embodiment is a modified preferred embodiment of the dielectric loaded antenna apparatus of the sixth preferred embodiment shown in FIG. 21. The dielectric loaded antenna apparatus of the twelfth preferred embodiment is different from that of the sixth preferred embodiment shown in FIG. 21 in the following points as shown in FIG. 46.

(A) The loaded dielectric 8*a* and the radiation waveguide 7*a*, the feeding waveguide 4*a* and the like connected with the dielectric 8*a* are eliminated.

(B) The feeding waveguides 4*b*, 4*c*, 4*d*, and 4*e* are formed so that the feeding directions of the feeding waveguides 4*b*, 4*c*, 4*d*, and 4*e* parallel to the axial directions of the respective feeding waveguides 4*b*, 4*c*, 4*d*, and 4*e* for respective pairs of radiation waveguides (7*b*, 7*d*), (7*d*, 7*c*), (7*c*, 7*e*), and (7*e*, 7*b*) located to be adjacent to each other are perpendicular to end surfaces of the radiation waveguides 7*b*, 7*c*, 7*d* and 7*e* when the feeding directions thereof intersect end surfaces of the radiation waveguides 7*b*, 7*c*, 7*d* and 7*e*. These waveguides 7*b*, 7*c*, 7*d* and 7*e* are arranged so that the axial directions of the feeding waveguides 4*b*, 4*c*, 4*d* and 4*e* pass through the central portions in the width direction (the centers of the openings) of the feeding openings 1*b* to 1*e* and so that width directions of the feeding waveguides 4*b*, 4*c*, 4*d* and 4*e* are parallel to the width directions of the feeding openings 1*b* to 1*e*, respectively.

In the preferred embodiment shown in FIG. 46, electromagnetic waves are fed to the loaded dielectrics 8*d* and 8*e* by the feeding waveguides 7*d* and 7*e* each having a width direction parallel to the x-axial direction, respectively. However, electromagnetic waves are fed to the loaded dielectrics 8*b* and 8*c* by the feeding waveguides 7*b* and 7*c* each having the width direction in the y-axial direction, respectively, and therefore, the electromagnetic waves of linearly polarized waves are radiated in parallel to the y-axial direction. In this case, the loaded dielectric 8*b* is closer to the loaded dielectrics 8*d* and 8*e* than the loaded dielectric 8*c*, so that polarized waves thereof are made to be perpendicular to each other between the loaded dielectrics 8*b* and 8*d* and the polarized waves thereof are made to be perpendicular to each other between the loaded dielectrics 8*b* and 8*e*. Further, the loaded dielectric 8*c* is closer to the loaded dielectrics 8*d* and 8*e* than the loaded dielectric 8*b*, so that the polarized waves thereof are made to be perpendicular to each other between the loaded dielectrics 8*c* and 8*d* and polarized waves thereof are made perpendicular to each other between the loaded dielectrics 8*c* and 8*d*. In other words, the feeding directions of the feeding waveguides toward the radiation waveguide corresponding to each pair of the adjacent loaded dielectrics are made to be perpendicular to each other, and the polarized waves of the electromagnetic waves radiated from the pair of adjacent loaded dielectrics are thereby made to be perpendicular to each other.

According to the present preferred embodiment, the polarized waves of the electromagnetic waves radiated from each pair of adjacent loaded dielectrics are made to be perpendicular to each other. This leads to that the coupled electric fields from each pair of the loaded dielectrics mainly include perpendicular components, and it becomes difficult to combine these components. Therefore, it is possible to decrease the influence of coupling between elements (these elements means herein respective dielectric loaded antenna apparatuses in the array antenna apparatus). If the coupling between elements is decreased, the element does not receive the electromagnetic wave radiated from the adjacent element. Therefore, it is possible to ensure a better element isolation characteristic. If the influence of the element coupling can be decreased, the array antenna apparatus can be designed more easily. Further, the distance between the loaded dielectrics can be shortened so that the whole structure of the apparatus can be made to be smaller in size.

In the present preferred embodiment, the four loaded dielectrics 8*b* to 8*e* are employed. However, the number of loaded dielectrics is not limited to four, and may be an arbitrary plural number. In the present preferred embodiment, electromagnetic waves are fed using the feeding waveguides 4*b* to 4*e*. However, the present invention is not limited to this, and electromagnetic waves may be fed using the feeding microstrip lines shown in FIG. 20. Further, in the present preferred embodiment, the linearly polarized waves of the electromagnetic waves radiated from each pair of adjacent loaded dielectrics are made to be perpendicular to each other. However, the present invention is not limited to this. The array antenna apparatus may be a combination of the array antenna apparatus of the eleventh preferred embodiment and the array antenna apparatus of the twelfth preferred embodiment. In other words, the array antenna apparatus may be constituted to make the circularly polarized waves of the electromagnetic waves radiated from each pair of adjacent loaded dielectrics be perpendicular to each other by using the right-handed circularly polarized wave and the left-handed circularly polarized wave.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

The invention claimed is:

1. A dielectric loaded antenna apparatus comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide.

2. The dielectric loaded antenna apparatus as claimed in claim 1, wherein a cross section of said column-shaped loaded dielectric perpendicular to the axial direction of said column-shaped loaded dielectric has a shape of one of a circle, an ellipse and a polygon.

3. The dielectric loaded antenna apparatus as claimed in claim 1, wherein an interior of said waveguide is filled with a dielectric.

4. The dielectric loaded antenna apparatus as claimed in claim 1, further comprising a radome covering the dielectric loaded antenna apparatus, wherein said radome and said column-shaped loaded dielectric are formed integrally with each other.

5. The dielectric loaded antenna apparatus as claimed in claim 1, wherein the inclined radiation surface of said loaded dielectric is one of a surface inclined from an electric field plane of a radiated electromagnetic wave and a surface inclined from a magnetic field plane of the radiated electromagnetic wave.

6. The dielectric loaded antenna apparatus as claimed in claim 1, further comprising a circularly polarized wave radiating device for radiating an electromagnetic wave radiated from the dielectric loaded antenna apparatus as a circularly polarized wave.

7. The dielectric loaded antenna apparatus as claimed in claim 6, wherein the opening of said radiation waveguide has a hexagonal shape to form said circularly polarized wave radiating device.

8. A dielectric loaded antenna apparatus comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide toward one of a polarization direction of the electromagnetic wave and a direction perpendicular to the polarization direction of the electromagnetic wave.

9. The dielectric loaded antenna apparatus as claimed in claim 8, wherein a cross section of said column-shaped loaded dielectric perpendicular to the axial direction of said column-shaped loaded dielectric has a shape of one of a circle, an ellipse and a polygon.

10. The dielectric loaded antenna apparatus as claimed in claim 8, wherein an interior of said waveguide is filled with a dielectric.

11. The dielectric loaded antenna apparatus as claimed in claim 8, further comprising a radome covering the dielectric loaded antenna apparatus, wherein said radome and said column-shaped loaded dielectric are formed integrally with each other.

12. The dielectric loaded antenna apparatus as claimed in claim 8, wherein the inclined radiation surface of said loaded dielectric is one of a surface inclined from an electric field plane of a radiated electromagnetic wave and a surface inclined from a magnetic field plane of the radiated electromagnetic wave.

13. The dielectric loaded antenna apparatus as claimed in claim 8, further comprising a circularly polarized wave radiating device for radiating an electromagnetic wave radiated from the dielectric loaded antenna apparatus as a circularly polarized wave.

14. The dielectric loaded antenna apparatus as claimed in claim 13, wherein the opening of said radiation waveguide has a hexagonal shape to form said circularly polarized wave radiating device.

15. A dielectric loaded antenna apparatus comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said feeding waveguide is arranged so that a central axis of said feeding waveguide in an axial direction of said feeding waveguide is shifted from a center of said column-shaped radiation waveguide.

16. The dielectric loaded antenna apparatus as claimed in claim 15, wherein a cross section of said column-shaped loaded dielectric perpendicular to the axial direction of said column-shaped loaded dielectric has a shape of one of a circle, an ellipse and a polygon.

17. The dielectric loaded antenna apparatus as claimed in claim 15, wherein an interior of said waveguide is filled with a dielectric.

18. The dielectric loaded antenna apparatus as claimed in claim 15, further comprising a radome covering the dielectric loaded antenna apparatus, wherein said radome and said column-shaped loaded dielectric are formed integrally with each other.

19. The dielectric loaded antenna apparatus as claimed in claim 15, wherein the inclined radiation surface of said loaded dielectric is one of a surface inclined from an electric field plane of a radiated electromagnetic wave and a surface inclined from a magnetic field plane of the radiated electromagnetic wave.

20. The dielectric loaded antenna apparatus as claimed in claim 15, further comprising a circularly polarized wave radiating device for radiating an electromagnetic wave radiated from the dielectric loaded antenna apparatus as a circularly polarized wave.

21. The dielectric loaded antenna apparatus as claimed in claim 20, wherein the opening of said radiation waveguide has a hexagonal shape to form said circularly polarized wave radiating device.

22. A dielectric loaded antenna apparatus comprising:

a dielectric substrate;

a microstrip line formed on said dielectric substrate;

a feeding patch conductor provided on an end portion of said microstrip line; and a column-shaped loaded dielectric loaded on said end portion of said microstrip line, whereby said feeding patch conductor feeds an electromagnetic wave to said column-shaped loaded dielectric, said column-shaped loaded dielectric having an inclined radiation surface which is inclined from a surface perpendicular to an axial direction of said column-shaped loaded dielectric, wherein said column-shaped loaded dielectric is arranged so that a central axis of said column-shaped loaded dielectric is shifted from a center of said feeding patch conductor.

23. A dielectric loaded antenna apparatus comprising:

a dielectric substrate;

a microstrip line formed on said dielectric substrate;

a feeding patch conductor provided on an end portion of said microstrip line; and a column-shaped loaded dielectric loaded on said end portion of said microstrip line, whereby said feeding patch conductor feeds an electromagnetic wave to said column-shaped loaded dielectric, said column-shaped loaded dielectric having an inclined radiation surface which is inclined from a surface perpendicular to an axial direction of said column-shaped loaded dielectric, wherein said column-shaped loaded dielectric is arranged so that a central axis of said column-shaped loaded dielectric is shifted from a center of said feeding patch conductor toward one of a polarization direction of the electromagnetic wave and a direction perpendicular to the polarization direction of the electromagnetic wave.

24. A dielectric loaded antenna apparatus comprising:

a dielectric substrate;

a microstrip line formed on said dielectric substrate;

a feeding patch conductor provided on an end portion of said microstrip line; and a column-shaped loaded dielectric loaded on said end portion of said microstrip line, whereby said feeding patch conductor feeds an electromagnetic wave to said column-shaped loaded dielectric, said column-shaped loaded dielectric having an inclined radiation surface which is inclined from a surface perpendicular to an axial direction of said column-shaped loaded dielectric, wherein said microstrip line is arranged so that a central axis of said microstrip line is shifted from a center of said feeding patch conductor.

25. A dielectric loaded antenna apparatus comprising:

a feeding line including a waveguide and a microstrip line;

a column-shaped loaded dielectric loaded on an end portion of said feeding line, said column-shaped loaded dielectric having an inclined radiation surface which is inclined from a surface perpendicular to an axial direction of said column-shaped loaded dielectric; and a converter inserted between said waveguide and said microstrip line, said converter matching impedance between said waveguide and said microstrip line.

26. An array antenna apparatus comprising a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide.

27. The array antenna apparatus as claimed in claim 26, wherein the respective inclined radiation surfaces of said column-shaped loaded dielectrics of said dielectric loaded antenna apparatuses are inclined at a predetermined inclination angle in a predetermined direction so as to attain a predetermined directivity pattern of the array antenna apparatus.

28. The array antenna apparatus as claimed in claim 26, further comprising a switching device for selectively switching between said column-shaped loaded dielectrics to connect a selected one of said column-shaped loaded dielectrics to a feeding line of the array antenna apparatus.

29. The array antenna apparatus as claimed in claim 26, wherein an arrangement of said respective column-shaped loaded dielectrics is changable according to an installation position of the array antenna apparatus.

30. An array antenna apparatus comprising a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide toward one of a polarization direction of the electromagnetic wave and a direction perpendicular to the polarization direction of the electromagnetic wave.

31. The array antenna apparatus as claimed in claim 30, wherein the respective inclined radiation surfaces of said column-shaped loaded dielectrics of said dielectric loaded antenna apparatuses are inclined at a predetermined inclination angle in a predetermined direction so as to attain a predetermined directivity pattern of the array antenna apparatus.

32. The array antenna apparatus as claimed in claim 30, further comprising a switching device for selectively switching between said column-shaped loaded dielectrics to connect a selected one of said column-shaped loaded dielectrics to a feeding line of the array antenna apparatus.

33. The array antenna apparatus as claimed in claim 30, wherein an arrangement of said respective column-shaped loaded dielectrics is changable according to an installation position of the array antenna apparatus.

34. An array antenna apparatus comprising a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said feeding waveguide is arranged so that a central axis of said feeding waveguide in an axial direction of said feeding waveguide is shifted from a center of said column-shaped radiation waveguide.

35. The array antenna apparatus as claimed in claim 34, wherein the respective inclined radiation surfaces of said column-shaped loaded dielectrics of said dielectric loaded antenna apparatuses are inclined at a predetermined inclination angle in a predetermined direction so as to attain a predetermined directivity pattern of the array antenna apparatus.

36. The array antenna apparatus as claimed in claim 34, further comprising a switching device for selectively switching between said column-shaped loaded dielectrics to connect a selected one of said column-shaped loaded dielectrics to a feeding line of the array antenna apparatus.

37. The array antenna apparatus as claimed in claim 34, wherein an arrangement of said respective column-shaped loaded dielectrics is changable according to an installation position of the array antenna apparatus.

38. An array antenna apparatus comprising a plurality of dielectric loaded antenna apparatuses apart from each other by a predetermined distance, each of said dielectric loaded antenna apparatuses including a feeding line and a column-shaped loaded dielectric loaded on an end portion of said feeding line, said column-shaped loaded dielectric having an inclined radiation surface which is inclined from a surface perpendicular to an axial direction of said column-shaped loaded dielectric, wherein at least one of said plurality of dielectric loaded antenna apparatuses is removable based on an installation position of the array antenna apparatus.

39. An array antenna apparatus comprising a plurality of dielectric loaded antenna apparatuses apart from each other by a predetermined distance, each of said dielectric loaded antenna apparatuses including a feeding line and a column-shaped loaded dielectric loaded on an end portion of said feeding line, said column-shaped loaded dielectric having an inclined radiation surface which is inclined from a surface perpendicular to an axial direction of said column-shaped loaded dielectric, wherein said dielectric loaded antenna apparatuses are arranged so that linear polarized waves of electromagnetic waves radiated from each pair of said dielectric loaded antenna apparatuses arranged to be adjacent to each other among said dielectric loaded antenna apparatuses are perpendicular to each other.

40. A radio communication apparatus comprising:

a substrate;

a dielectric loaded antenna apparatus arranged on said substrate; and a radio transceiver circuit provided on a surface of said substrate or in said substrate, said radio transceiver circuit being connected with said dielectric loaded antenna apparatus, wherein said dielectric loaded antenna apparatus comprises:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide.

41. The radio communication apparatus as claimed in claim 40, further comprising a modulator and demodulator circuit provided on the surface of said substrate or in said substrate, said modulator and demodulator circuit being connected with said radio transceiver circuit.

42. A radio communication apparatus comprising:

a substrate;

a dielectric loaded antenna apparatus arranged on said substrate; and a radio transceiver circuit provided on a surface of said substrate or in said substrate, said radio transceiver circuit being connected with said dielectric loaded antenna apparatus, wherein said dielectric loaded antenna apparatus comprises:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide toward one of a polarization direction of the electromagnetic wave and a direction perpendicular to the polarization direction of the electromagnetic wave.

43. The radio communication apparatus as claimed in claim 42, further comprising a modulator and demodulator circuit provided on the surface of said substrate or in said substrate, said modulator and demodulator circuit being connected with said radio transceiver circuit.

44. A radio communication apparatus comprising:

a substrate;

a dielectric loaded antenna apparatus arranged on said substrate; and a radio transceiver circuit provided on a surface of said substrate or in said substrate, said radio transceiver circuit being connected with said dielectric loaded antenna apparatus, wherein said dielectric loaded antenna apparatus comprises:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said feeding waveguide is arranged so that a central axis of said feeding waveguide in an axial direction of said feeding waveguide is shifted from a center of said column-shaped radiation waveguide.

45. The radio communication apparatus as claimed in claim 44, further comprising a modulator and demodulator circuit provided on the surface of said substrate or in said substrate, said modulator and demodulator circuit being connected with said radio transceiver circuit.

46. A radio communication apparatus comprising:

a substrate;

an array antenna apparatus arranged on said substrate; and a radio transceiver circuit provided on a surface of said substrate or in said substrate, said radio transceiver circuit being connected with said array antenna apparatus, wherein said array antenna apparatus comprises a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide.

47. The radio communication apparatus as claimed in claim 46, further comprising a modulator and demodulator circuit provided on the surface of said substrate or in said substrate, said modulator and demodulator circuit being connected with said radio transceiver circuit.

48. A radio communication apparatus comprising:

a substrate;

an array antenna apparatus arranged on said substrate; and a radio transceiver circuit provided on a surface of said substrate or in said substrate, said radio transceiver circuit being connected with said array antenna apparatus, wherein said array antenna apparatus comprises a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said column-shaped loaded dielectric is arranged so that a central axis of said column-shaped loaded dielectric is shifted from a central axis of said radiation waveguide toward one of a polarization direction of the electromagnetic wave and a direction perpendicular to the polarization direction of the electromagnetic wave.

49. The radio communication apparatus as claimed in claim 48, further comprising a modulator and demodulator circuit provided on the surface of said substrate or in said substrate, said modulator and demodulator circuit being connected with said radio transceiver circuit.

50. A radio communication apparatus comprising:

a substrate;

an array antenna apparatus arranged on said substrate; and a radio transceiver circuit provided on a surface of said substrate or in said substrate, said radio transceiver circuit being connected with said array antenna apparatus, wherein said array antenna apparatus comprises a plurality of dielectric loaded antenna apparatuses apart from each other by a predetermined distance, each of said dielectric loaded antenna apparatuses comprising:

a waveguide; and a column-shaped loaded dielectric loaded on an end portion of said waveguide, said column-shaped loaded dielectric having an inclined radiation surface which is inclined from a surface perpendicular to an axial direction of said column-shaped loaded dielectric, wherein said waveguide includes:

a radiation waveguide having an axis parallel to the axial direction of said column-shaped loaded dielectric and including an opening for feeding an electromagnetic wave to said column-shaped loaded dielectric; and a feeding waveguide for feeding the electromagnetic wave to said radiation waveguide, and wherein said feeding waveguide is arranged so that a central axis of said feeding waveguide in an axial direction of said feeding waveguide is shifted from a center of said column-shaped radiation waveguide.

51. The radio communication apparatus as claimed in claim 50, further comprising a modulator and demodulator circuit provided on the surface of said substrate or in said substrate, said modulator and demodulator circuit being connected with said radio transceiver circuit.

* * * * *